US008567396B2

(12) United States Patent
Whitesel et al.

(10) Patent No.: US 8,567,396 B2
(45) Date of Patent: Oct. 29, 2013

(54) BREATHING GAS SUPPLY SYSTEM

(75) Inventors: Mary B. Whitesel, Grafton, OH (US); Martin Fabian, Bay Village, OH (US); Valentine Antonio Hodos, Cleveland, OH (US); Joseph M. Kolecki, Brooklyn, OH (US)

(73) Assignee: Invacare Corp., Elyria, OH (US)

( * ) Notice: Subject to any disclaimer, the term of this patent is extended or adjusted under 35 U.S.C. 154(b) by 156 days.

(21) Appl. No.: 13/023,006

(22) Filed: Feb. 8, 2011

(65) Prior Publication Data

US 2011/0192122 A1 Aug. 11, 2011

Related U.S. Application Data

(60) Provisional application No. 61/302,906, filed on Feb. 9, 2010.

(51) Int. Cl.
*A62B 7/00* (2006.01)

(52) U.S. Cl.
USPC ..... 128/204.18; 55/357

(58) Field of Classification Search
USPC ..... 96/108, 121, 147; 55/357; 95/47, 130; 128/200.24, 204.18, 205.12, 205.27
See application file for complete search history.

(56) References Cited

U.S. PATENT DOCUMENTS

| | | | | |
|---|---|---|---|---|
| 4,342,573 | A | 8/1982 | McCombs et al. | |
| 4,511,377 | A | 4/1985 | McCombs | |
| 5,524,321 | A | 6/1996 | Weaver et al. | |
| 5,988,165 | A | 11/1999 | Richey, II et al. | |
| 6,068,680 | A * | 5/2000 | Kulish et al. | 95/98 |
| 6,923,180 | B2 | 8/2005 | Richey, II et al. | |
| 7,156,903 | B2 | 1/2007 | McCombs | |
| 7,510,601 | B2 * | 3/2009 | Whitley et al. | 96/121 |
| 8,016,925 | B2 * | 9/2011 | McCombs et al. | 96/121 |
| 2003/0167924 | A1 | 9/2003 | McCombs et al. | |
| 2003/0200865 | A1 | 10/2003 | McCombs et al. | |
| 2007/0065301 | A1 | 3/2007 | Goertzen et al. | |
| 2007/0261182 | A1 | 11/2007 | Fernandez-Grandizo Martinez et al. | |
| 2008/0105258 | A1 | 5/2008 | Deane et al. | |
| 2008/0156193 | A1 * | 7/2008 | Wang | 96/112 |
| 2009/0065007 | A1 | 3/2009 | Wilkinson et al. | |

OTHER PUBLICATIONS

International Search Report and Written Opinion from PCT/US11/24005 dated Apr. 4, 2011.

HomeFill Oxygen System with Concentrator, Product ID: IOH200PV95PO2, one printed webpage, Invacare Product Catalog, printed Jun. 18, 2010 from http://www.invacare.com/cgi-bin/imhqprd/inv_catalog/prod_cat_detail.jsp?s=O&prodID=I . . . .

Invacare Corporation, Operator's Manual, HomeFill II Compressor, 40 pgs., Revision G, Nov. 1, 2006, copyright 2006.

(Continued)

*Primary Examiner* — Frank Lawrence, Jr.

(74) *Attorney, Agent, or Firm* — Calfee Halter & Griswold, LLP

(57) ABSTRACT

An oxygen concentrator and compressor assembly. An oxygen concentrator is disposed in a housing having an upper end. A compressor is disposed in a housing having a lower end. The upper end of the oxygen concentrator housing and the lower end of the compressor housing are configured such that placement of the lower end of the compressor housing on the upper end of the oxygen concentrator housing sets the position of the compressor housing with respect to the oxygen concentrator housing.

42 Claims, 74 Drawing Sheets

(56) References Cited

OTHER PUBLICATIONS

Invacare Corporation, User Manual, Perfecto2 Series, 32 pgs., Revision E—Nov. 2009, copyright 2009.

Invacare Corporation, Operator's Manual, Platinum Series XL, 5, 10, 32 pgs., Revision J—Apr. 2009, copyright 2009.

Invacare Corporation, User Manual, Invacare SOLO2 Transportable Oxygen Concentrator, 52 pgs., Revision C—Jan. 2010, copyright 2010.

* cited by examiner

BREATHING GAS SUPPLY SYSTEM

RELATED APPLICATIONS

The present application claims the benefit of U.S. provisional application Ser. No. 61/302,906, filed on Feb. 9, 2010, which is incorporated herein by reference in its entirety.

FIELD OF THE INVENTION

The present application relates generally to the systems and methods for providing a breathing gas including, but not limited to oxygen concentrators and compressors for compressing oxygen supplied by oxygen concentrators.

BACKGROUND

Oxygen has many important medical uses including, for example, assisting patients that have congestive heart failure or other diseases. Supplemental oxygen allows patients to receive more oxygen than is present in the ambient atmosphere.

SUMMARY

The present application discloses exemplary embodiments of an oxygen concentrator and compressor assembly. An oxygen concentrator is disposed in a housing having an upper end. A compressor is disposed in a housing having a lower end. The upper end of the oxygen concentrator housing and the lower end of the compressor housing are configured such that placement of the lower end of the compressor housing on the upper end of the oxygen concentrator housing sets the position of the compressor housing with respect to the oxygen concentrator housing.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to example the principles of this invention.

DETAILED DESCRIPTION

Figure 1A:
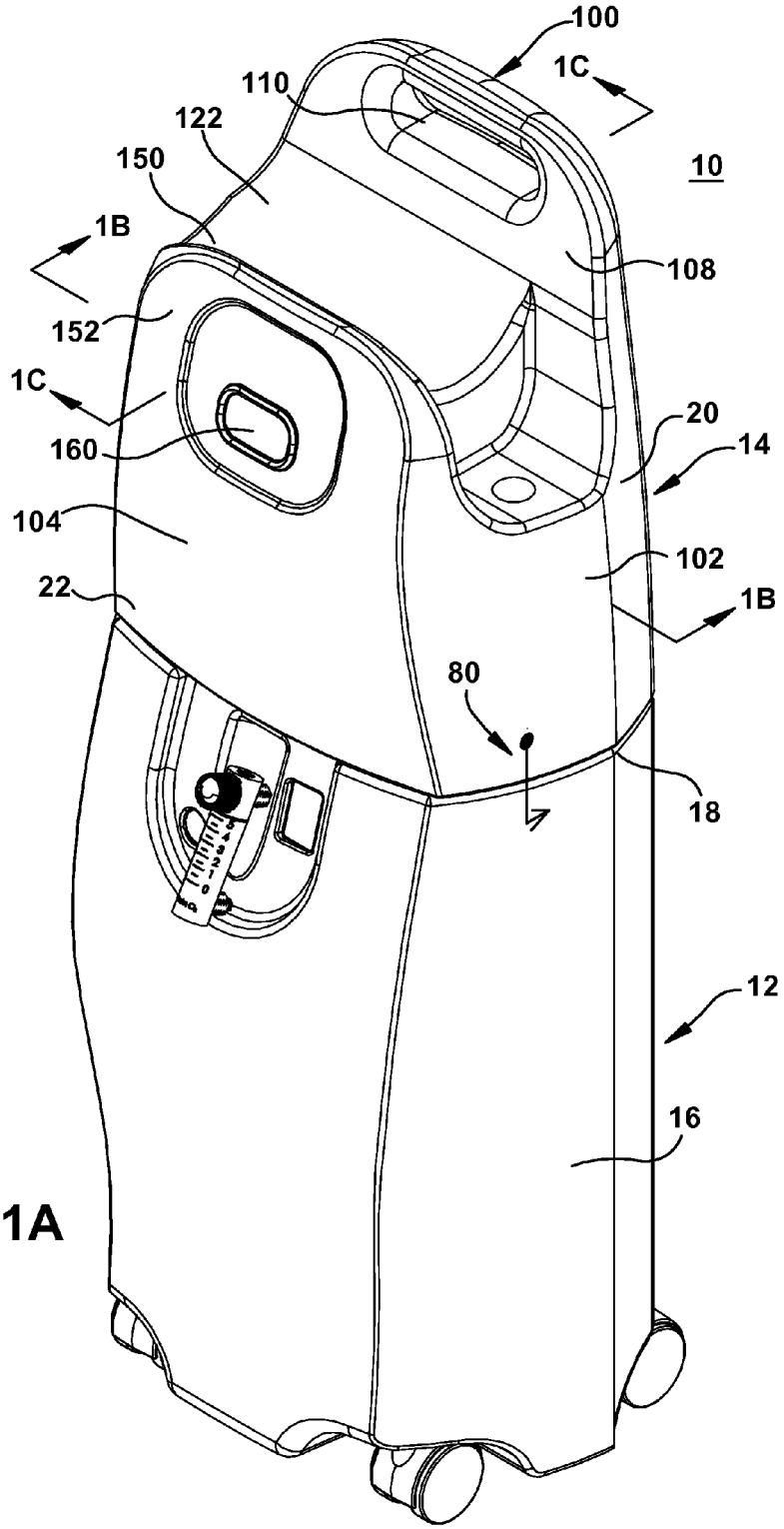
FIG. 1A is a perspective view of an oxygen concentrator and compressor assembly or system of a first embodiment.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component,"or "portion" shall not be limited to a single structural member, component, or element but can include an assembly of components, members or elements.

The present application discloses exemplary embodiments of systems and methods for delivering a breathing gas including, for example, oxygen concentrator and compressor assemblies 10. Each oxygen concentrator and compressor assembly includes an oxygen concentrator 12 and a compressor 14. Each oxygen concentrator 12 is disposed in a housing 16 having an upper end 18. Each compressor 14 is disposed in a housing 20 having a lower end 22. The upper end 18 of the oxygen concentrator housing 16 and/or the lower end 22 of the compressor housing 20 are configured such that placement of the compressor housing lower end 22 on the oxygen concentrator housing upper end 18 sets the position of the compressor housing 20 with respect to the oxygen concentrator housing 16. The setting of the compressor 14 lower end 22 on the concentrator 12 upper end 18 provides for a keying, mating, docking, modular, sectional and/or latching arrangement between the compressor 14 and the concentrator 18. In this manner, the two components present a unified, uncluttered, and space-saving system for providing a breathing gas.

The oxygen concentrator housing upper end 18 and the compressor housing lower end 22 can be configured in a wide variety of different ways to set the position of the compressor housing 16 with respect to the oxygen concentrator housing 12 when the compressor 14 is placed on top of the oxygen concentrator 12. In the illustrated embodiments, the oxygen concentrator upper end 18 includes features or surfaces that engage features or surfaces of the compressor lower end 22 to position and/or hold the compressor 14 with respect to the oxygen concentrator 12. These features or surfaces may take a wide variety of different forms. Examples of features or surfaces that can be implemented to set the position of the compressor 14 with respect to the oxygen concentrator 12 include, but are not limited to, recesses or openings that accept protrusions, such as pins or bump-outs that fit in holes, mating surfaces, and the like. Any structure that sets the position of the compressor housing 20 with respect to the oxygen concentrator housing 16 when the compressor 14 is placed on top of the oxygen concentrator 12 can be used.

In the embodiments illustrated by FIGS. 1-9 and 11-13, the oxygen concentrator housing upper end 18 may include at least one surface that is generally congruent to or congruent to at least one surface of the compressor, housing lower end 22. As used herein, "generally congruent" includes surfaces or any portion of one or more surfaces that are congruent, abutting, contacting, physically communicating or otherwise arranged for setting the relative positions of the compressor 14 and concentrator 18. In another embodiment, the surfaces may have substantially different sizes, shapes and/or configurations including, for example, being arcuate or curvilinear, straight, segmented, smooth, or combinations of the foregoing. The surfaces may engage one another when the compressor 14 is placed on the oxygen concentrator 12 to set the position of the oxygen concentrator housing with respect to the compressor housing. In an exemplary embodiment, once the surface(s) of the oxygen concentrator upper end 18 engage the surface(s) of the compressor housing lower end 22, the compressor housing 20 is not moveable with respect to the oxygen concentrator housing 16 without disengaging the compressor housing from the oxygen concentrator housing (for example, by lifting the compressor up, off of the oxygen concentrator). Optionally, these surfaces are shaped to allow placement of the compressor housing 20 on the oxygen concentrator housing 16 at only a single orientation (i.e. so that the front, back and sides of the oxygen concentrator housing are aligned with the front, back and sides of the compressor housing). As such, the compressor housing 20 is nested on top of the oxygen concentrator housing 18.

In the examples illustrated by FIGS. 1-9 and 11-13, surfaces that set the position of the compressor housing 20 with respect to the oxygen concentrator housing 16 are included on a projection 30 (see FIG. 2A) of the oxygen concentrator housing upper end 18 that fits in a recess 32 (see FIG. 3B) of the compressor housing lower end 22. In other embodiments, the oxygen concentrator housing 16 includes the recess 32 and the compressor housing 18 includes the projection. An outer surface 34 of the projection 30 cooperates with an inner surface 36 of the recess 32 to set the position of the compressor housing 20 with respect to the oxygen concentrator housing 16, when the compressor 14 is placed on top of the oxygen concentrator 12.

The projection 30 and recess 32 may take a wide variety of different forms. In one embodiment, the recess is included in the oxygen concentrator housing 16 and the projection is included on the compressor housing 20. In the illustrated embodiments, the outer surface 34 or perimeter of the projection 30 has substantially the same size and shape as the inner surface 36 of the recess 32 to set the position of the compressor housing 20 with respect to the oxygen concentrator housing 16, when the compressor 14 is placed on top of the oxygen concentrator 12. However, the projection 20 and the recess 32 may have substantially different sizes and/or shapes, such that only portions of the surfaces 34, 36 engage one another (or are in close proximity to one another) to set the position of the compressor housing 20 with respect to the oxygen concentrator housing 16 when the compressor 14 is placed on top of the oxygen concentrator 12.

As one example, FIGS. 11-13 show an embodiment where the surfaces 34, 36 are discontinuous. In this example, the concentrator housing 16 includes two projections 30 that are spaced apart by a curved recess 1100. The curved recess 1100 accommodates a user's hand beneath a handle 1110. Referring to FIG. 11D, a rim that forms the inner surface 36 of the compressor housing 20 includes gaps 1102, 1104, 1106. Gap 1102 may provide access to a port or other input or output of the concentrator 16 and or the compressor. Gaps 1104 and 1106 provide access to handles as will be described in more detail below.

The projection 30 and the recess 32 may have a wide variety of different shapes. In an exemplary embodiment, the projection 30 and recess 32 are asymmetrical about at least one axis. For example, the projection 30 and the recess 32 may be asymmetrical about both their X and Y axes. In the embodiments illustrated by FIGS. 1-3, 4-6, and 11-13 the projection 30 and recess 32 each have six curved sides of varying length (see FIGS. 2B, 3G, 5B, 6G, 12B, 13G, and 13H). However, as is illustrated by the embodiments of FIGS. 4-6 and 11-13, some of these sides may be discontinuous. In the embodiment illustrated by FIGS. 7-9 the projection 30 and recess 32 have oval shapes. However, the projection 30 and recess 32 may have any shape that sets the position of the compressor housing 20 with respect to the oxygen concentrator housing 16.

In the illustrated embodiments, the recess 32 is defined by a skirt 40 or wall (see FIG. 3B) that extends around the periphery of the compressor housing lower end 22. As such, the inner surface 36 extends substantially around an entirety of the perimeter of the compressor housing lower end 22. However, in other embodiments, the inner surface 36 and/or the skirt 40 may be discontinuous or segmented. For example, the embodiment of FIGS. 11-13 provides an example of a skirt 40 that is discontinuous or segmented to provide the gaps 1102, 1104, 1106. The skirt 40 may engage the projection 30 to set the position of the compressor housing 20 with respect to the oxygen concentrator housing 16, when the compressor 14 is placed on the oxygen concentrator.

In one exemplary embodiment, a vibration damping structure 1300 (FIG. 13B) is provided that damps vibration between the compressor housing 20 and the concentrator housing 16 caused by operation of the compressor 14 and/or the concentrator 12. The vibration damping structure 1300 reduces noise caused by vibration of the compressor 14 on the concentrator. The vibration damping structure 1300 can take a wide variety of different forms. Any structure capable of reducing vibration of the concentrator housing 16 and/or the compressor housing 20 and/or capable of inhibiting contact or rubbing between the concentrator housing 16 and/or the compressor housing 20 can be used. Examples of suitable vibration dampening structures 1300 include, but are not limited to, gaskets, springs, shock absorbers, resilient bumpers, lubricants, and the like.

Figure 13A:
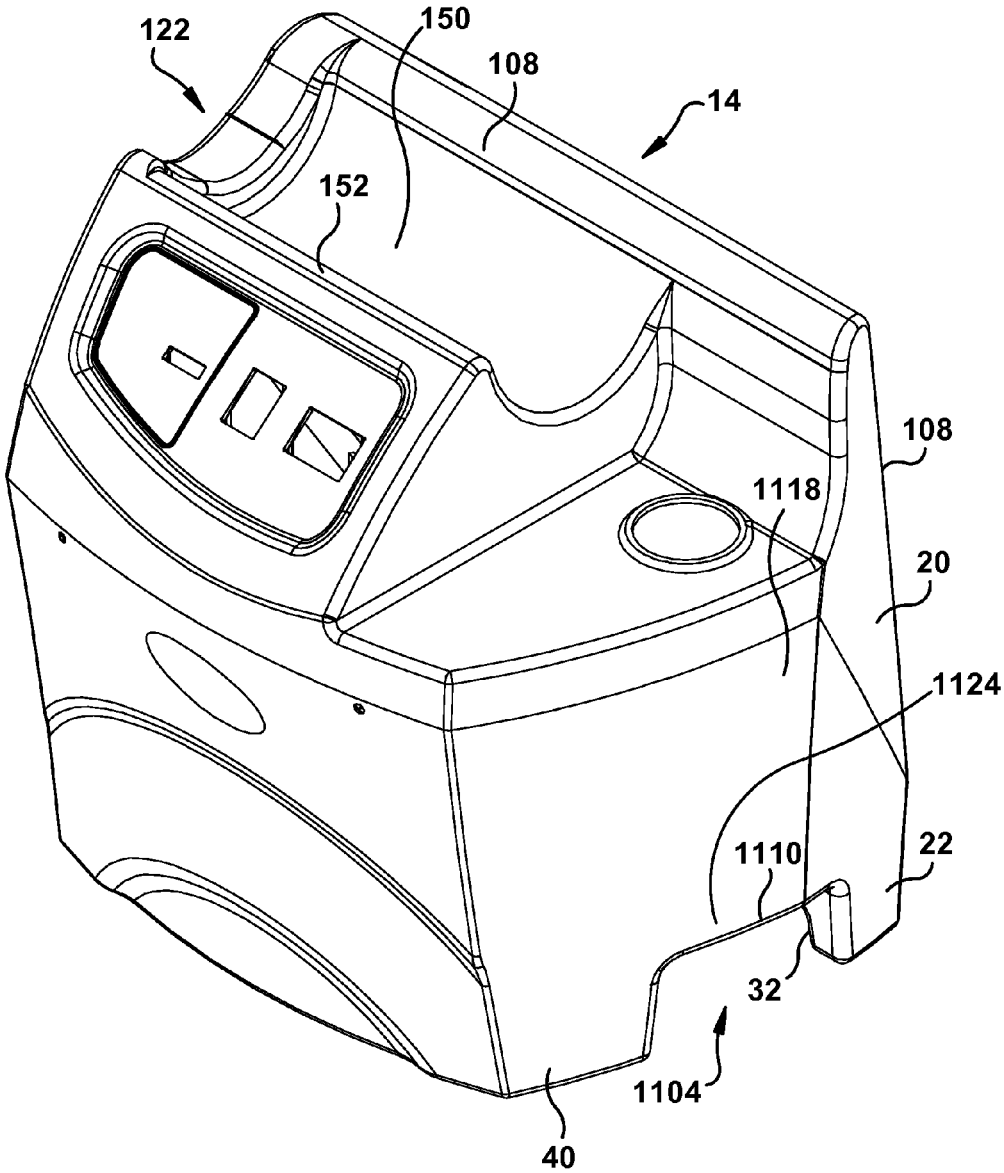
FIG. 13A is a perspective view of a compressor housing of the assembly shown in FIG. 11A.
Figure 13B:
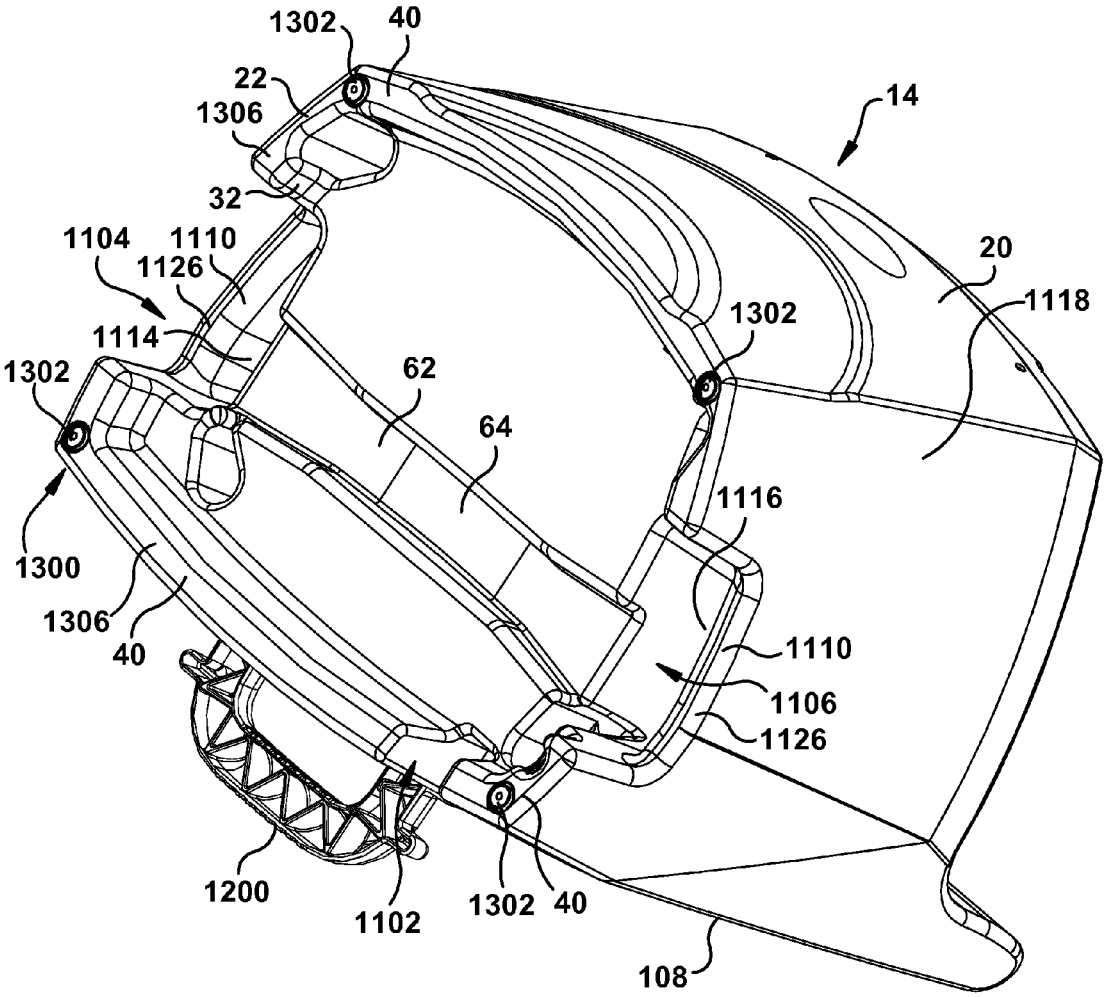
FIG. 13B is a second perspective view of the compressor housing shown in FIG. 13A, showing a lower end of the compressor housing.
Figure 13C:
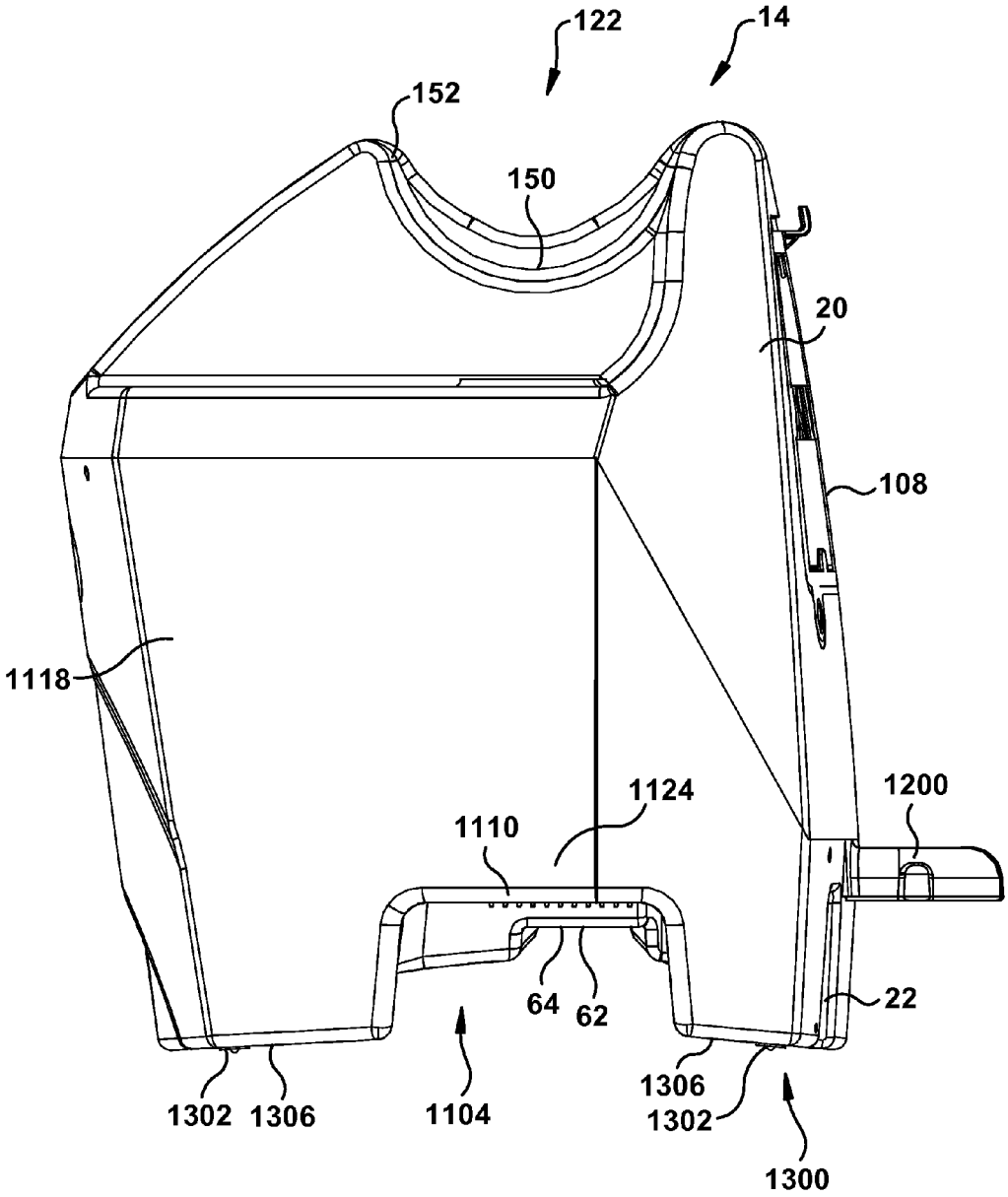
FIG. 13C is a side view of the compressor housing shown in FIG. 13A.
Figure 13D:
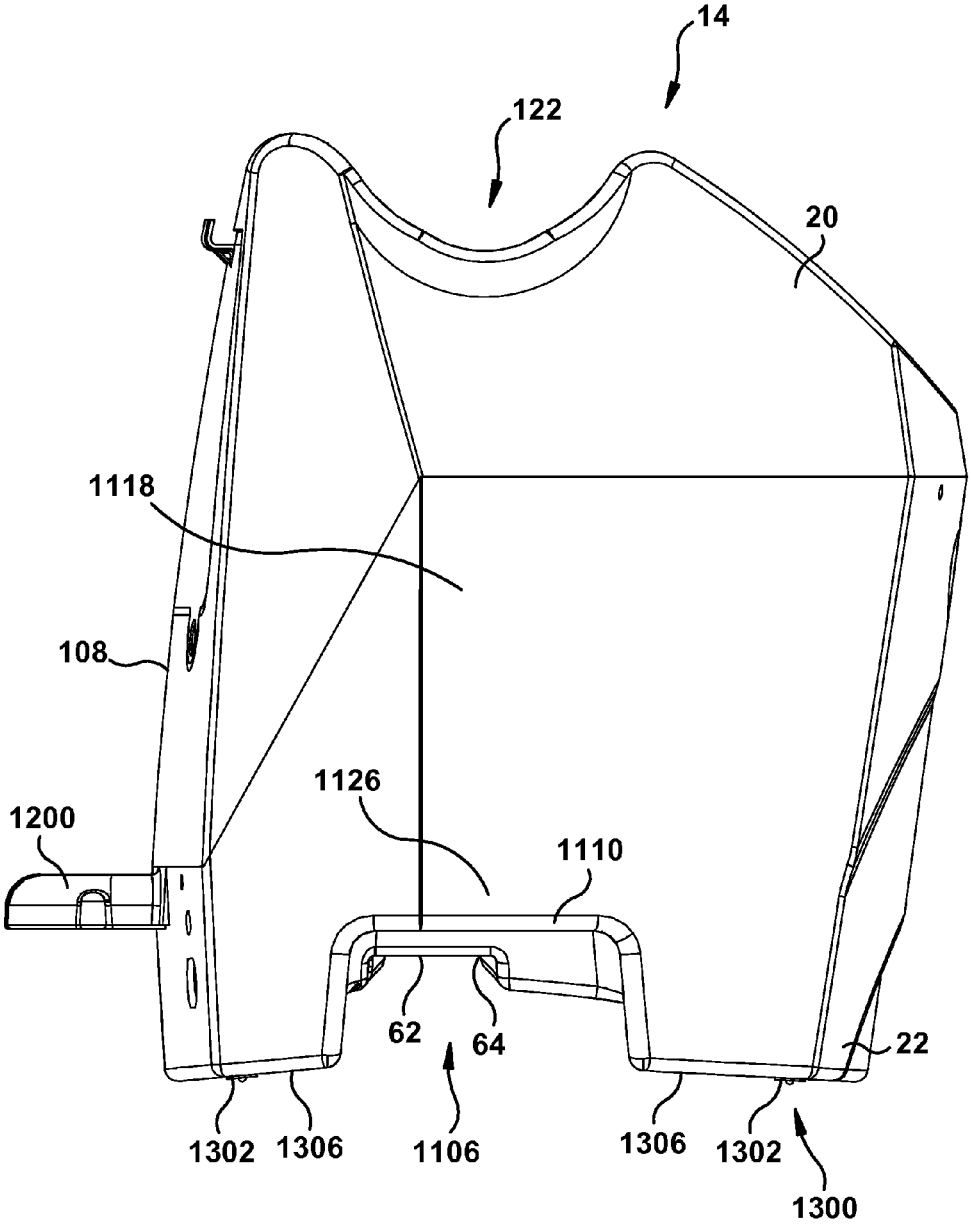
FIG. 13D is a side view of the compressor housing shown in FIG. 13A.
Figure 13E:
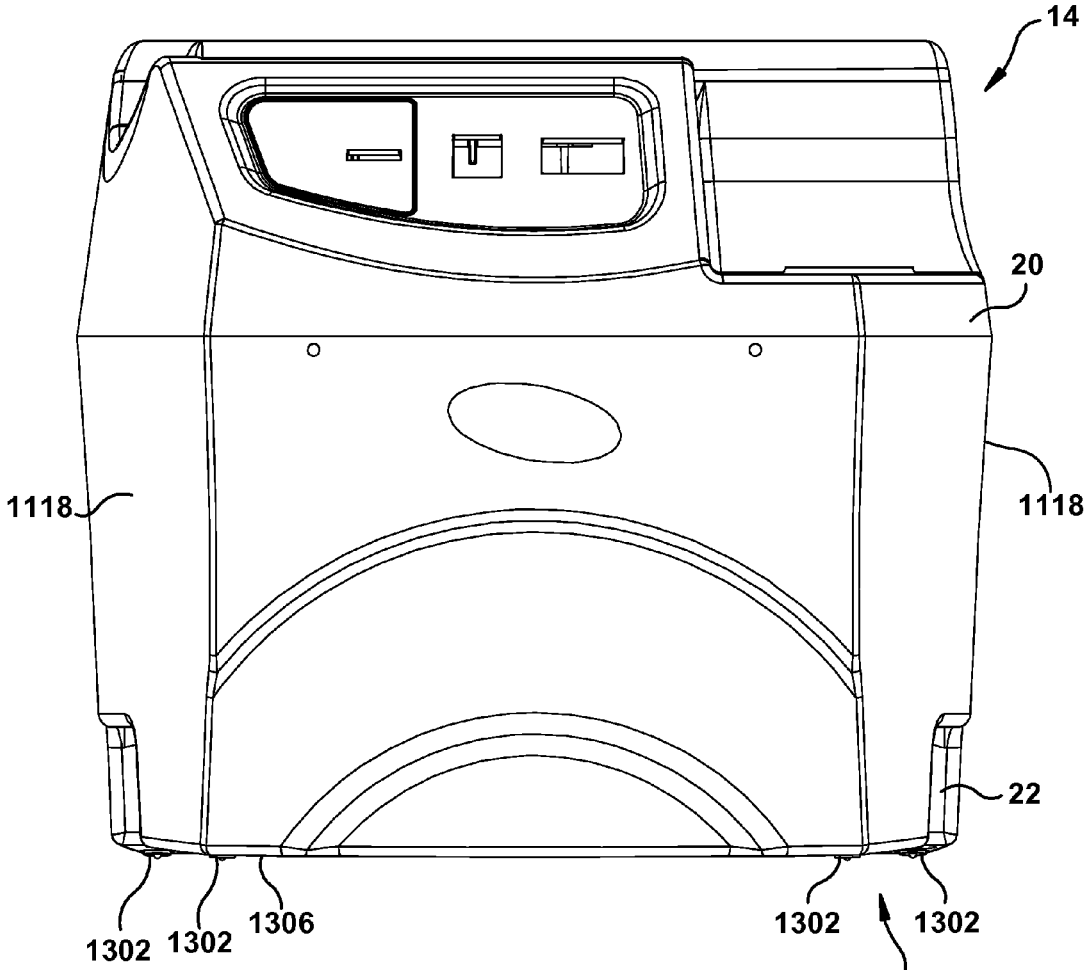
FIG. 13E is a front view of the compressor housing shown in FIG. 13A.
Figure 13F:
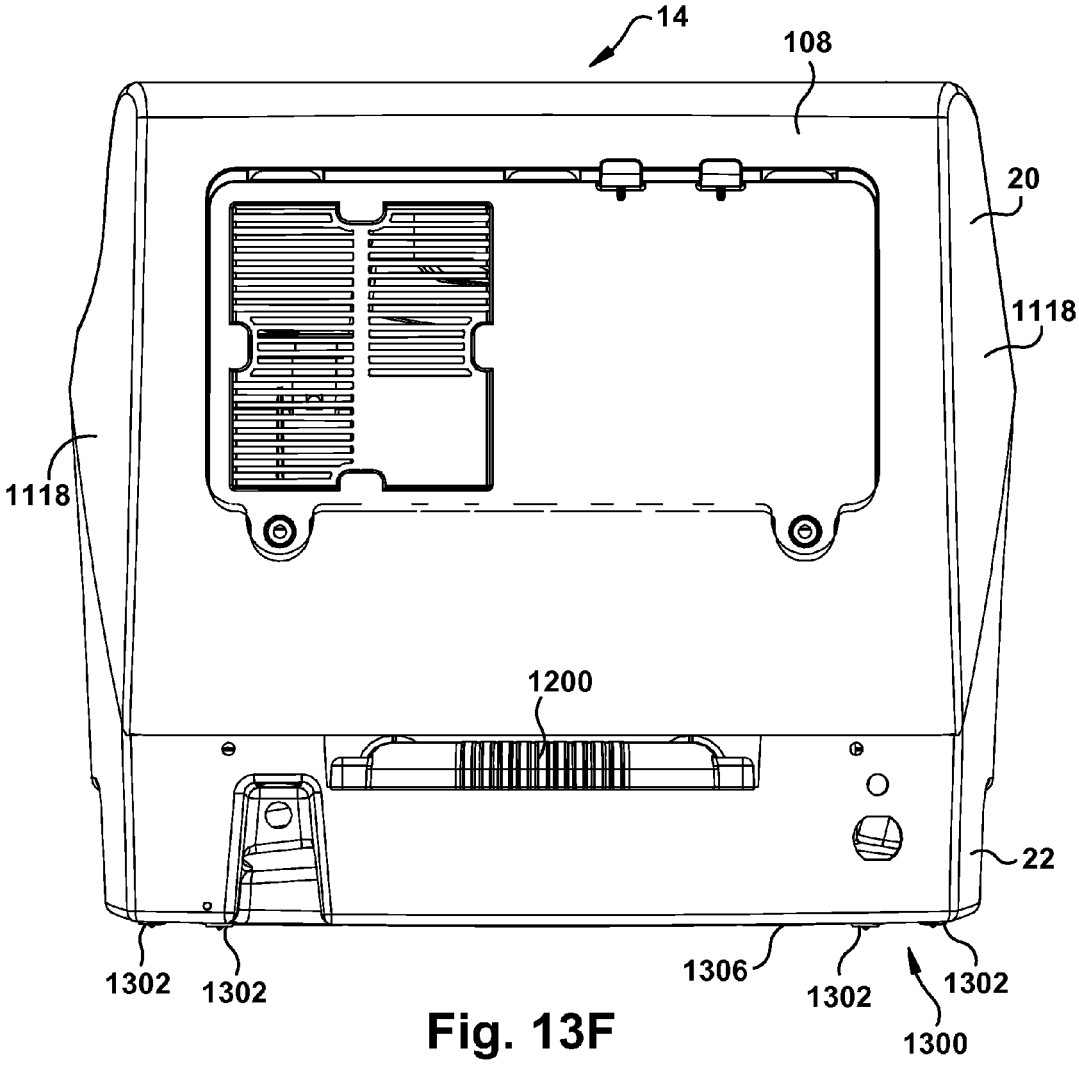
FIG. 13F is a back view of the compressor housing shown in FIG. 13A.
Figure 13G:
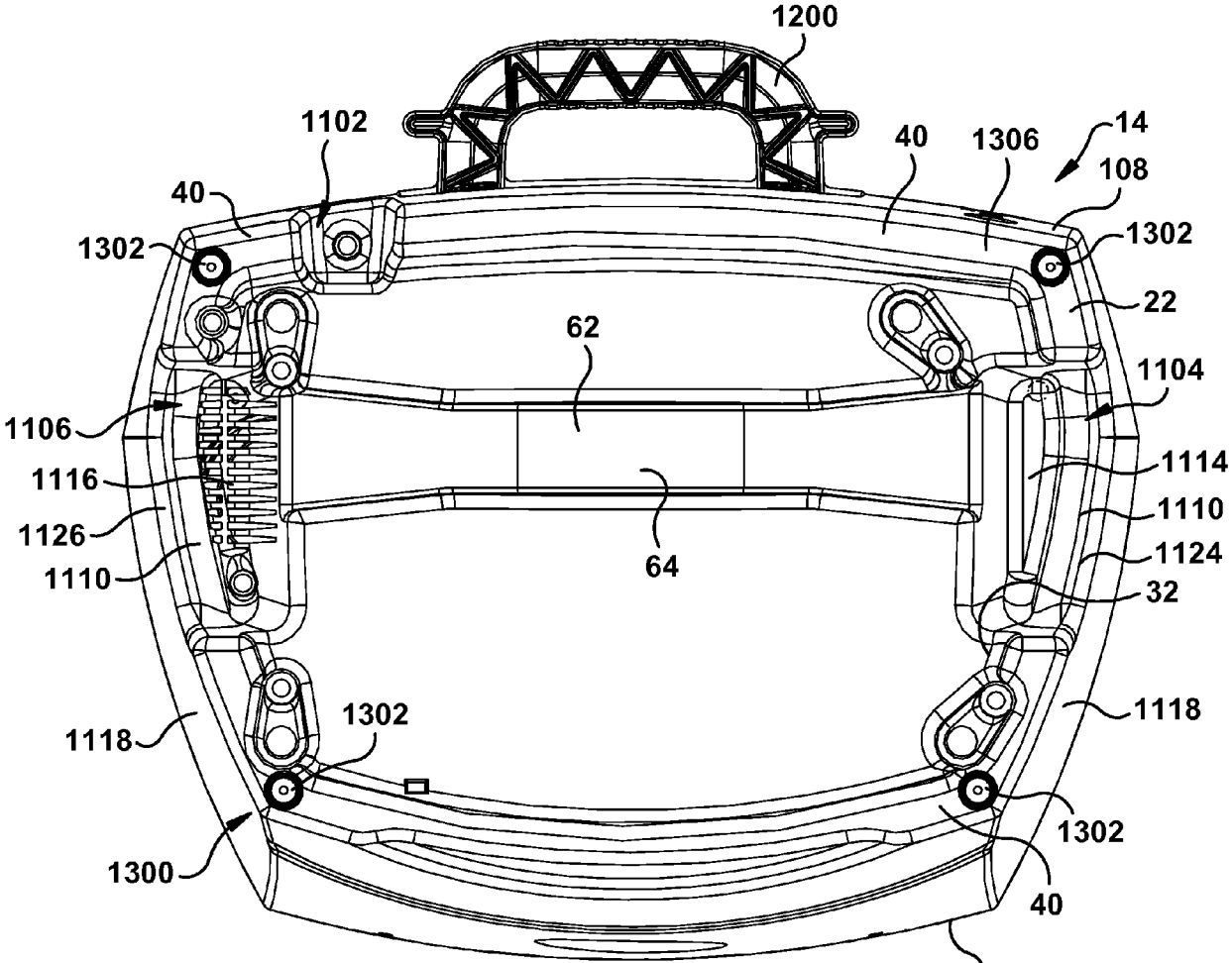
FIG. 13G is a bottom view of the compressor housing shown in FIG. 3A.
Figure 13H:
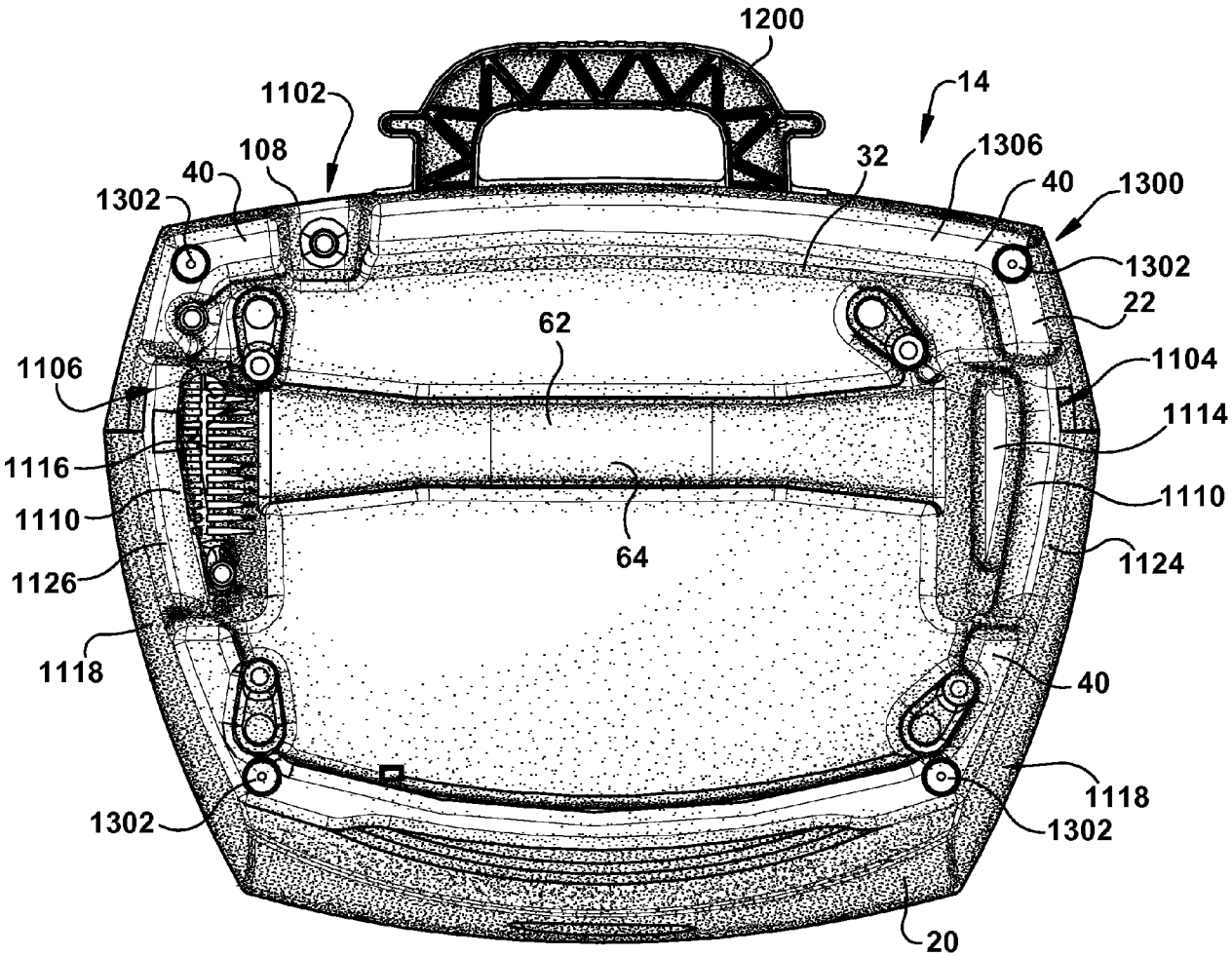
FIG. 13H is a shaded bottom view of the compressor housing shown in FIG. 13A.
Figure 13I:
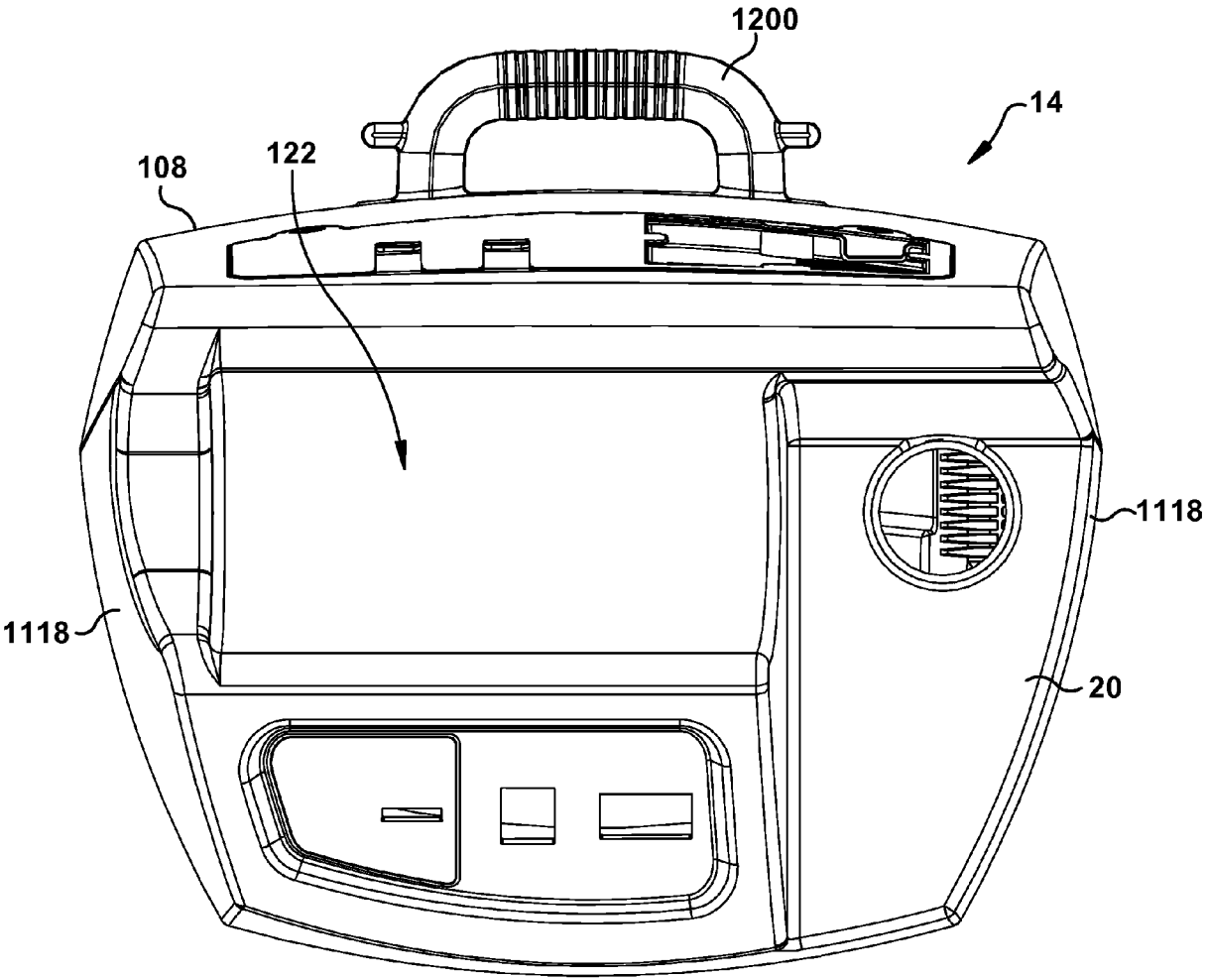
FIG. 13I is a top view of the compressor housing shown in FIG. 13A.

In the example illustrated by FIG. 13B, the vibration damping structure 1300 comprises four bumpers 1302 made from a resilient material, such as rubber. The bumpers 1302 are disposed on the compressor housing 20 in the illustrated embodiment, but could be placed on the concentrator housing 16 instead. Alternatively, vibration damping structure could be placed on both the compressor housing 20 and the concentrator housing 16. One advantage of providing the bumpers 1302 on the compressor housing 20 is that the bumpers 1302 will damp vibration of a compressor 14 that is used on another support surface such as a compressor stand or a table. In the exemplary embodiment, the bumpers 1302 are squeezed between a top support surface 1304 of the concentrator housing 16 and a bottom support surface 1306 of the compressor housing 20. However, the vibration damping structure can be provided between any surfaces of the compressor housing 20 and the concentrator housing 16 to reduce vibration and noise.

In one exemplary embodiment, the projection 30 and recess 32 are configured to provide a snug or tight fit between the compressor housing 20 and the oxygen concentrator housing 16. This may be accomplished in a wide variety of different ways. Examples include, but are not limited to, providing inclined or tapered surfaces on the projection 30 and/or recess 32, providing one or more engaging surfaces of the projection 30 and/or recess with an increased coefficient of friction, for example by providing a surface with a rubber or abrasive coating or layer, and/or providing a detent mechanism. In the examples illustrated by FIGS. 1-9 and 11-13, the surfaces of the projections 30 and recesses 32 are inclined. This allows the compressor housing 20 to be easily placed on the oxygen concentrator housing 16 and provides a snug fit.

Figures 14A, 14B, 14C:
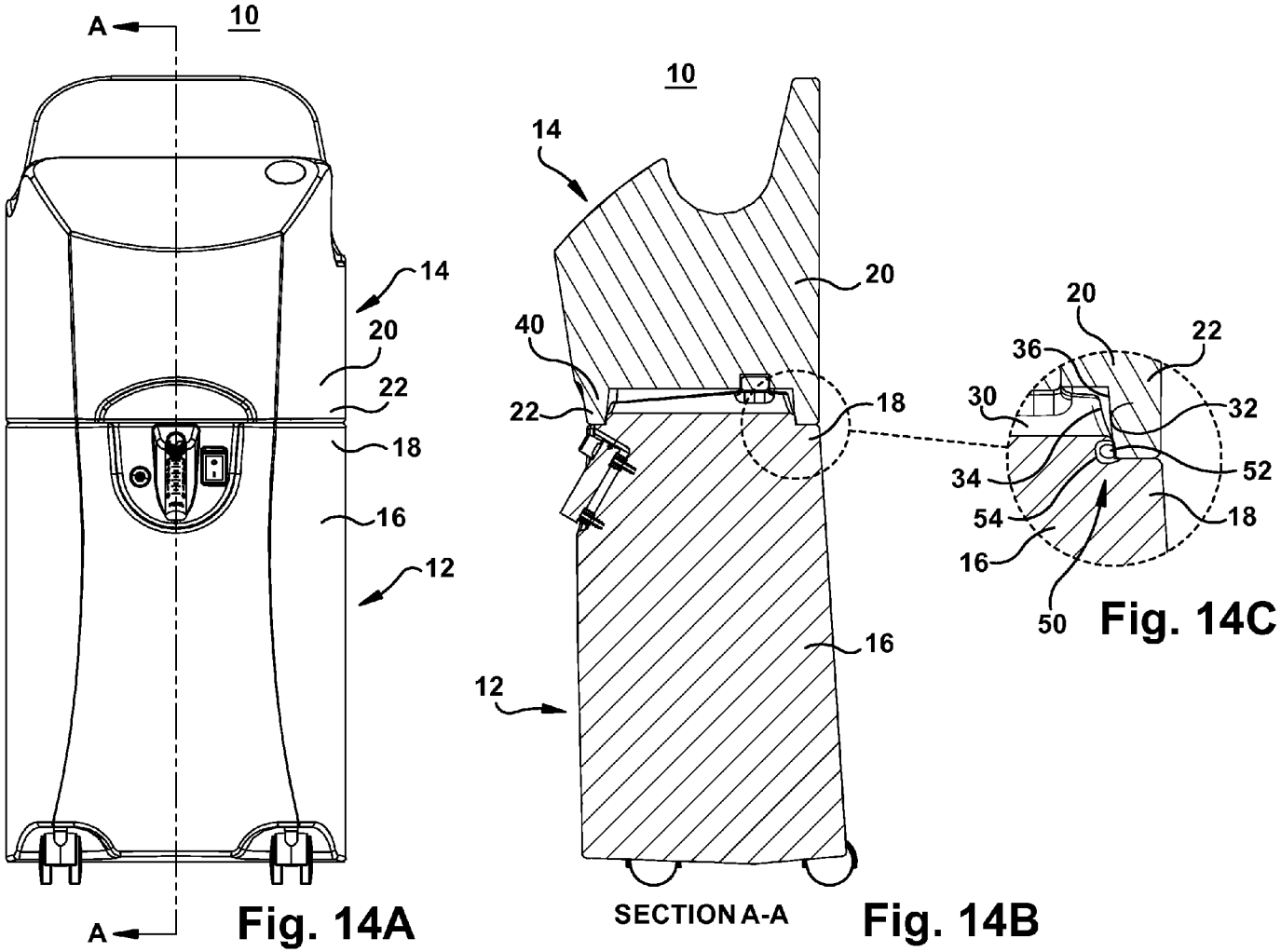
FIG. 14A is a front view of an oxygen concentrator and compressor assembly.
FIG. 14B is a sectional view taken along lines A-A in FIG. 14A.
FIG. 14C is an enlarged portion of FIG. 14B as indicated in FIG. 14B.

FIG. 14C illustrates a detent arrangement 50 between the compressor housing 20 and the oxygen concentrator housing 16. The detent arrangement 50 provides a positive engagement between the oxygen concentrator housing 16 and the compressor housing 20. The detent arrangement can take a wide variety of different forms. For example, any detent arrangement that snap-connects the compressor housing 20 to the oxygen concentrator housing 16 when the compressor housing is placed on the oxygen concentrator housing can be used. The detent arrangement 50 may be a tongue and groove arrangement. In the illustrated embodiment, a tongue 52 extends from the inner surface 36 and a groove 54 extends into the outer surface 34. However, this configuration can be reversed. When the compressor housing 20 is placed on the oxygen concentrator housing 16 in the proper orientation, the projection 30 fits into the recess 32 and the tongue 52 snaps into the groove 54 to positively secure the compressor 14 to the oxygen concentrator 12. The tongue 52 may be continuous about the periphery of the skirt or the tongue may include one or more discrete portions. If the tongue 52 includes discrete portions, the groove 54 may be continuous about the projection 30 or may include one or more discrete portions located to mate with the tongue portions. Including a detent arrangement 50 or other latching arrangement in the oxygen concentrator and compressor assembly 10 is optional.

Figure 1B:
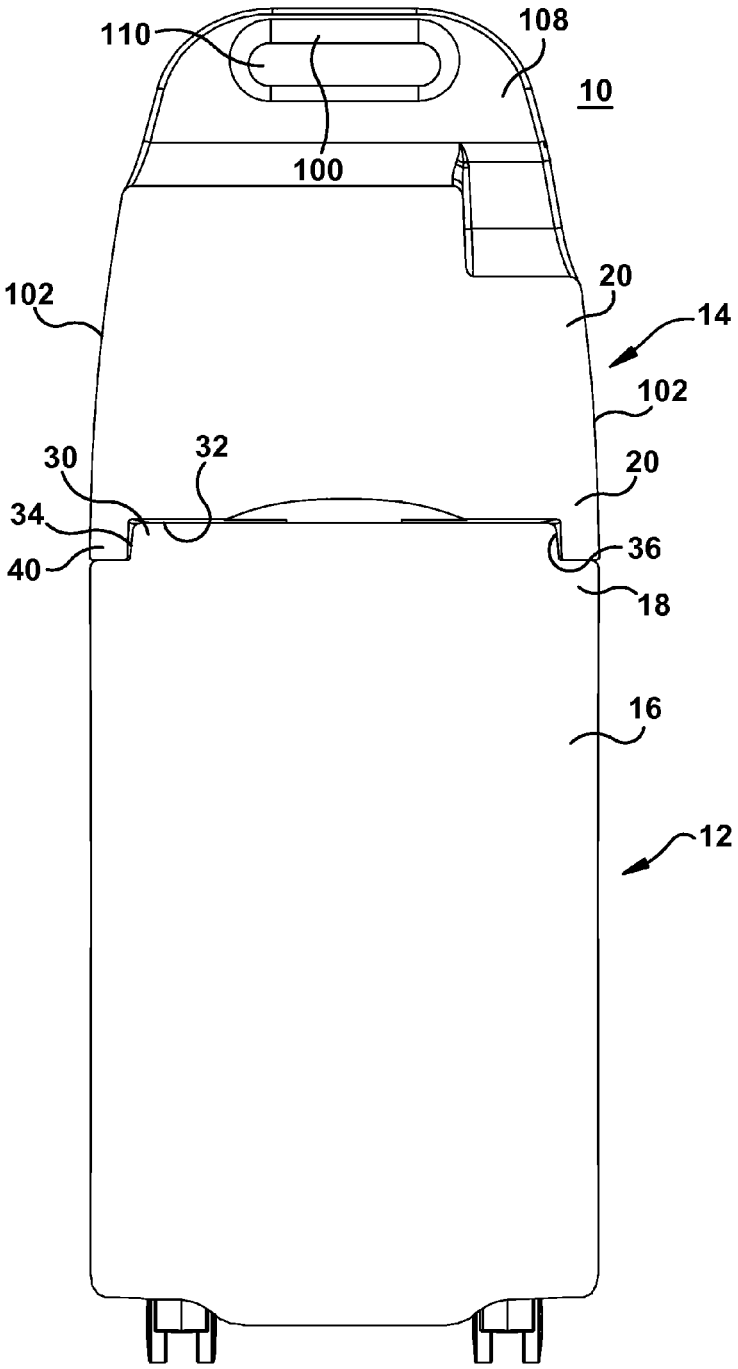
FIG. 1B is a sectional view taken along the plane indicated by lines 1B-1B in FIG. 1A.
Figure 1C:
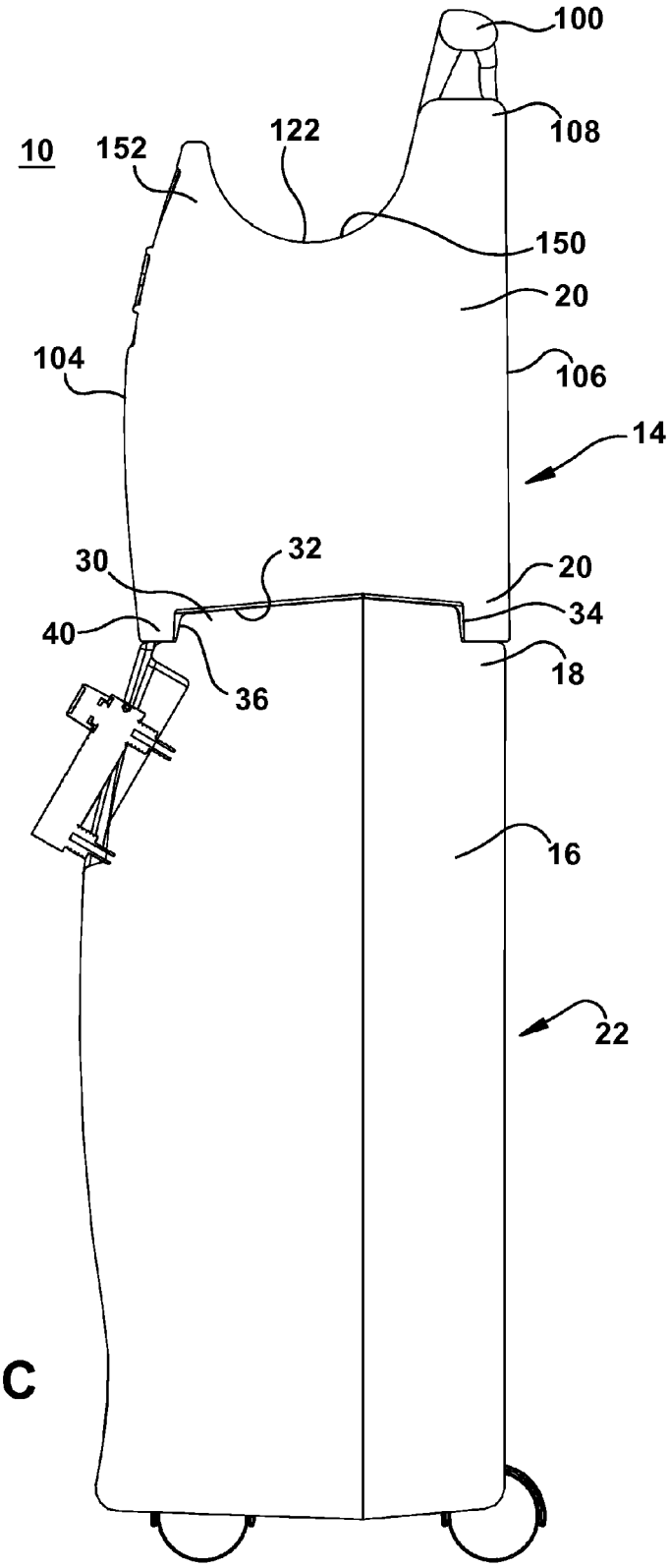
FIG. 1C is a sectional view taken along the plane indicated by lines 1C-1C in FIG. 1A.
Figure 2A:
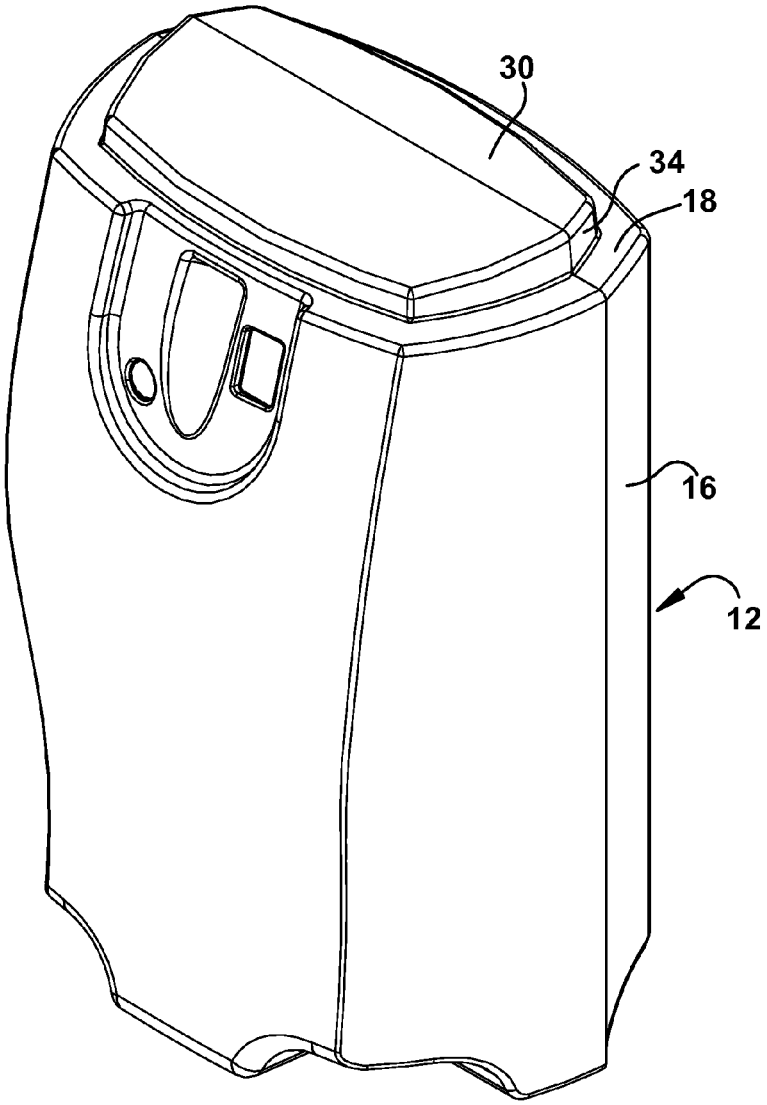
FIG. 2A is a perspective view of an oxygen concentrator housing of the assembly shown in FIG. 1A.
Figure 2B:
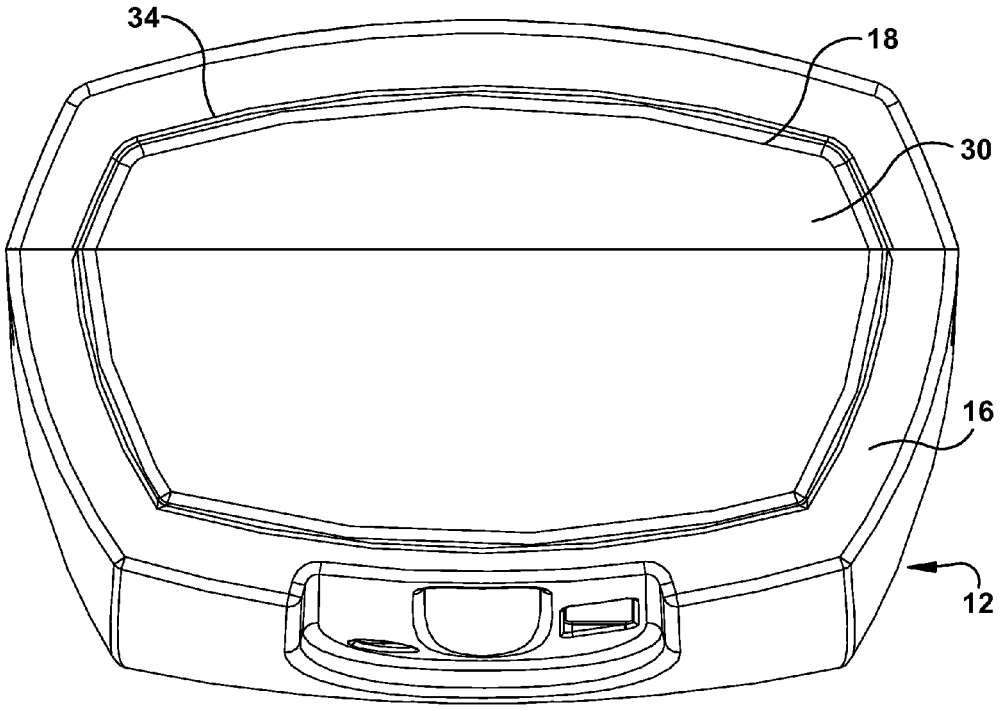
FIG. 2B is a top view of the oxygen concentrator housing shown in FIG. 2A.
Figure 2C:
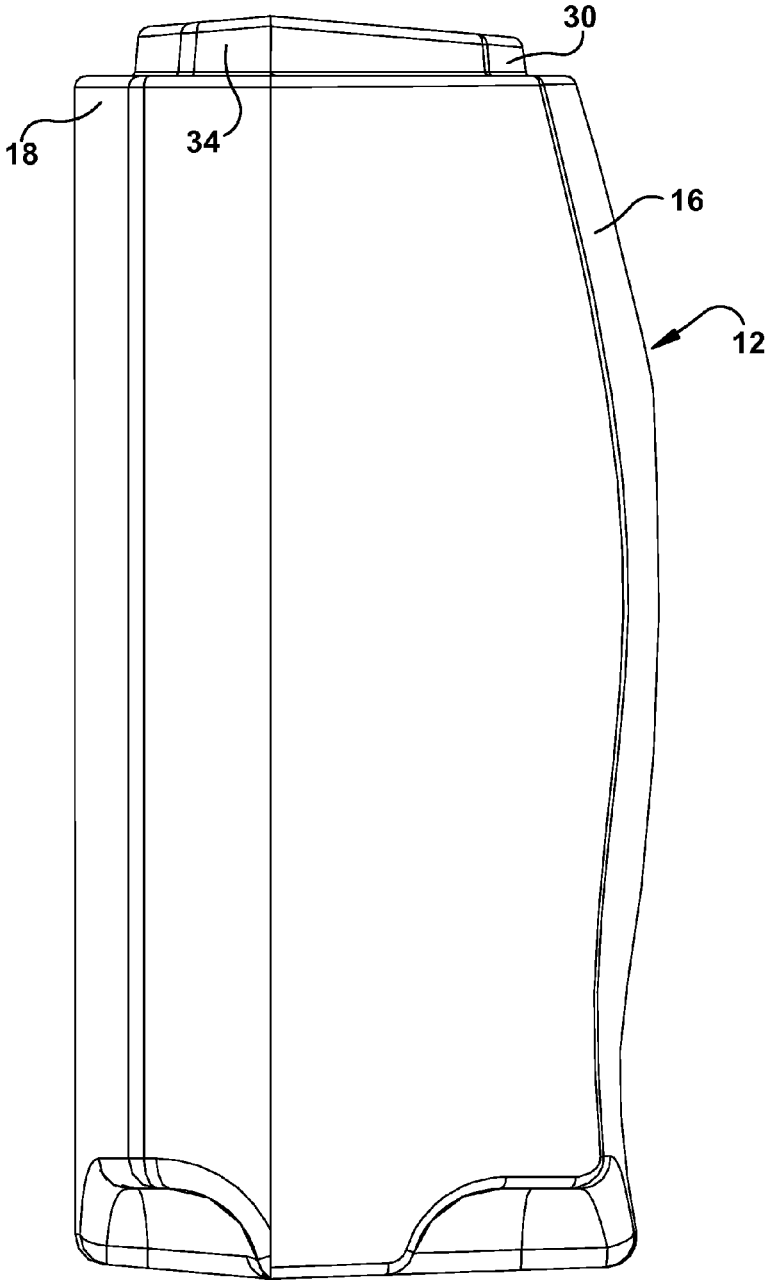
FIG. 2C is a side view of the oxygen concentrator housing shown in FIG. 2A.
Figure 2D:
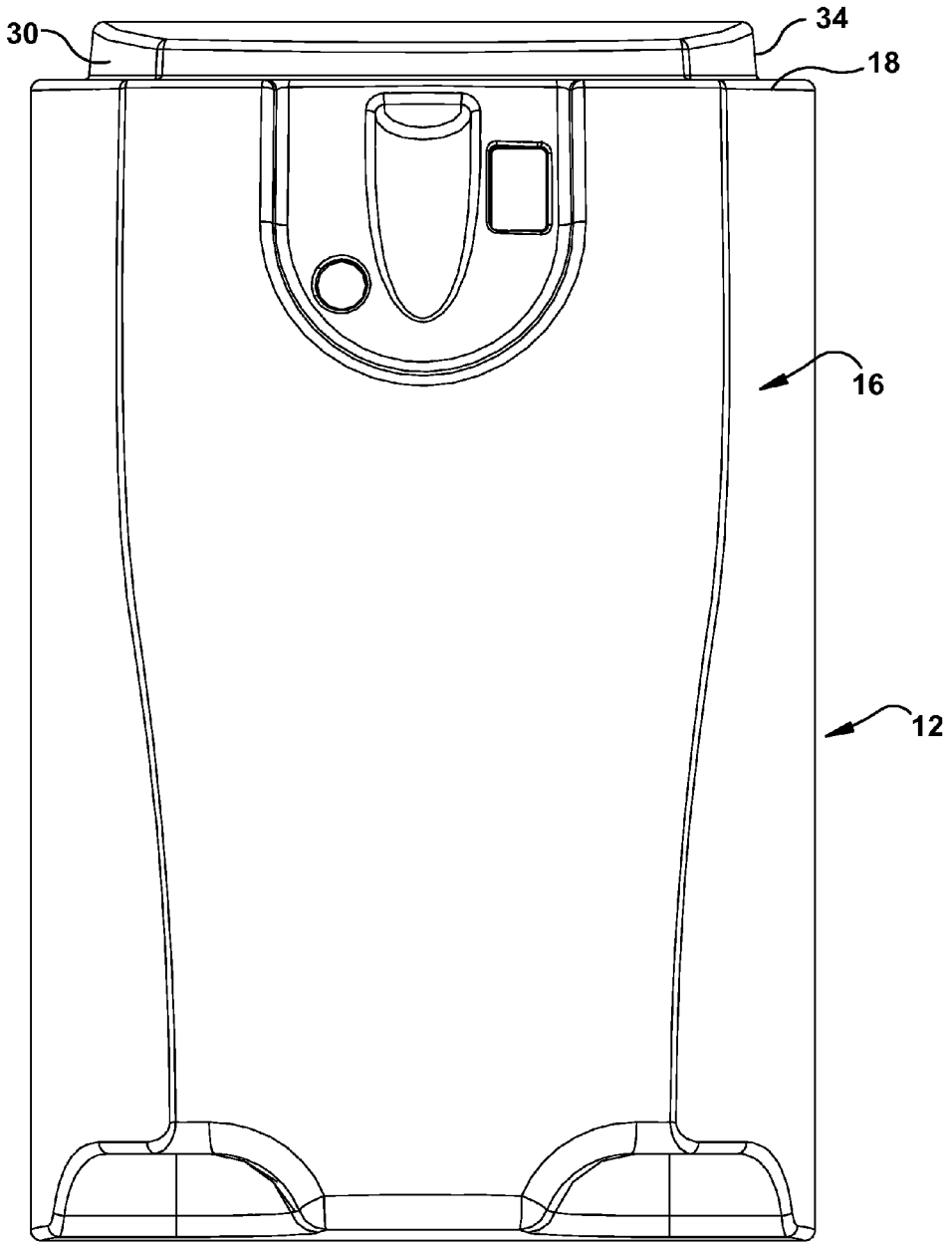
FIG. 2D is a front view of the oxygen concentrator housing shown in FIG. 2A.
Figure 2E:
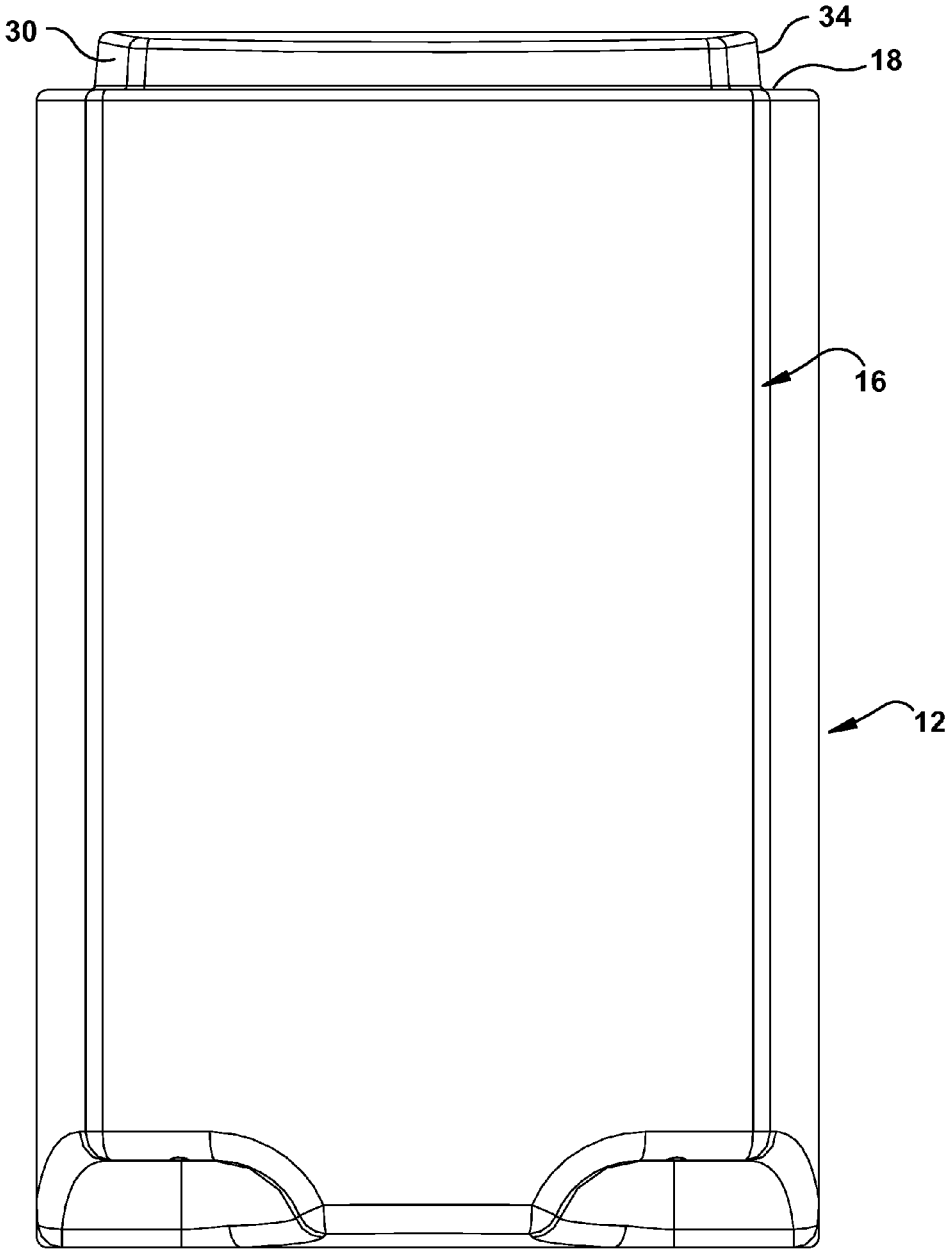
FIG. 2E is a back view of the oxygen concentrator housing shown in FIG. 2A.

In one exemplary embodiment, at least one of the surfaces that set the position of the compressor housing 20 with respect to the oxygen concentrator housing 16 comprises an optional handle 60 of the oxygen concentrator (see the embodiments illustrated by FIGS. 4-6, 6-9 and 11-13; a handle may also be included in the embodiment illustrated by FIGS. 1-3). Such a handle may take a wide variety of different configurations and may or may not provide one or more of the positioning surfaces. When the handle 60 provides a positioning surface, the projection 30 and the recess 32 may optionally be omitted. When the handle 60 is included, the compressor housing 20 may include a pocket 62 that accepts the handle to set the position or help set the position of the compressor housing 20 with respect to the oxygen concentrator housing 16. The handle 60 and the pocket 62 may take a wide variety of different forms. For example, the pocket 62 may be a recess 64 in the compressor housing 20 (see FIGS. 4-6 and 11-13) and/or the pocket may be defined by a pair of projections 66 (see FIGS. 6-9).

Figure 10A:
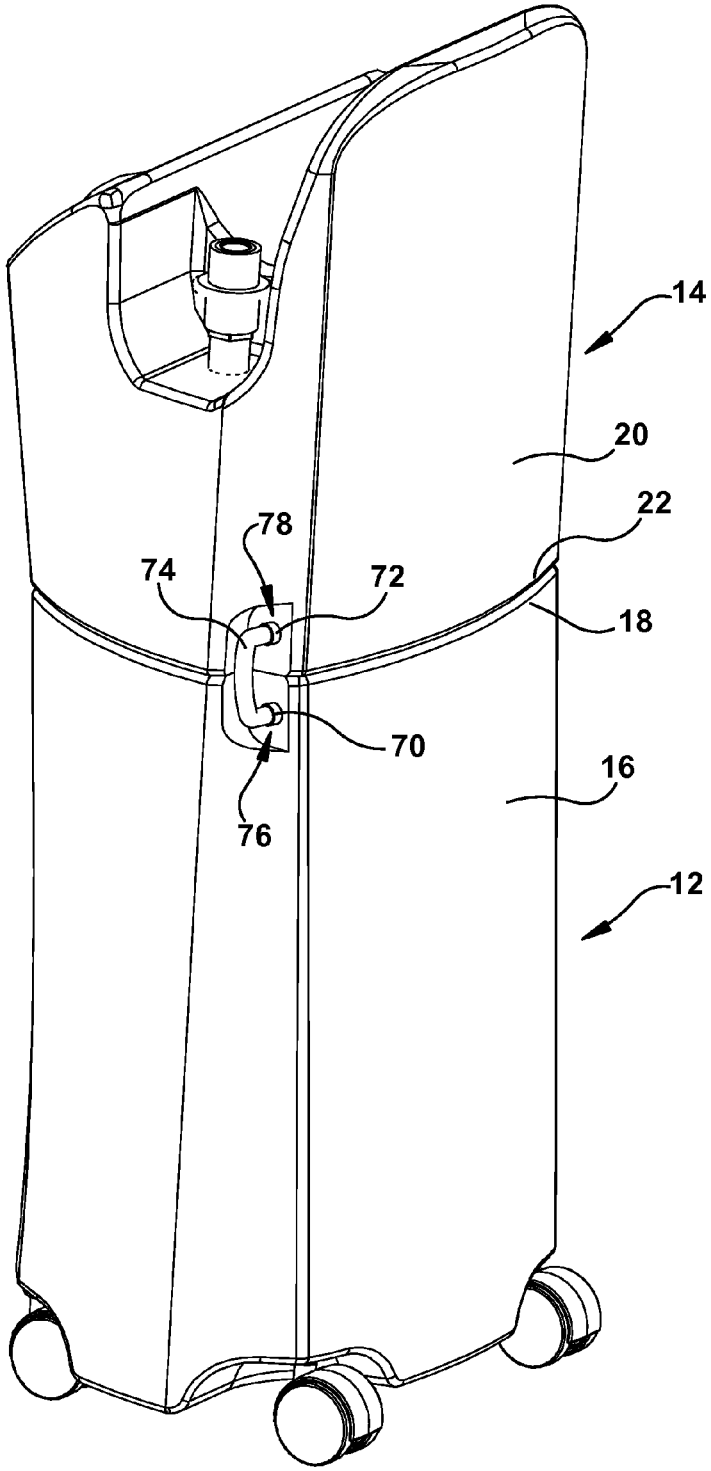
FIG. 10A is a perspective view of an oxygen concentrator and compressor assembly, showing a fluid connection between the oxygen concentrator and the compressor.
Figure 10B:
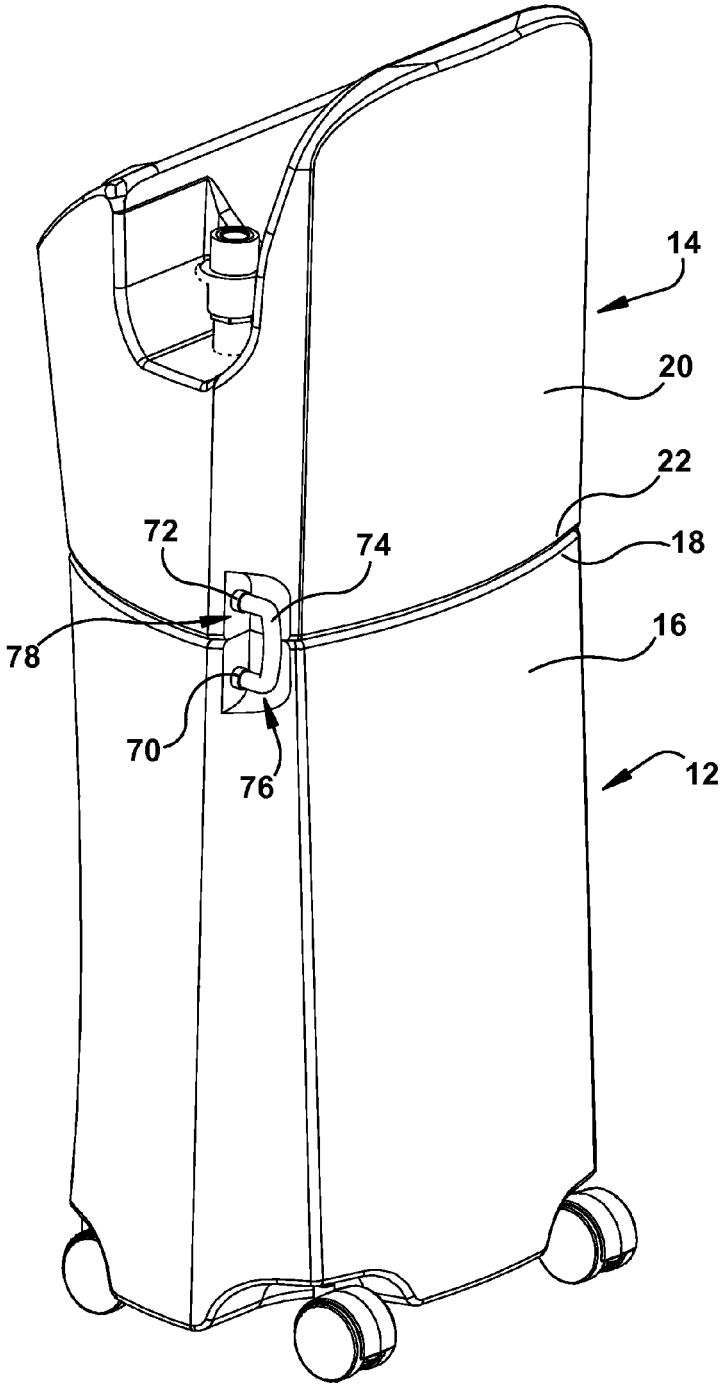
FIG. 10B is a perspective view of an oxygen concentrator and compressor assembly, showing a fluid connection between the oxygen concentrator and the compressor.
Figure 10C:
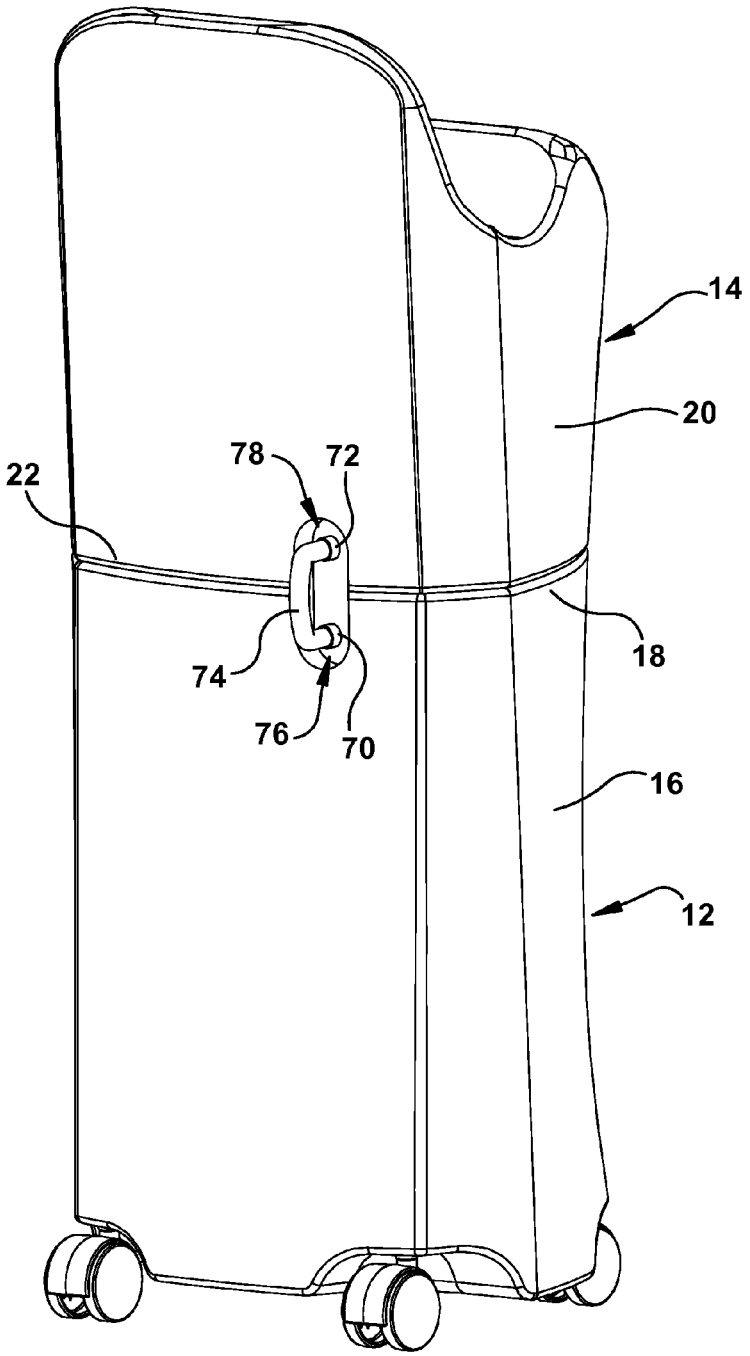
FIG. 10C is a perspective view of an oxygen concentrator and compressor assembly, showing a fluid connection between the oxygen concentrator and the compressor.
Figure 11A:
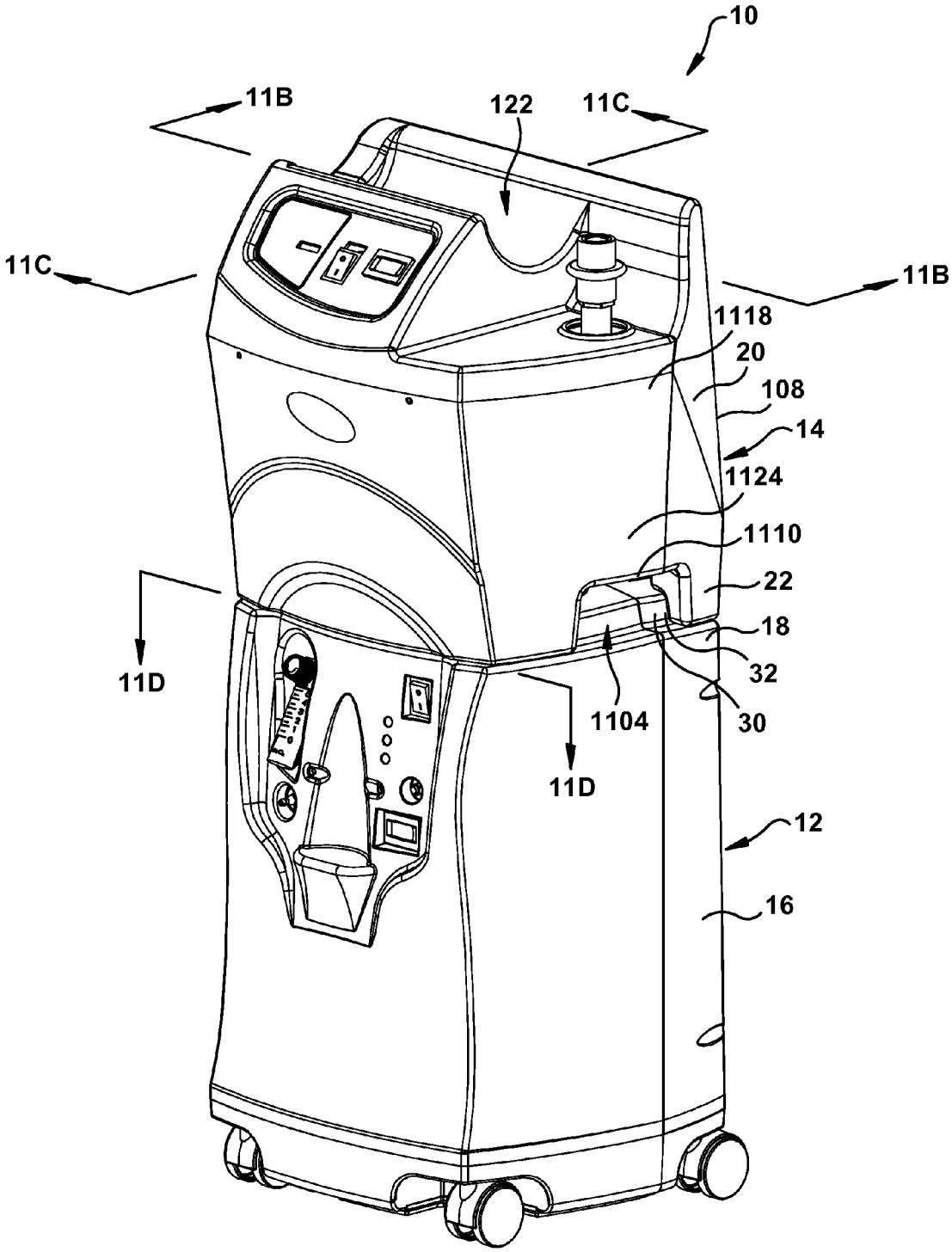
FIG. 11A is a perspective view of an oxygen concentrator and compressor assembly or system of a fourth embodiment.
Figure 11B:
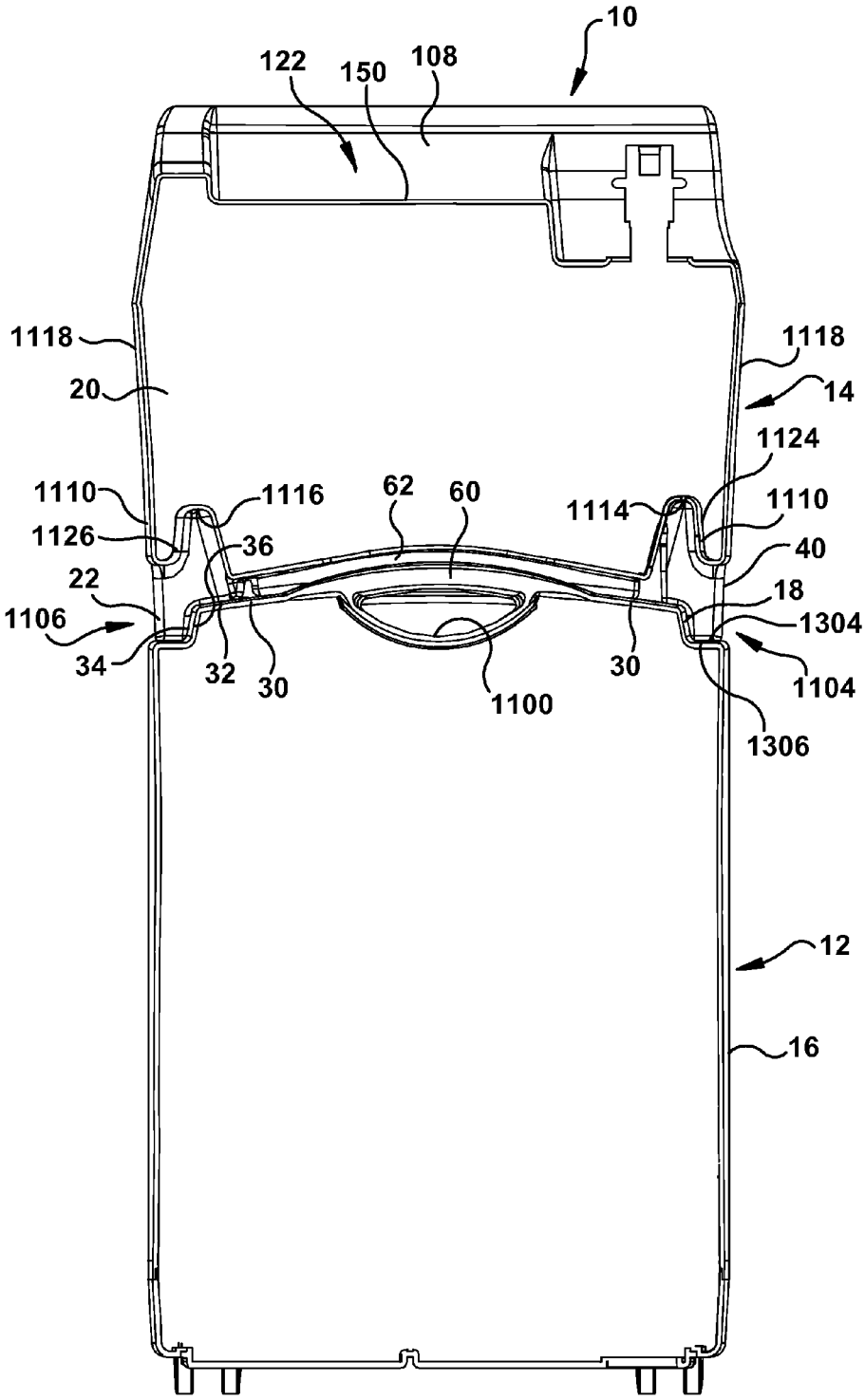
FIG. 11B is a sectional view taken along the plane indicated by lines 11B-11B in FIG. 11A.
Figure 11C:
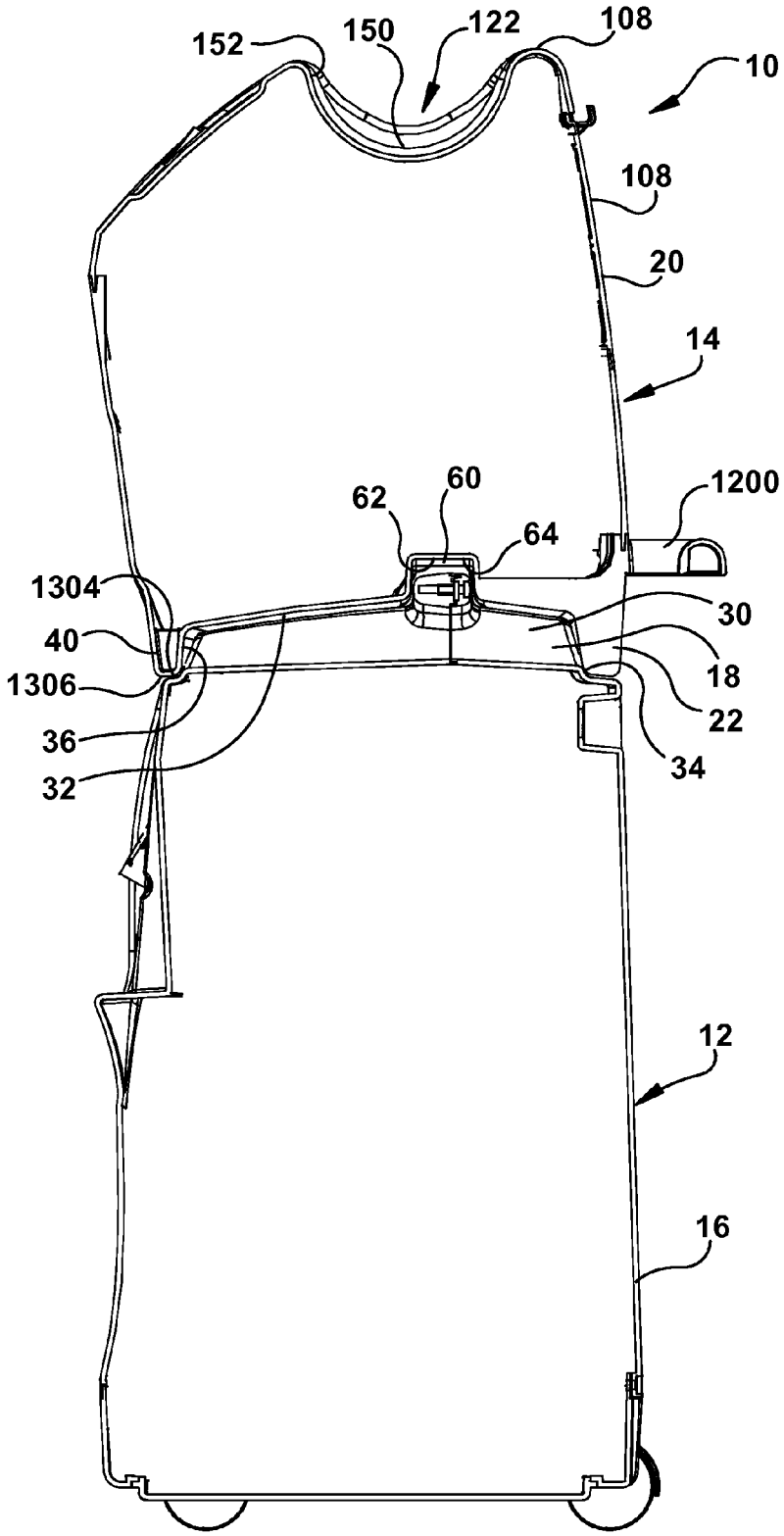
FIG. 11C is a sectional view taken along the plane indicated by lines 110-110 in FIG. 11A.
Figure 11D:
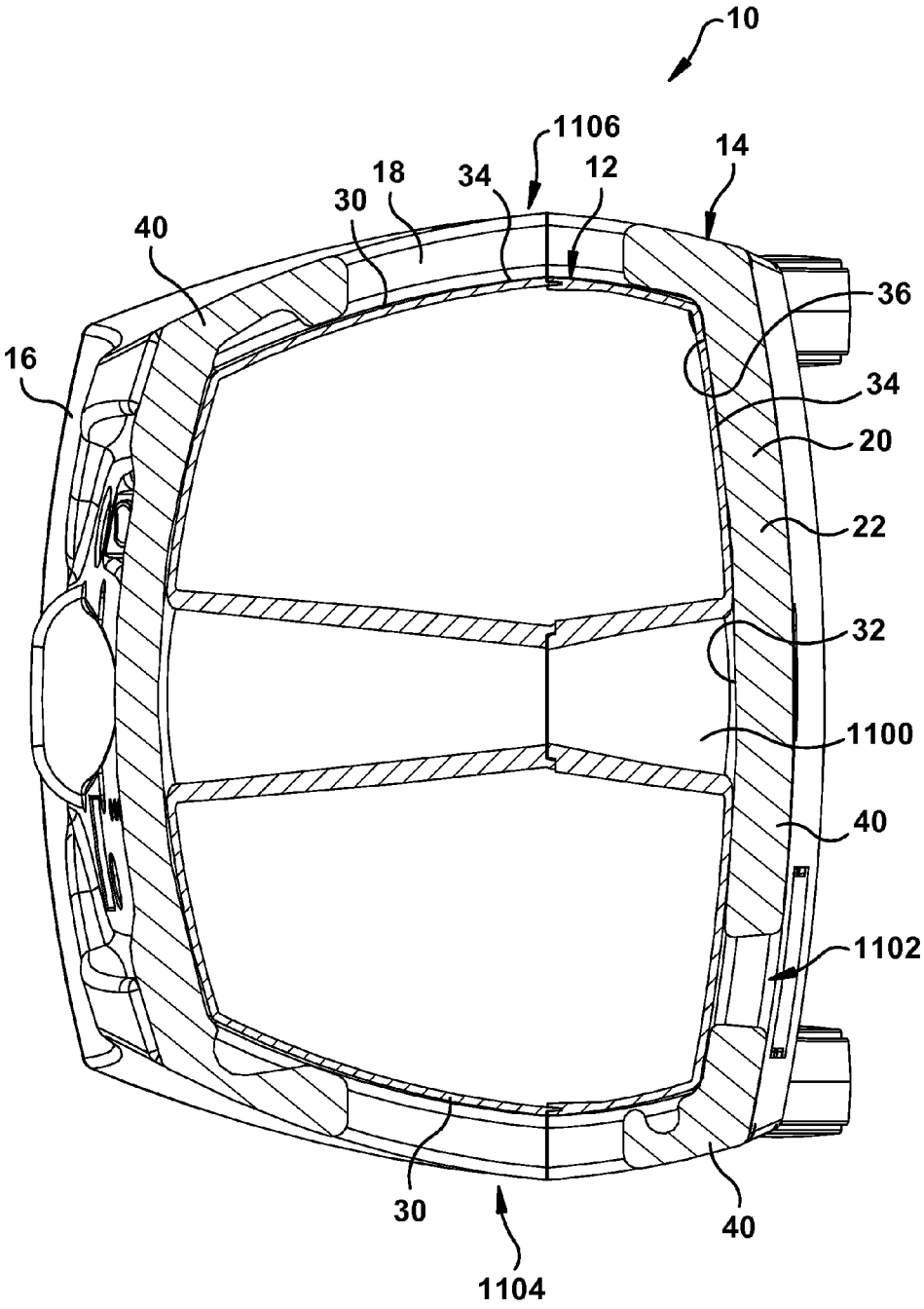
FIG. 11D is a sectional view taken along the plane indicated by lines 11D-11D in FIG. 11A.
Figure 12A:
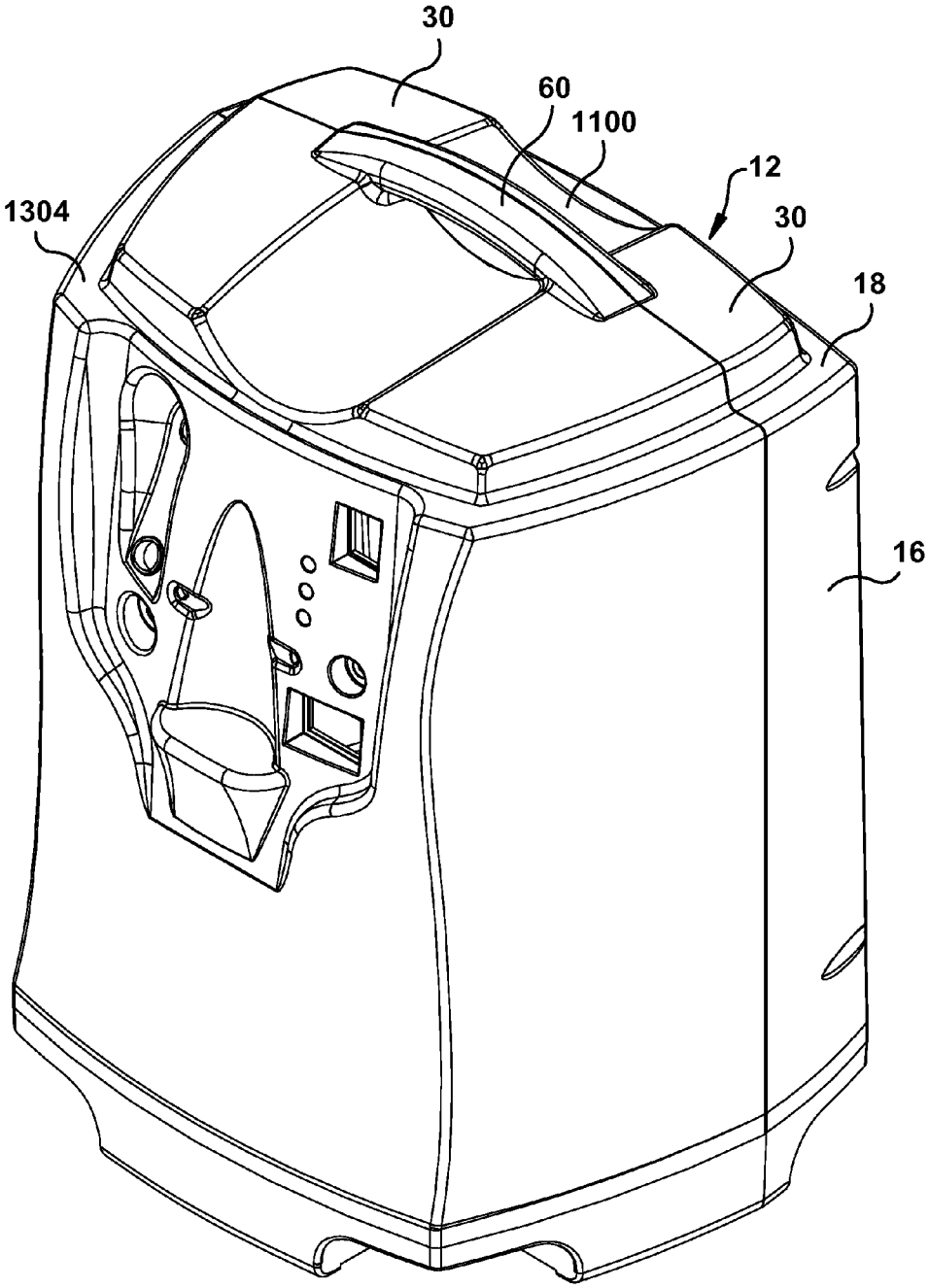
FIG. 12A is a perspective view of an oxygen concentrator housing of the assembly shown in FIG. 11A.
Figure 12B:
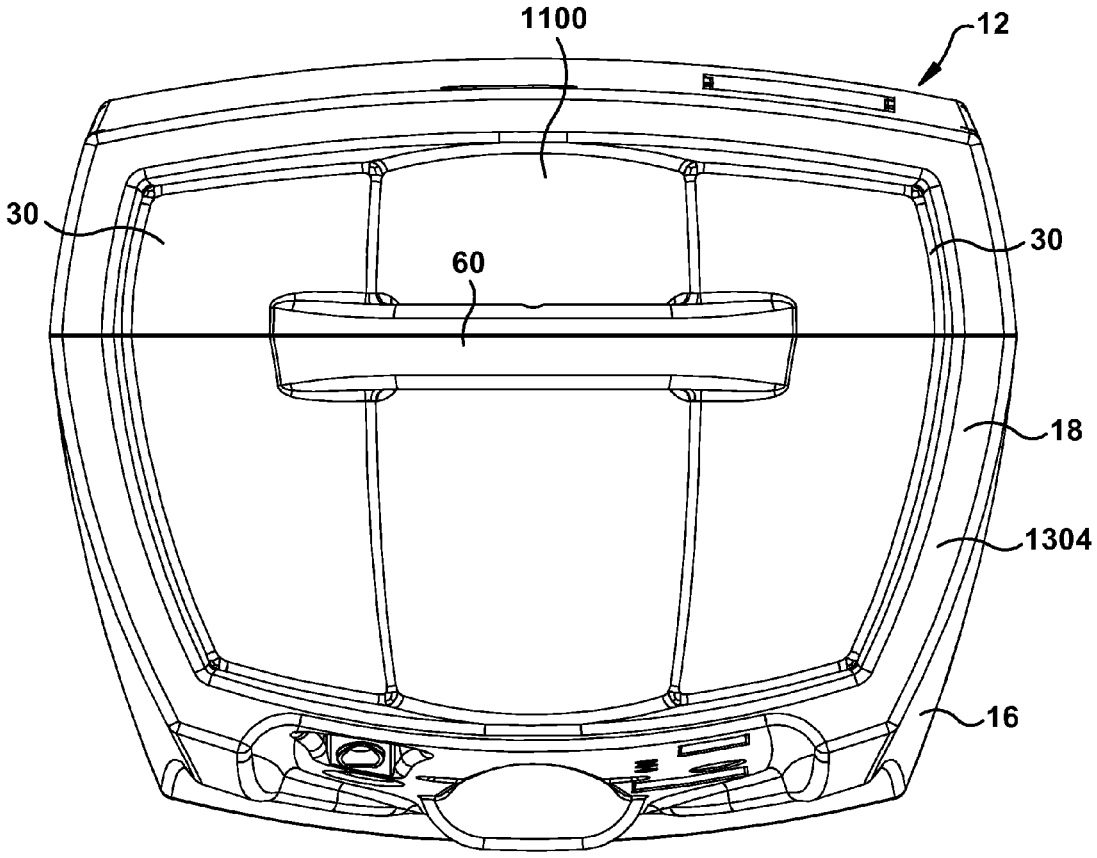
FIG. 12B is a top view of the oxygen concentrator housing shown in FIG. 12A.
Figure 12C:
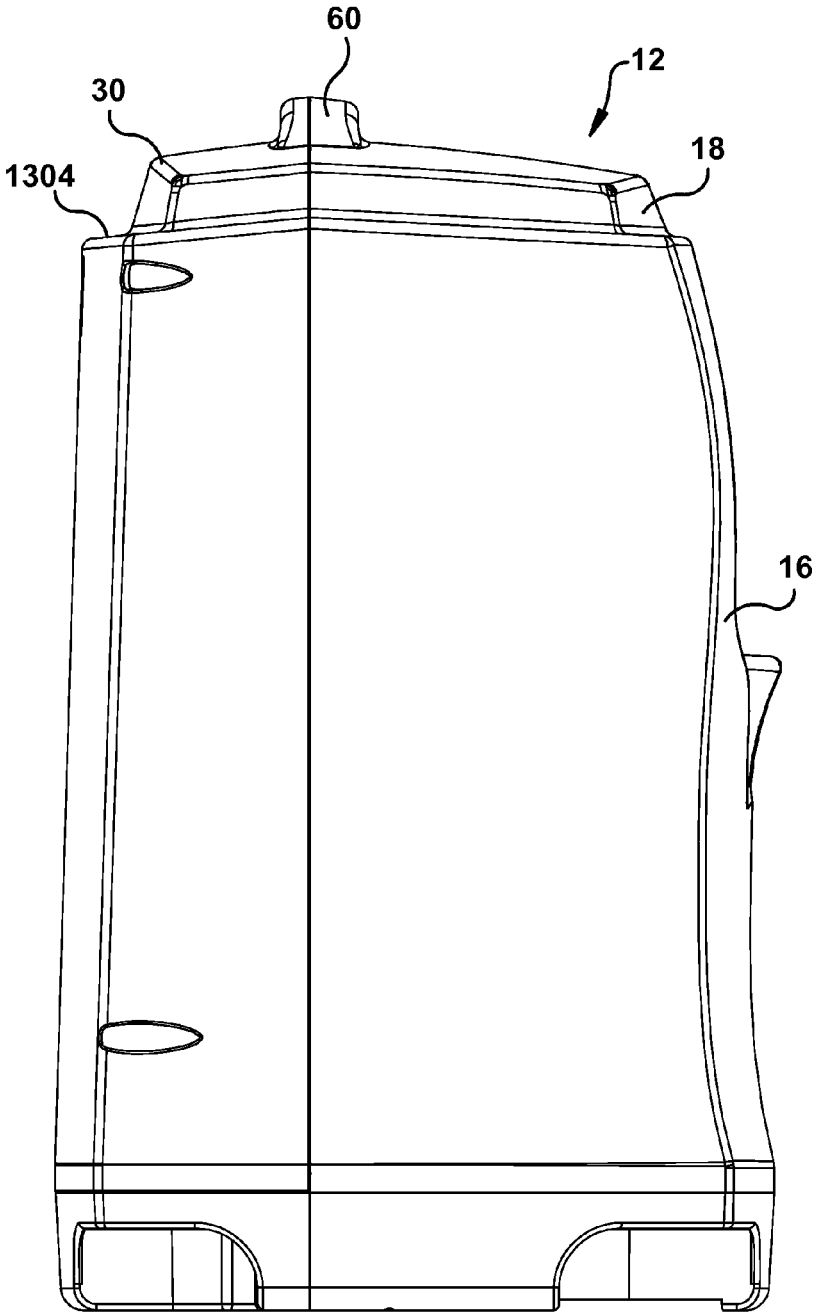
FIG. 12C is a side view of the oxygen concentrator housing shown in FIG. 12A.
Figure 12D:
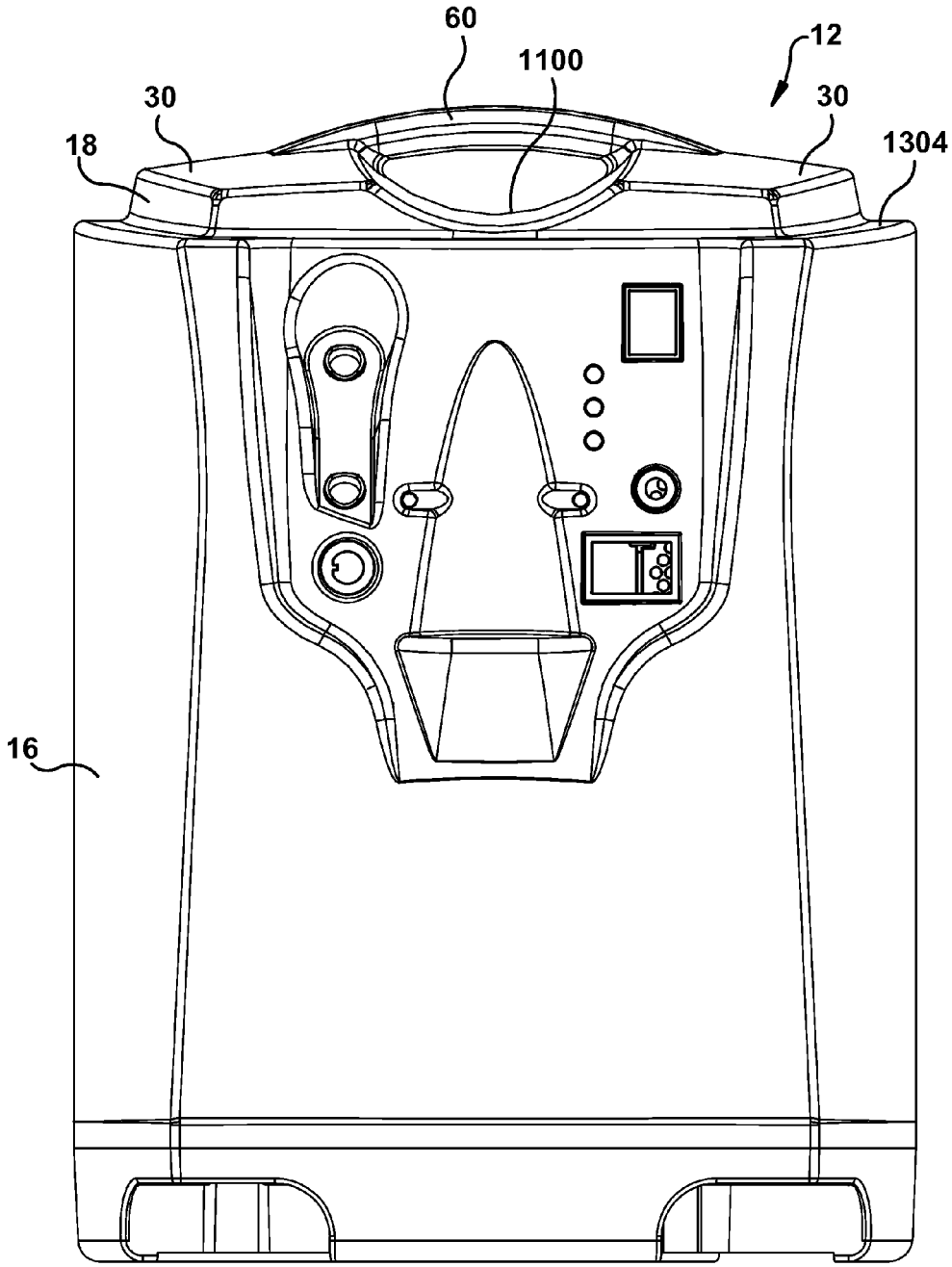
FIG. 12D is a front view of the oxygen concentrator housing shown in FIG. 12A.
Figure 12E:
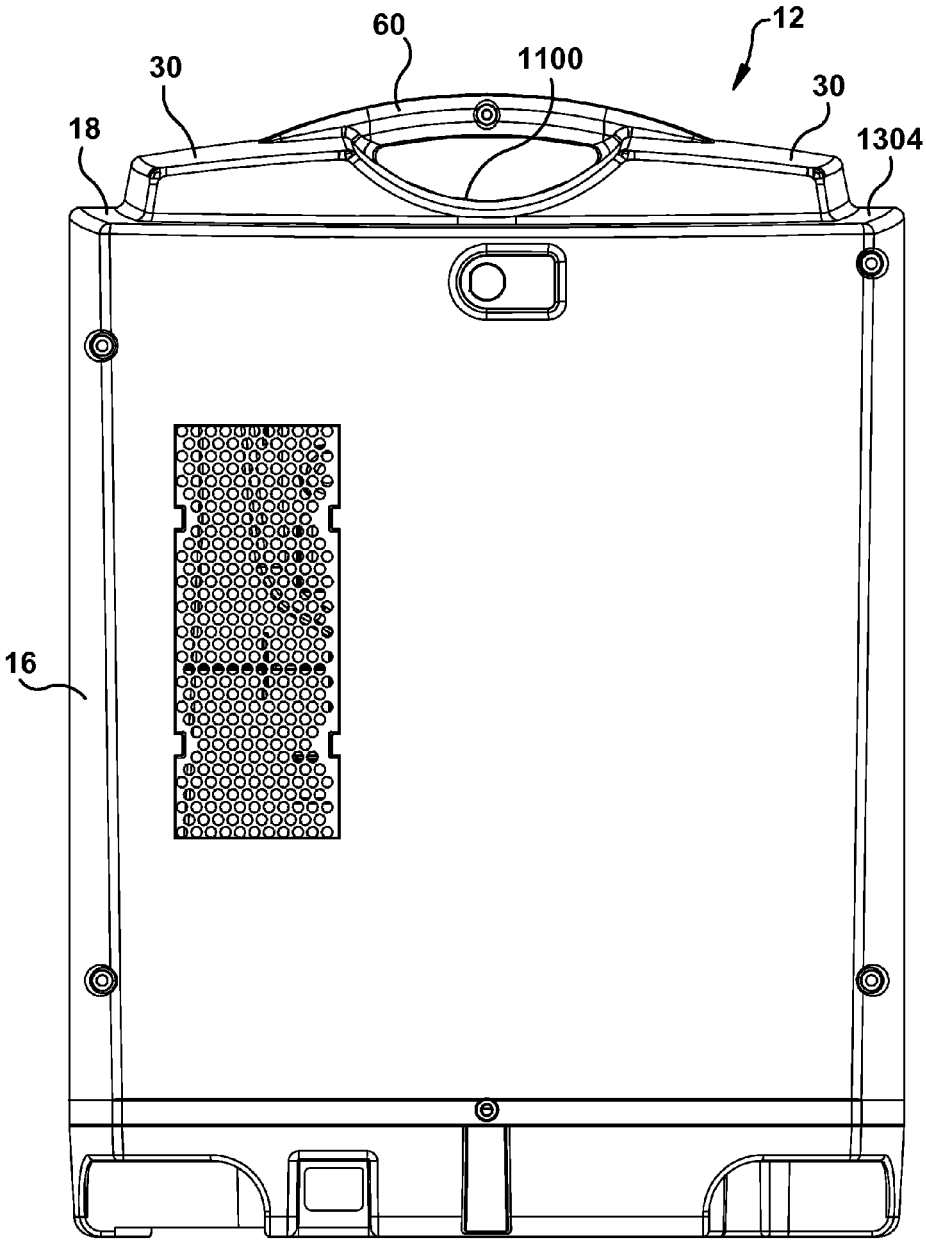
FIG. 12E is a back view of the oxygen concentrator housing shown in FIG. 12A.

Referring to FIGS. 10A-10C, in an exemplary embodiment an outlet 70 of the oxygen concentrator 12 is in fluid communication with an inlet 72 of the compressor. The fluid communication between the oxygen concentrator outlet 70 and the compressor inlet may be provided in a wide variety of different ways. In the examples illustrated by FIGS. 10A-10C, the outlet 70 is provided on an external surface of the oxygen concentrator housing 16 and the inlet 72 is provided on an external surface of the compressor housing 20. A conduit 74 connects the outlet 70 to the inlet 72. In the examples illustrated by FIGS. 10A-10C, the outlet 70 and the inlet 72 are provided in optional adjacent recesses 76, 78 in the compressor housing 20 and the oxygen concentrator housing 16. In FIG. 10A, the recesses 76, 78 are disposed in the side of the assembly. In FIGS. 10B and 10C, the recesses 76, 78 are disposed in the back of the assembly. The optional adjacent recesses may be provided at any location of the oxygen concentrator housing 16 and the compressor housing 20. In another embodiment, the out let 70 and the inlet 72 may be configured to automatically connect with one another by placing the compressor housing 20 on the oxygen concentrator housing. For example, the outlet 70 and inlet 72 may be aligned and connect with one another upon nesting of the compressor 14 on top of the oxygen concentrator 12. In such a case, the outlet 70 is disposed in the upper end 18 of the concentrator 12 and the inlet 72 is disposed in the lower end 22 of the compressor 14. A quick connect/release mechanism may be used to latch and unlatch the inlet and outlet.

In an exemplary embodiment, the compressor housing 20 may be secured to the oxygen concentrator housing 16 after the oxygen concentrator 14 is positioned on the compressor 20. This may be accomplished in a wide variety of different ways. For example, one or more latches 80 (see FIG. 1A) may be included. Any structure for fixedly attaching the oxygen concentrator housing 16 to the compressor housing 20 may be used.

In one exemplary embodiment, the compressor housing 20 is configured to facilitate lifting and placing the compressor 14 on the oxygen concentrator 12 and/or lifting the compressor 14 off of the oxygen concentrator 12. For example, the compressor housing may include one or more handles 100. The handles 100 may take a wide variety of different forms. For example, a pair of handles may be provided on opposite sides 102 of the housing 20 (See FIGS. 11-13) or on the front 104 and/or back 106 of the housing. Any handle configuration that facilitates placement and/or removal of the compressor housing 20 on/off the oxygen concentrator housing 16 may be used.

In the embodiments illustrated by FIGS. 1-3 and FIGS. 7-9, a single handle 100 may be formed in a back wall 108 of the housing 20. Such a single handle 100 may take a wide variety of different forms. The handle 100 may be integrally formed with the housing 20, as shown, or the handle may be a separate member that is attached to the housing 20. The illustrated handles 100 are formed by an opening 110 in the back wall 108. The handle may be positioned at any location on the back wall 108. In the illustrated embodiments, the handle 100 is disposed at a top 112 of the back wall 108 and is laterally centered on the compressor housing 20.

In the embodiment illustrated by FIGS. 11-13 a pair of handles 1110 may be formed in side walls 1118 of the housing 20. Such a pair of handles 1110 may take a wide variety of different forms. The handles 1110 may be integrally formed with the housing 20, as shown, or the handles 1110 may be separate members that are attached to the housing 20. The illustrated handles 1110 are formed by the gaps 1104, 1106 in the skirt and recesses 1114, 1116 that extend upward into the housing 20 inside the recesses 1114, 1116 (See FIGS. 11B and 13H). The recesses 1114, 1116 form side walls 1124, 1126 (See FIG. 11B) that extend down to the gaps 1104, 1106.

When a user wishes to lift the compressor 14 off of the concentrator 12, the user extends her hands through the gaps 1104, 1106 and up into the recesses 1114, 1116. Then, the user lifts up on the side walls 1124, 1126 to lift the compressor 14 off of the concentrator 12.

The handles 1110 may be positioned at any location on the sides of the housing 20. In the illustrated embodiments, the handles 1110 are disposed at the bottom of the housing 20 and are generally aligned or aligned under the cradle 122. By aligning the handles 1110 with the cradle, the weight of the compressed oxygen cylinder is positioned directly above the handles. This inhibits the compressor 14 from tilting due to the weight of the compressed oxygen cylinder 120 if the compressor is picked up with a compressed oxygen cylinder on the housing 10.

In the embodiment illustrated by FIGS. 11-13, a third handle 1200 may be disposed on a back wall 108 of the housing 20. Such a handle 1200 may take a wide variety of different forms. The handle 1200 may be integrally formed with the housing 20, as shown, or the handle may be a separate member that is attached to the housing 20. The illustrated handle 1200 is conventional in shape and size. The handle may be positioned at any location on the back wall 108. In the illustrated embodiments, the handle 1200 is disposed near the bottom of the back wall 108 and is laterally centered on the compressor housing 20.

Figure 7A:
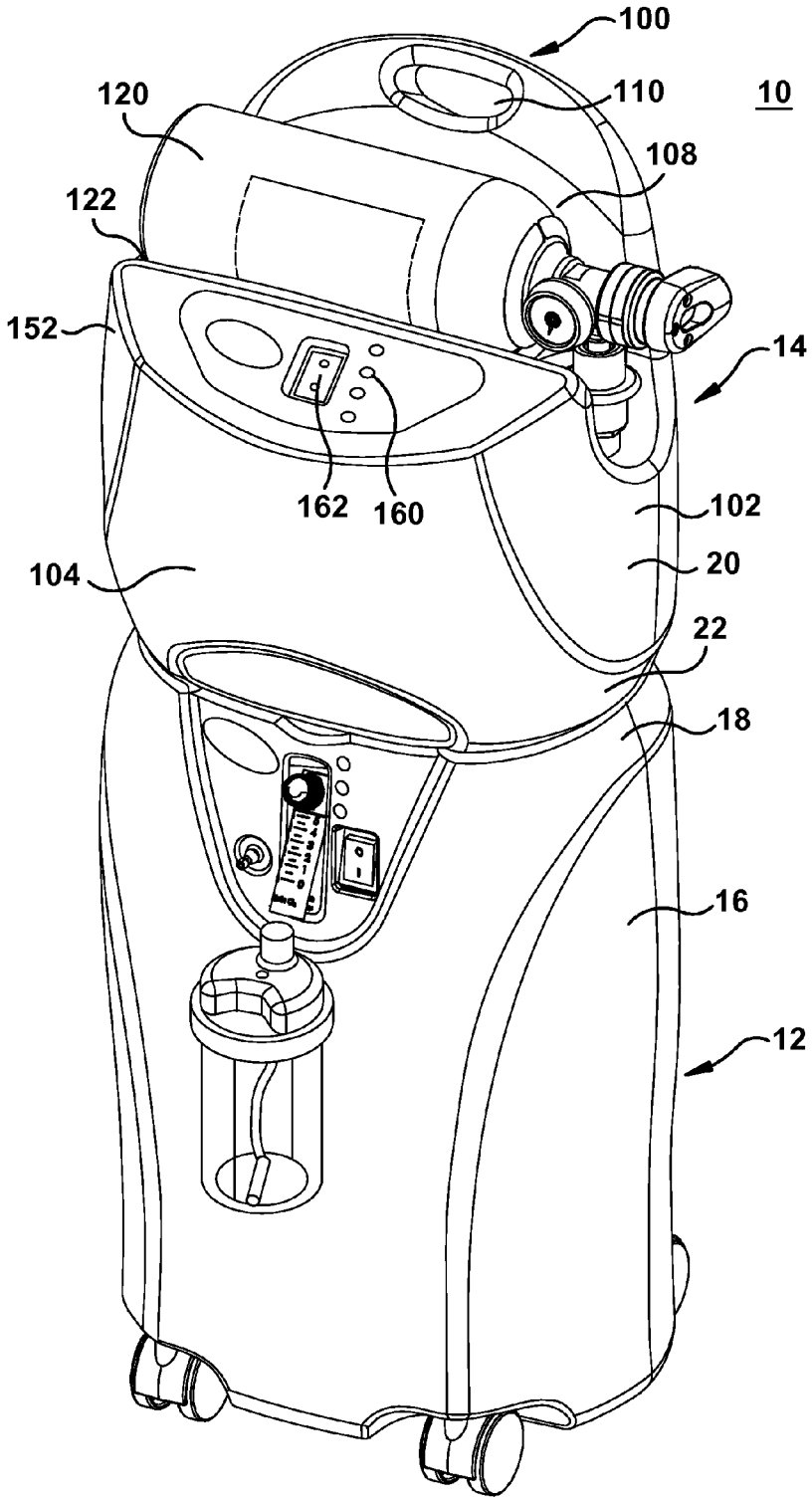
FIG. 7A is a perspective view of an oxygen concentrator and compressor assembly of a third embodiment.
Figure 7B:
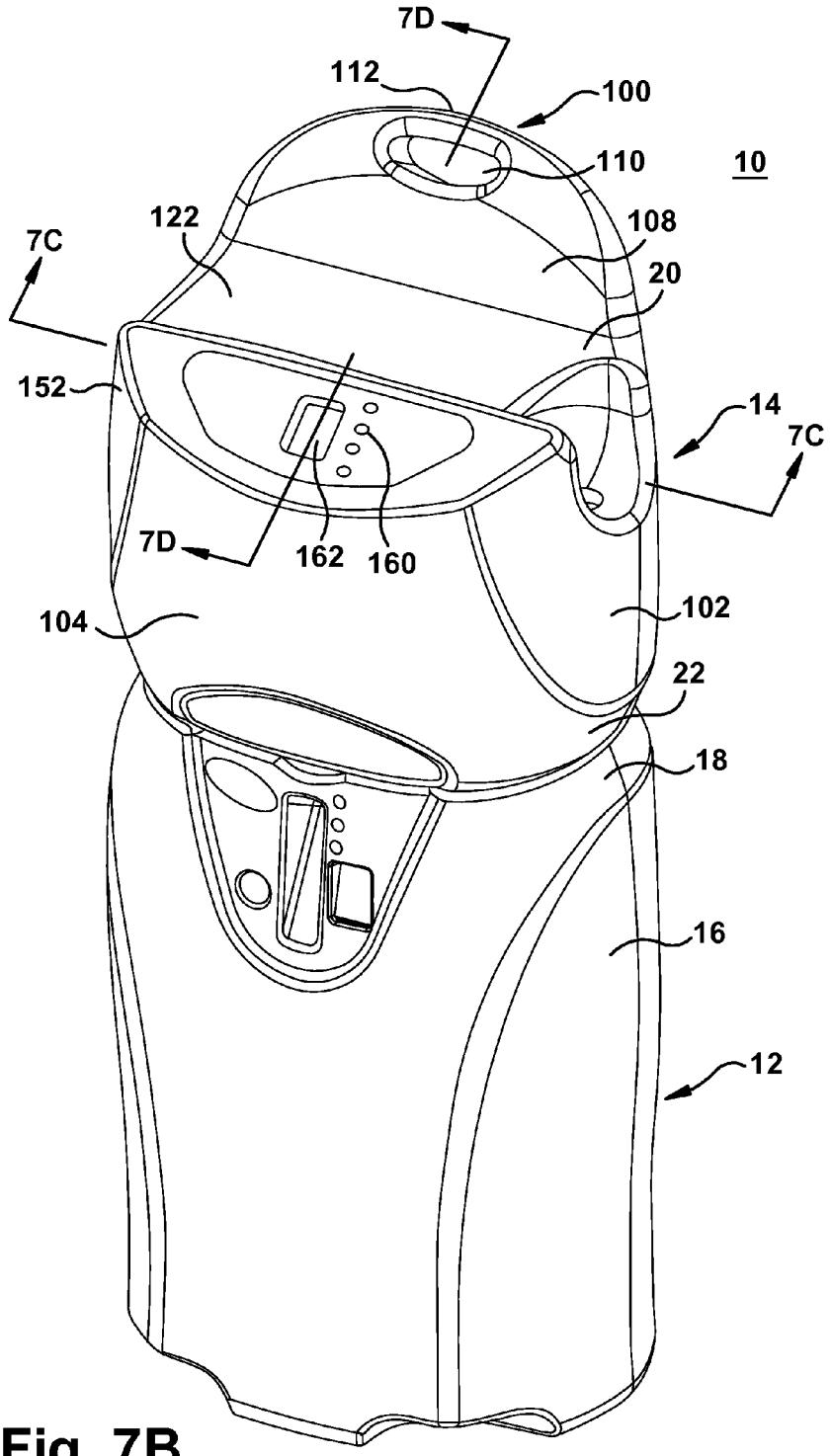
FIG. 7B is a perspective view of an oxygen concentrator housing and a compressor housing of the assembly shown in FIG. 7A.
Figure 7C:
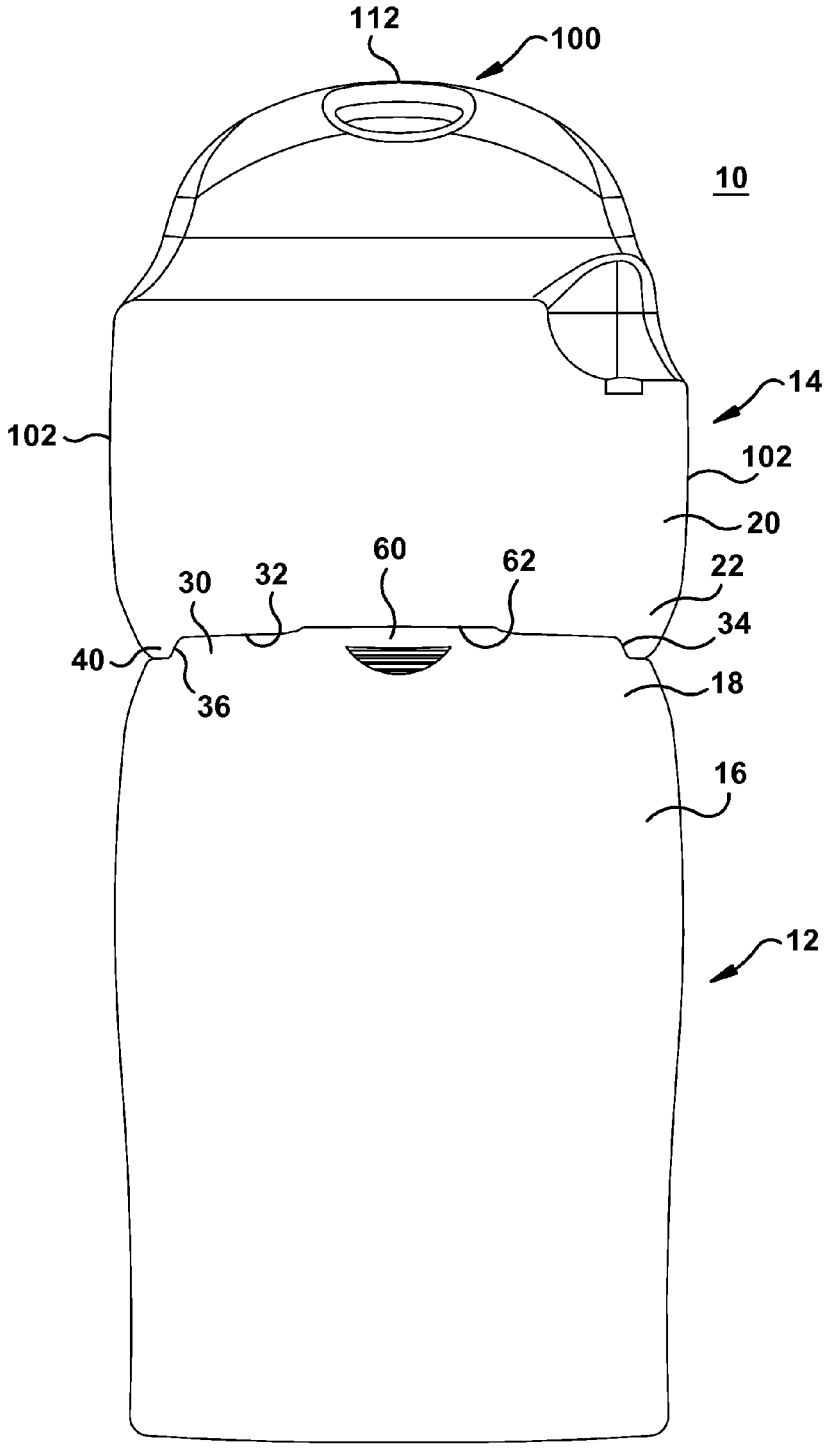
FIG. 7C is a sectional view taken along the plane indicated by lines 7C-7C in FIG. 7B.
Figure 7D:
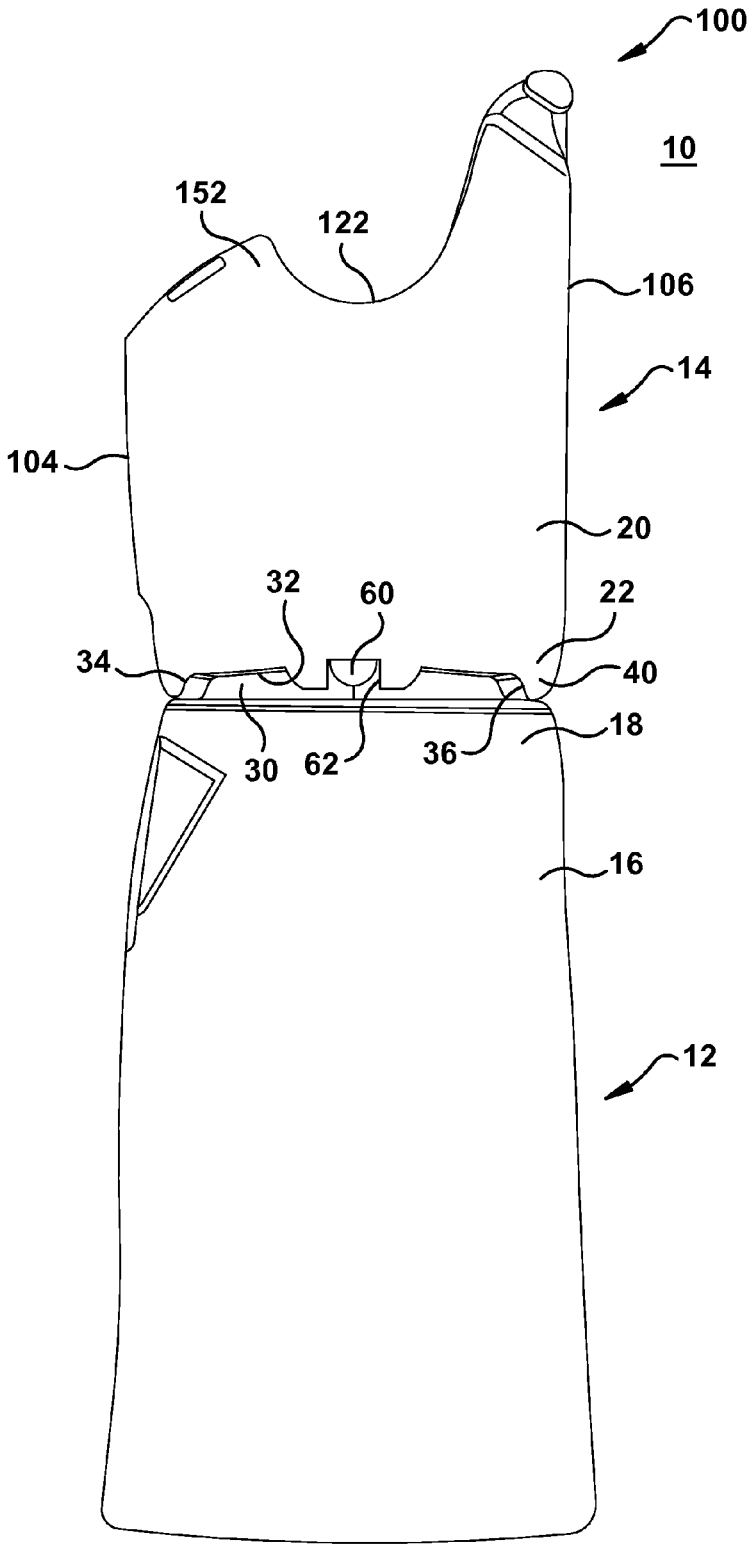
FIG. 7D is a sectional view taken along the plane indicated by lines 7D-7D in FIG. 7B.
Figure 7E:
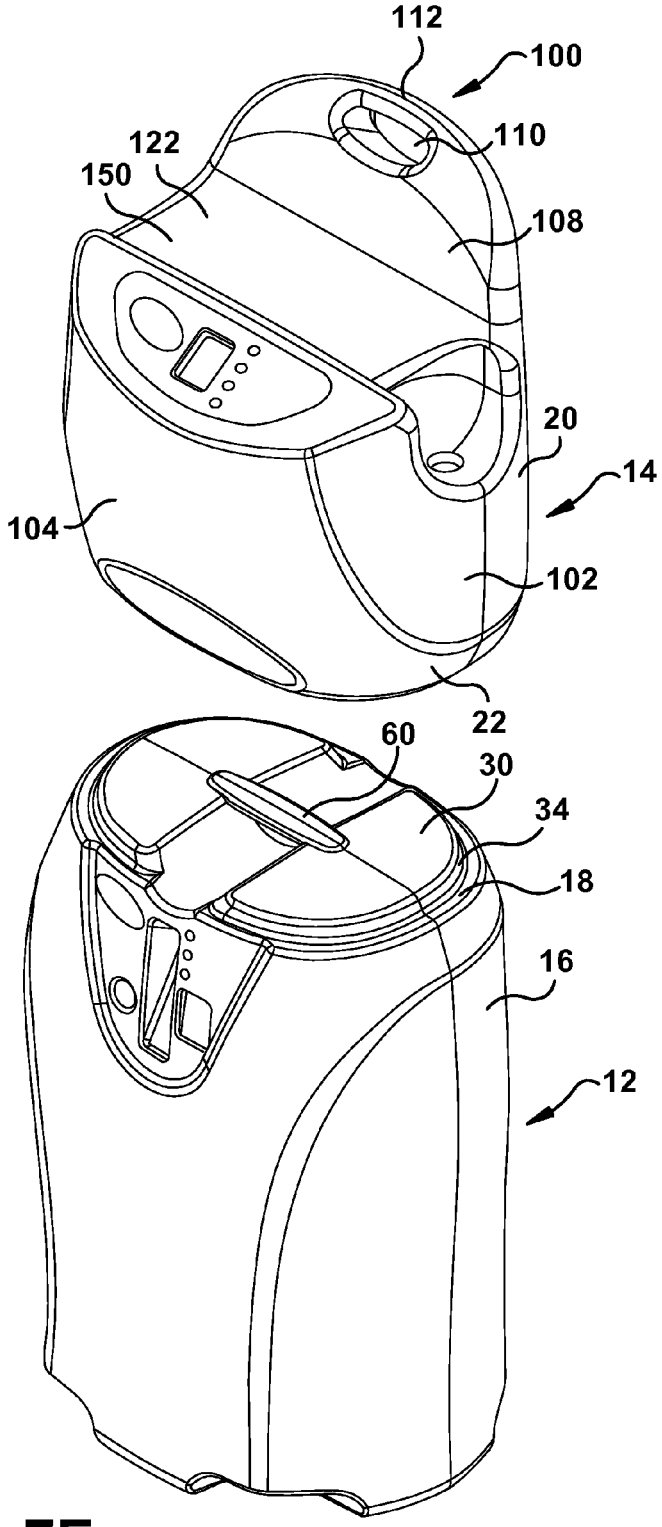
FIG. 7E is an exploded perspective view of an oxygen concentrator housing and a compressor housing of the assembly of FIG. 7A, showing an upper end of the oxygen concentrator housing.
Figure 7F:
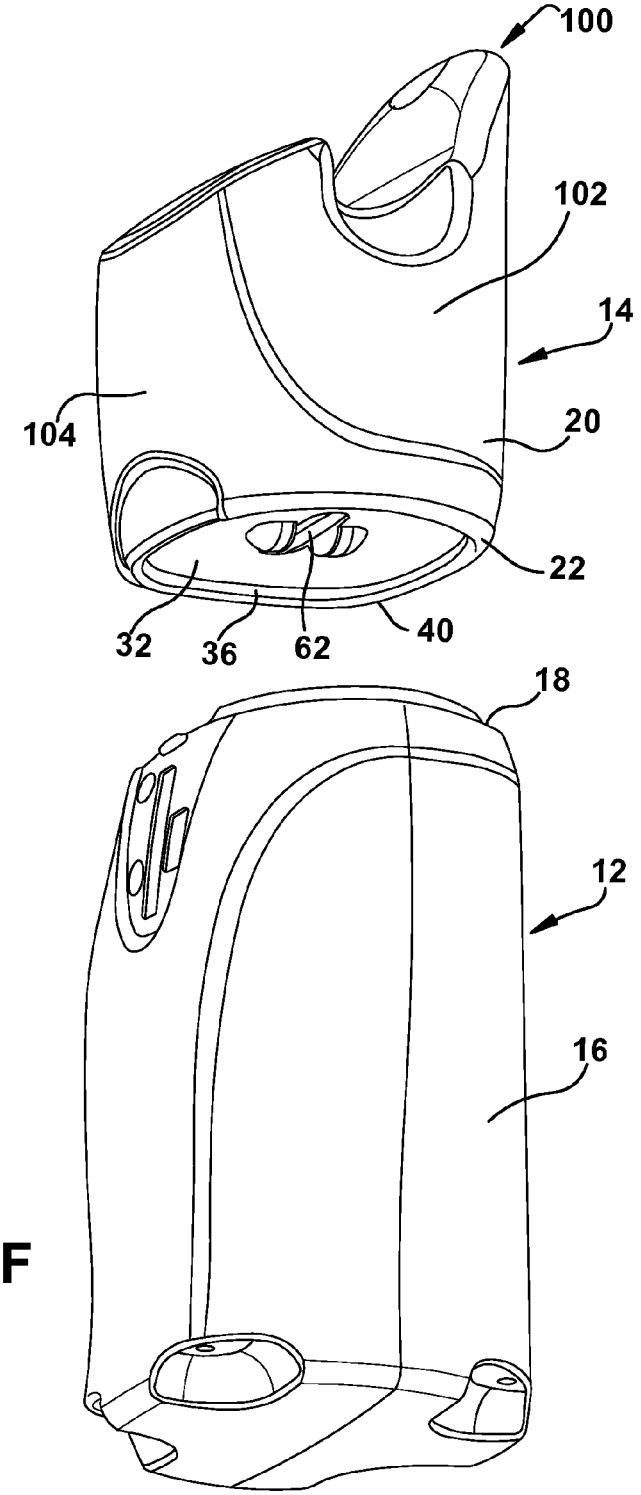
FIG. 7F is an exploded perspective view of an oxygen concentrator housing and a compressor housing of the assembly of FIG. 7A, showing a lower end of the compressor housing.
Figure 8A:
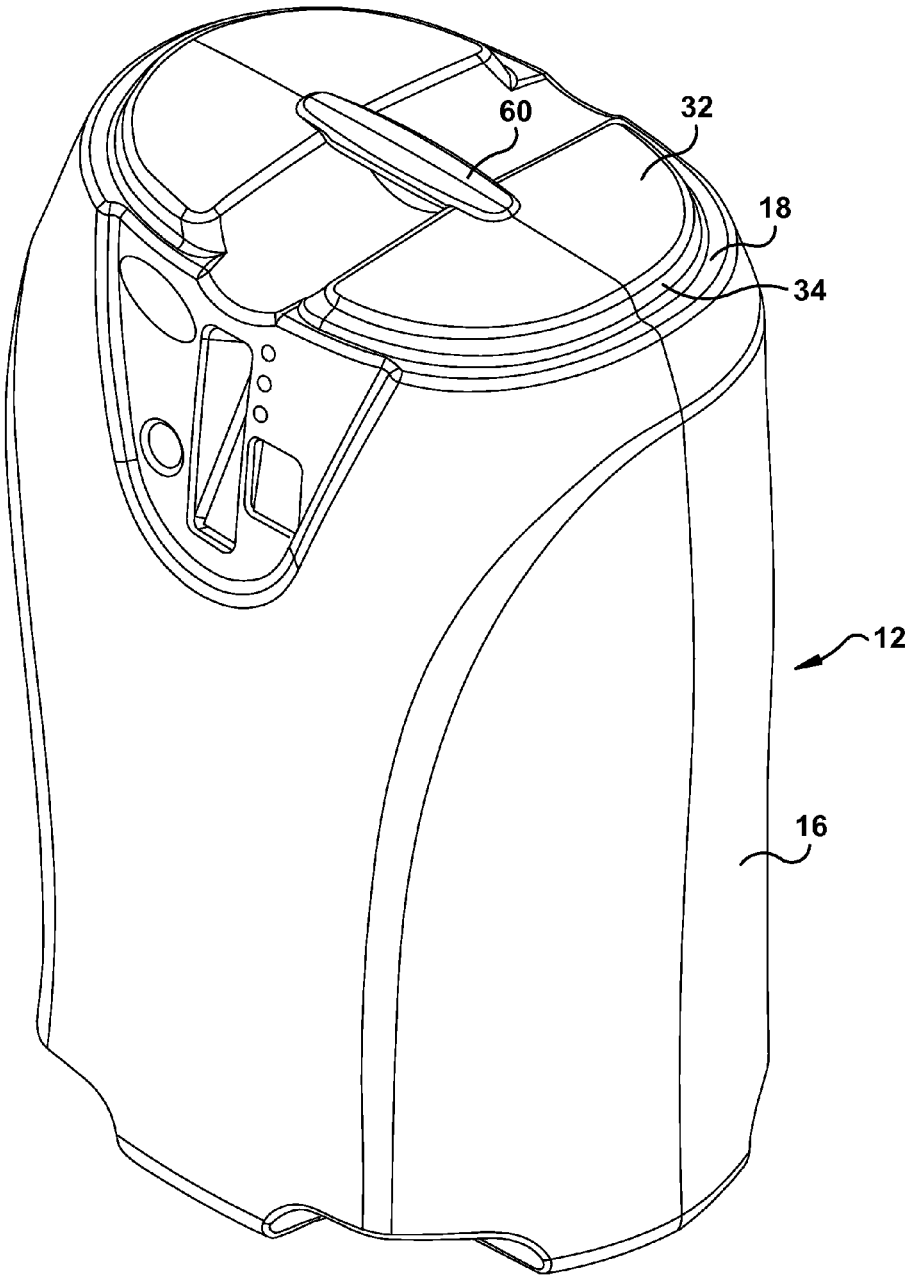
FIG. 8A is a perspective view of an oxygen concentrator housing of the assembly shown in FIG. 7A.
Figure 8B:
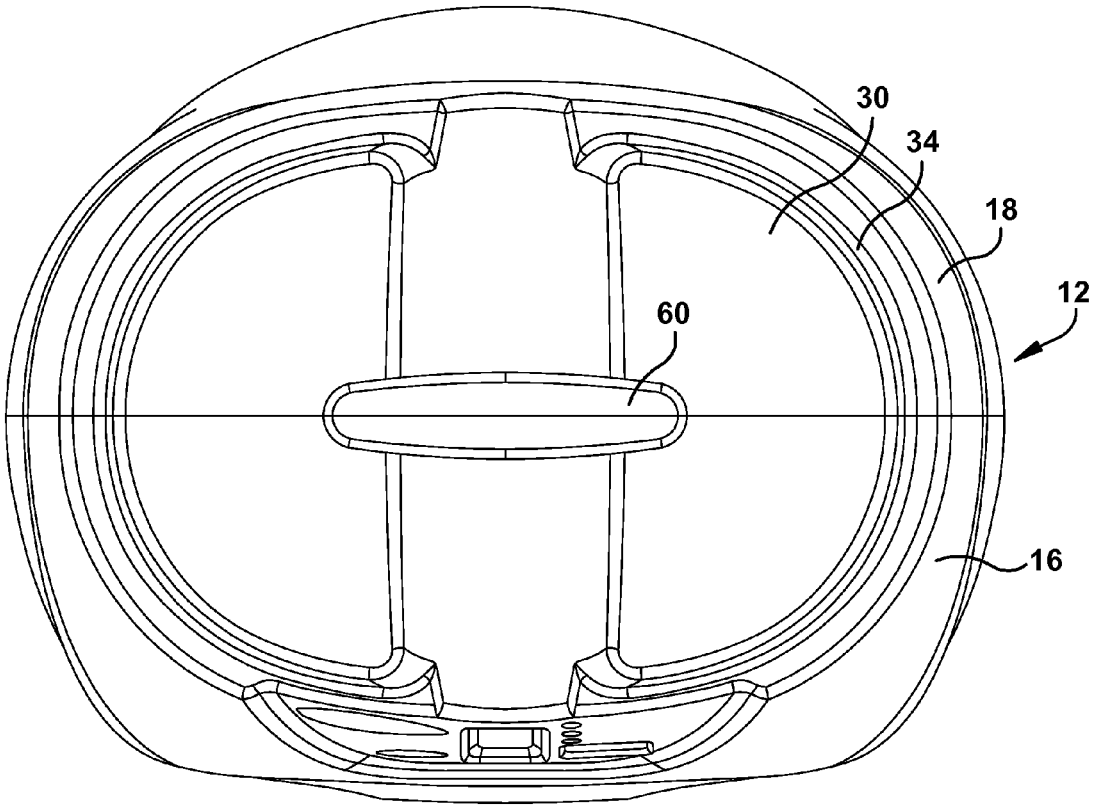
FIG. 8B is a top view of the oxygen concentrator housing shown in FIG. 7A.
Figure 8C:
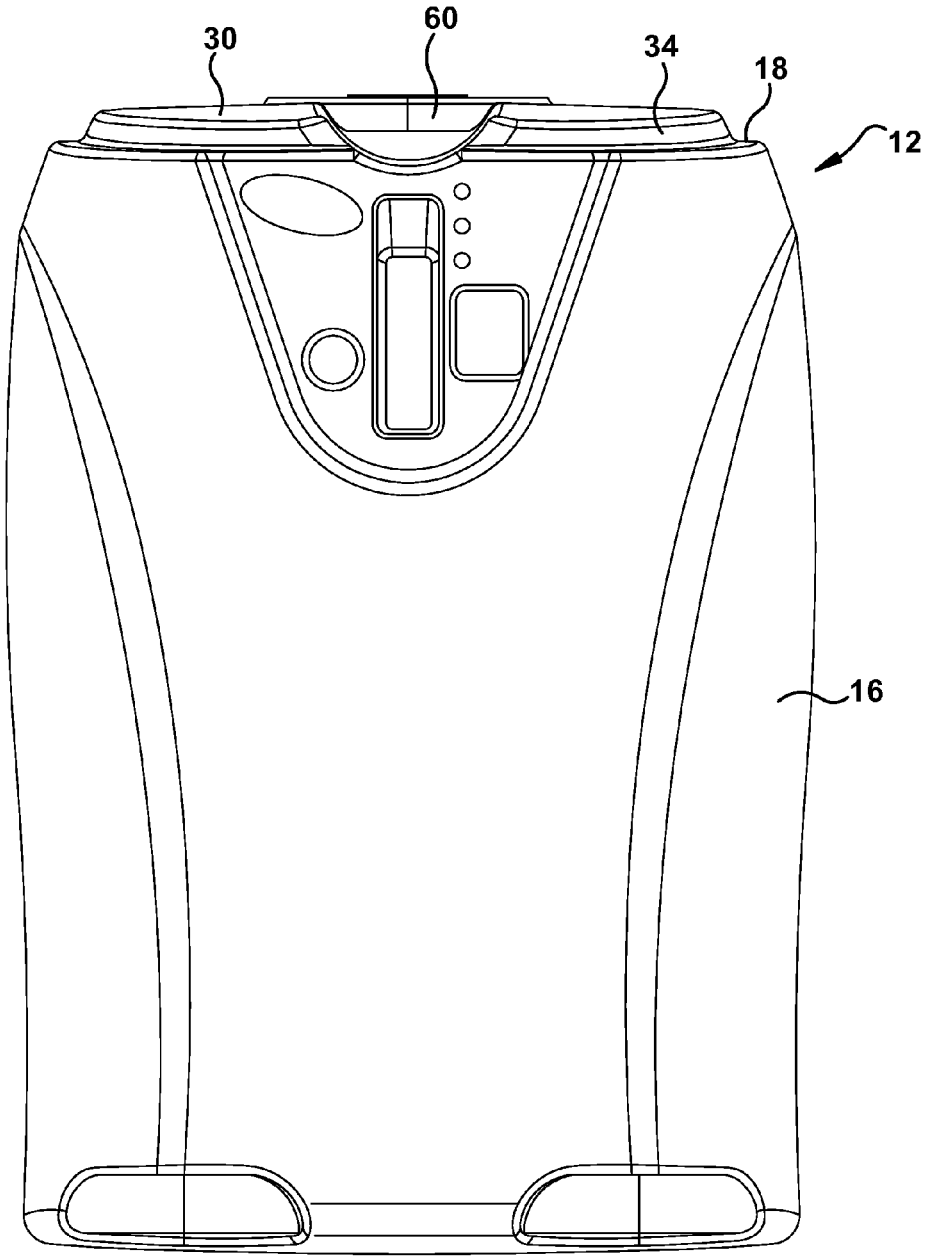
FIG. 8C is a front view of the oxygen concentrator housing shown in FIG. 7A.
Figure 8D:
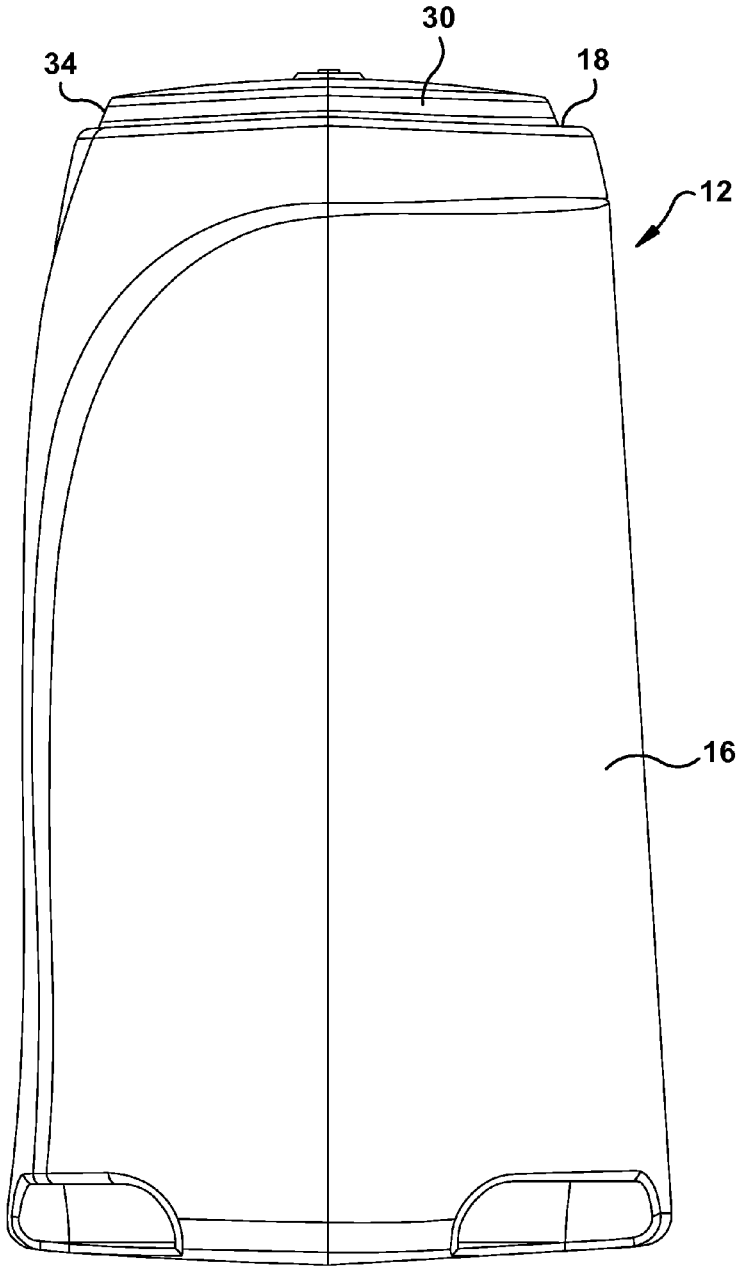
FIG. 8D is a side view of the oxygen concentrator housing shown in FIG. 7A.
Figure 8E:
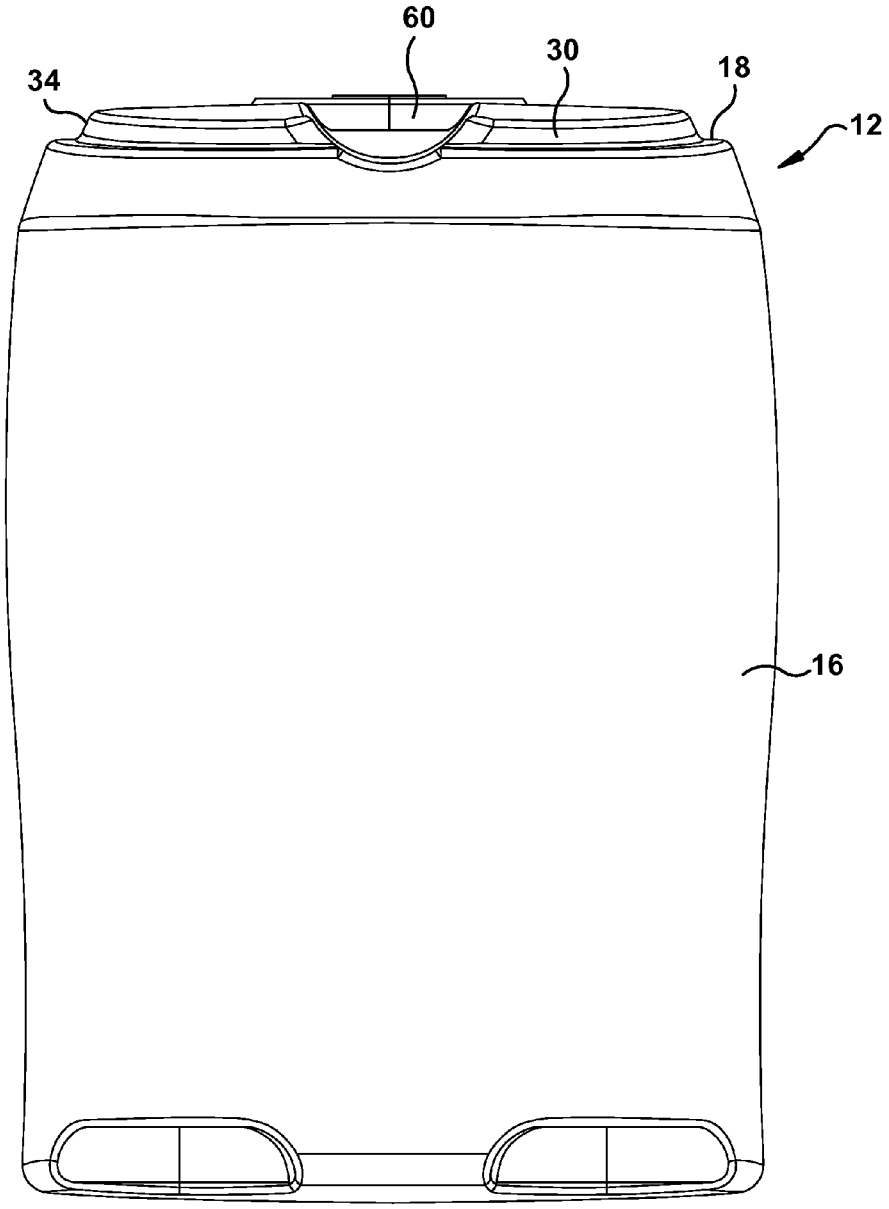
FIG. 8E is a back view of the oxygen concentrator housing shown in FIG. 7A.

Referring to FIG. 7A, the back wall 108 may optionally extend above a compressed oxygen cylinder 120 that rests in a cradle 122 of the compressor housing 20. Since the handle 100 is disposed at the top 112 of the back wall 108, the handle 100 is disposed above the compressed oxygen cylinder 120. This placement provides access to the handle both when a compressed oxygen cylinder 120 is not in the cradle 122 and when a compressed oxygen cylinder 120 is disposed in the cradle.

Figure 3A:
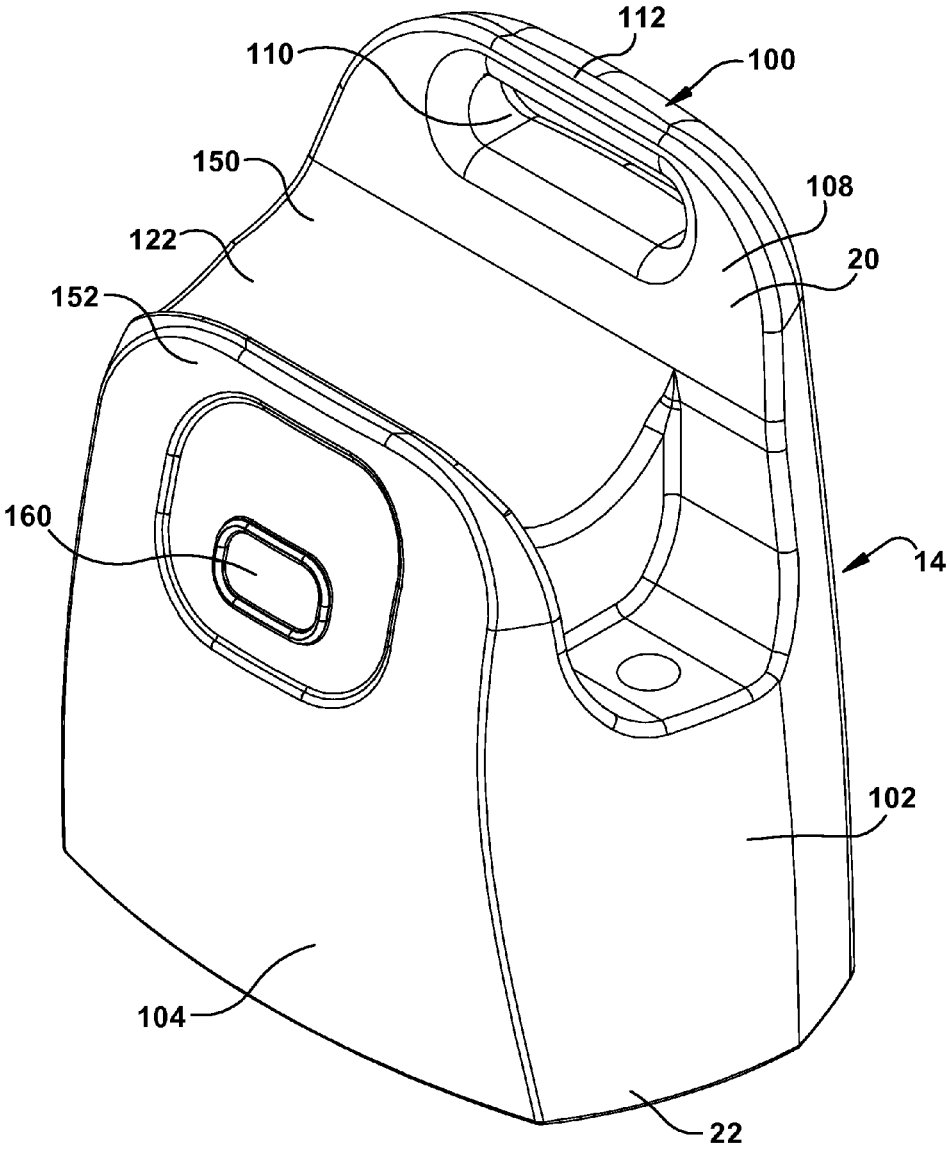
FIG. 3A is a perspective view of a compressor housing of the assembly shown in FIG. 1A.
Figure 3B:
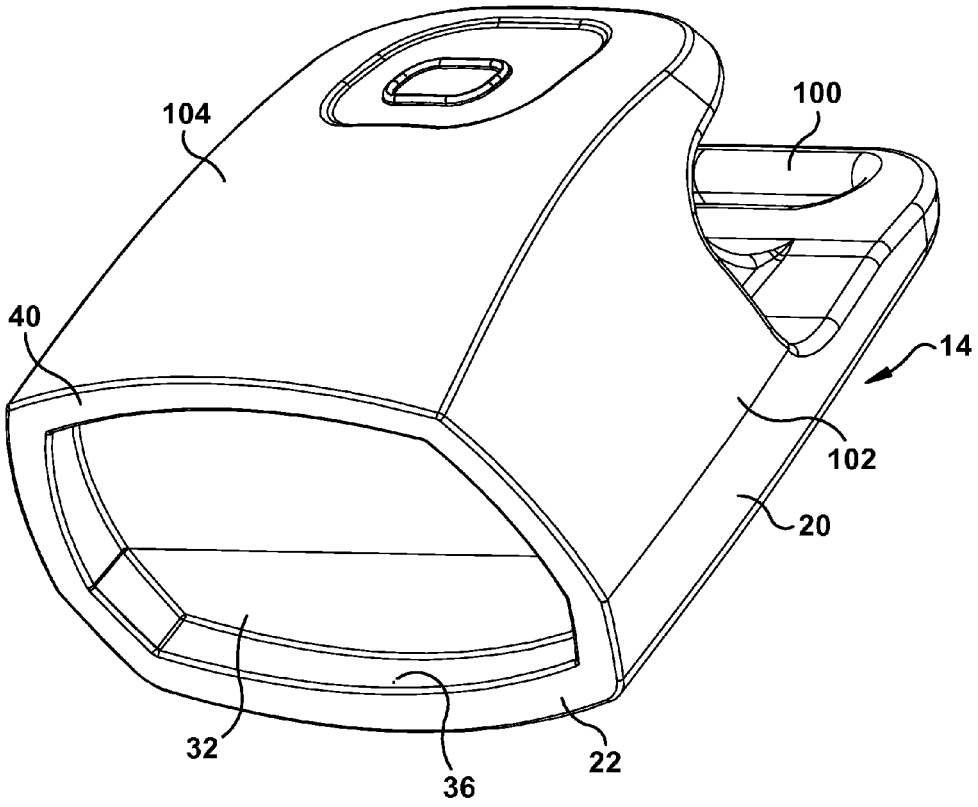
FIG. 3B is a second perspective view of the compressor housing shown in FIG. 3A, showing a lower end of the compressor housing.
Figure 3C:
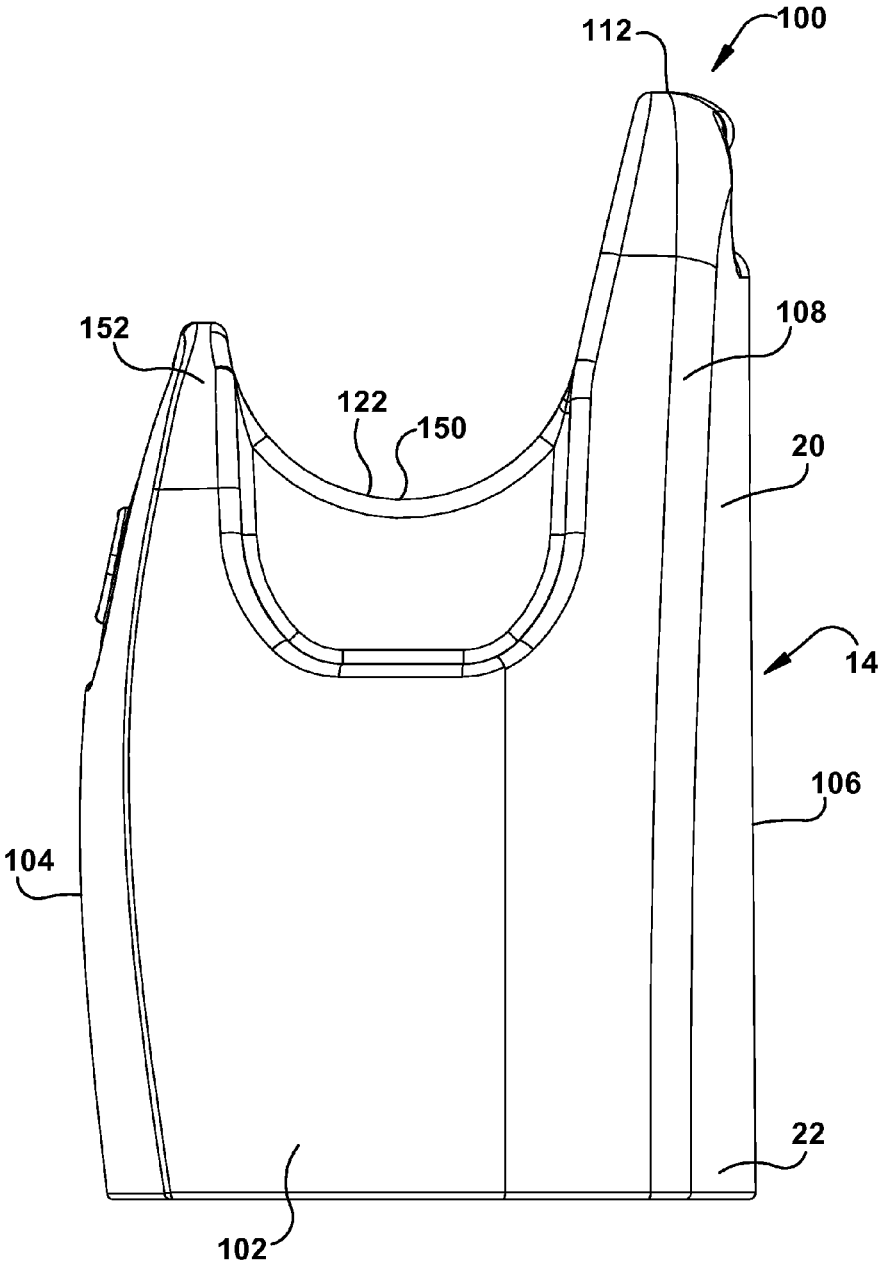
FIG. 3C is a side view of the compressor housing shown in FIG. 3A.
Figure 3D:
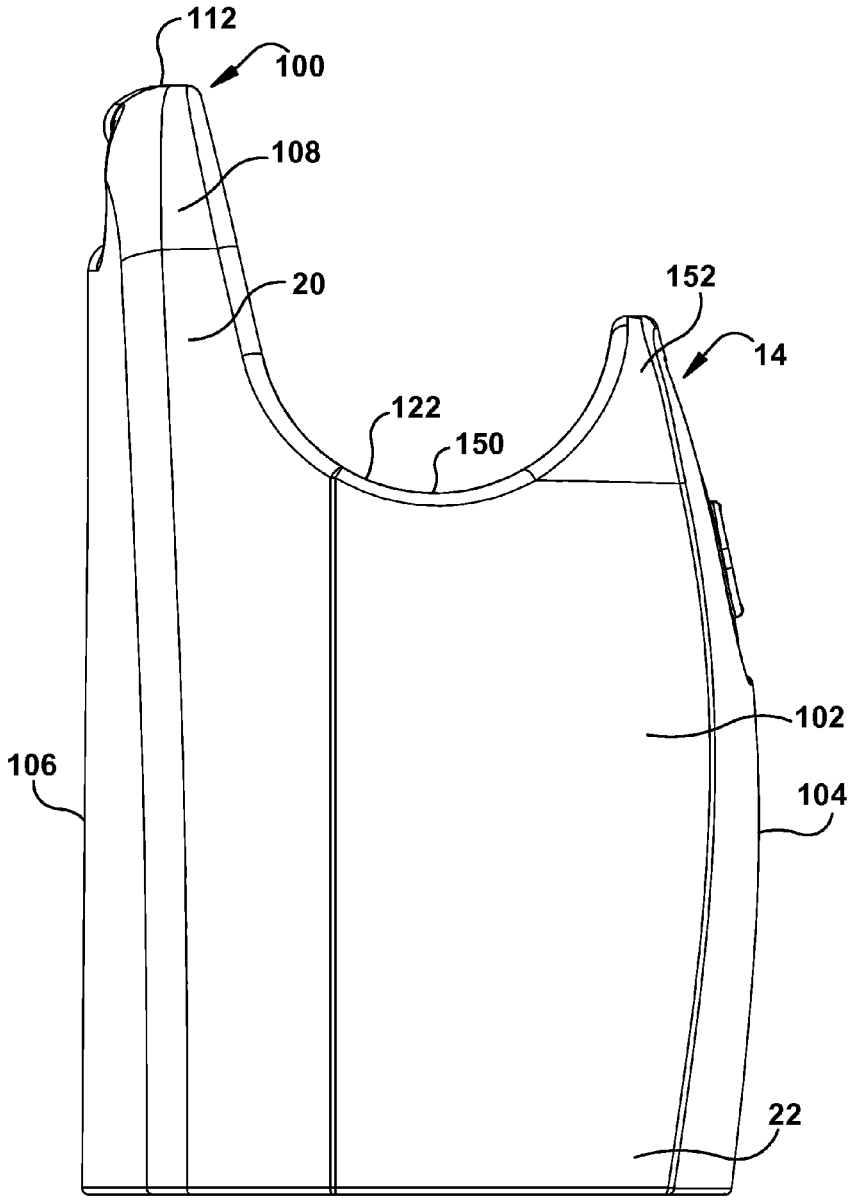
FIG. 3D is a side view of the compressor housing shown in FIG. 3A.
Figure 3E:
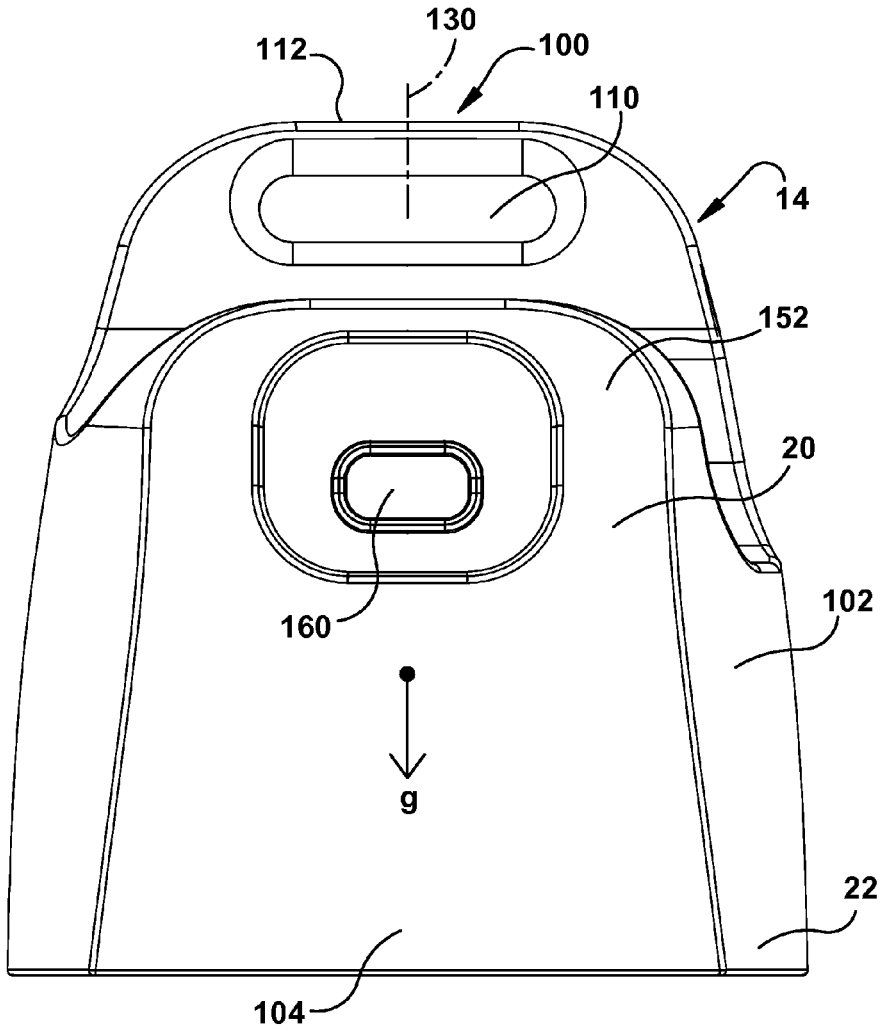
FIG. 3E is a front view of the compressor housing shown in FIG. 3A.
Figure 3F:
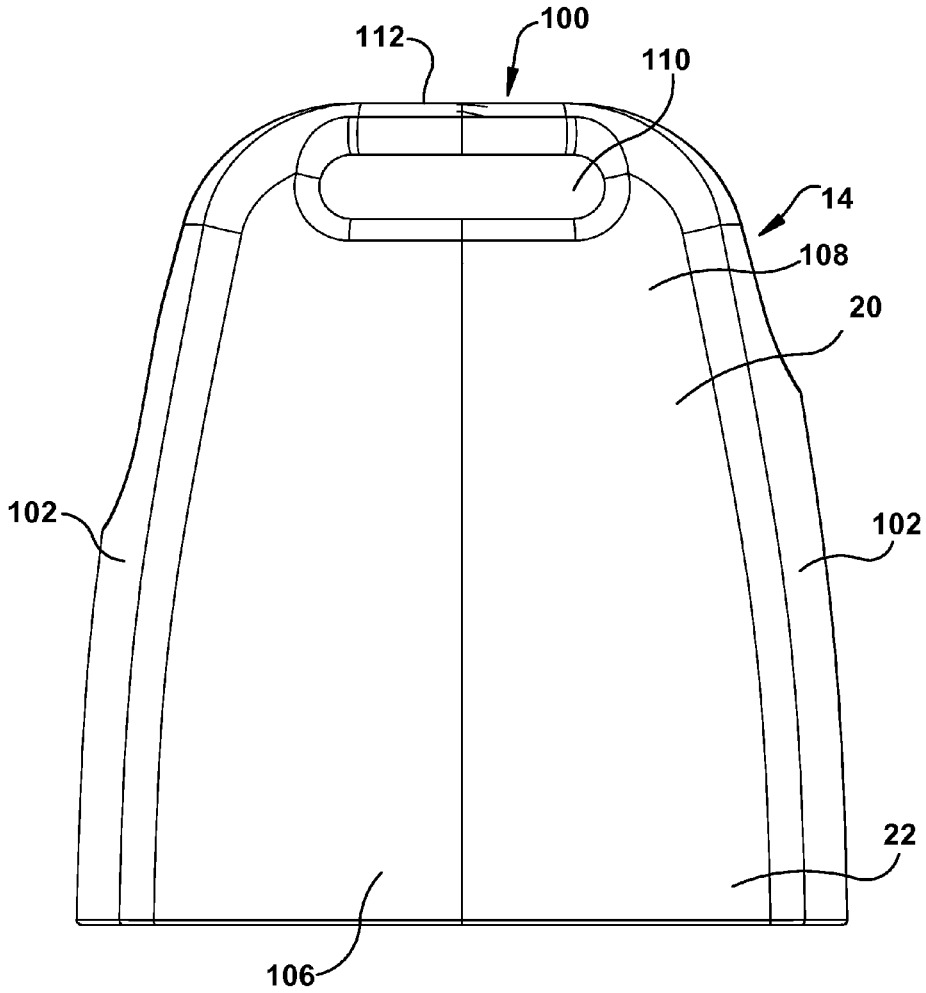
FIG. 3F is a back view of the compressor housing shown in FIG. 3A.
Figure 3G:
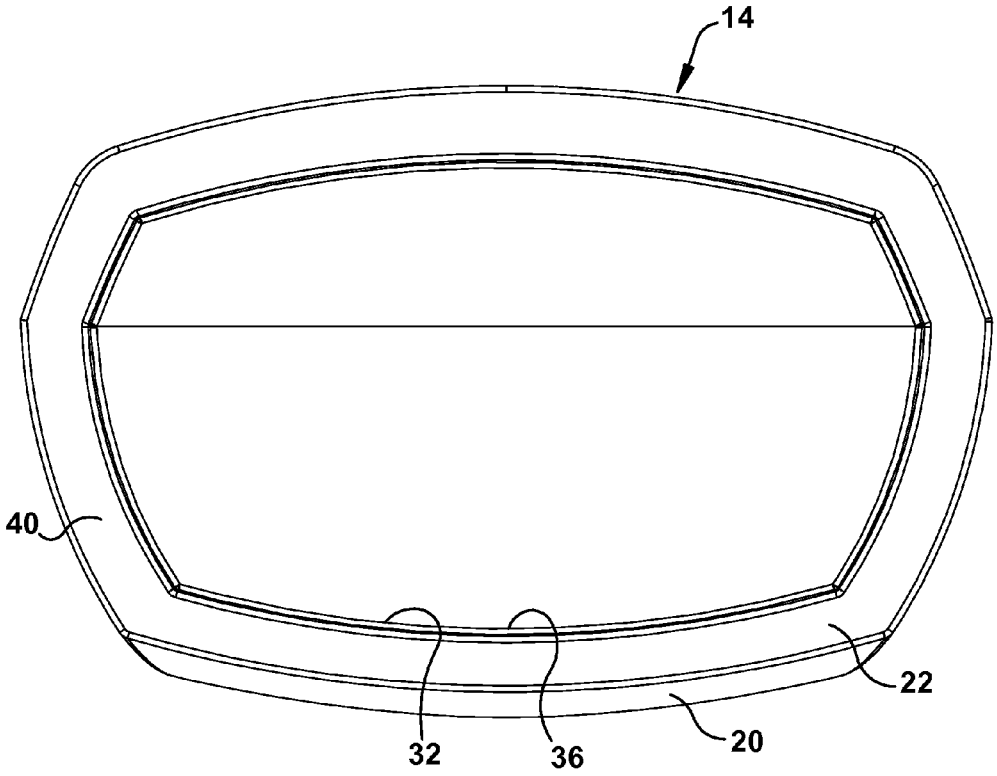
FIG. 3G is a bottom view of the compressor housing shown in FIG. 3A.
Figure 4A:
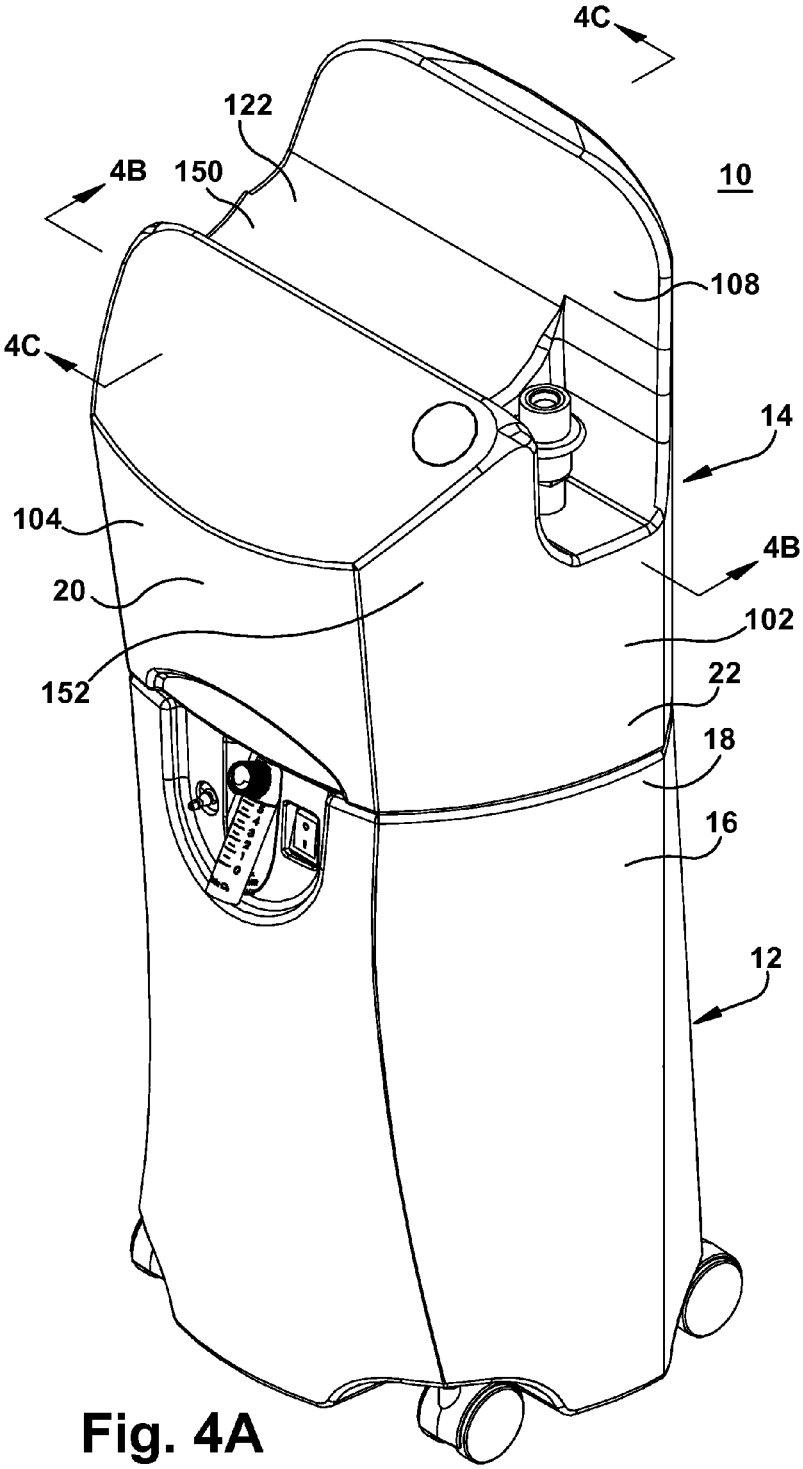
FIG. 4A is a perspective view of an oxygen concentrator and compressor assembly of a second embodiment.
Figure 4B:
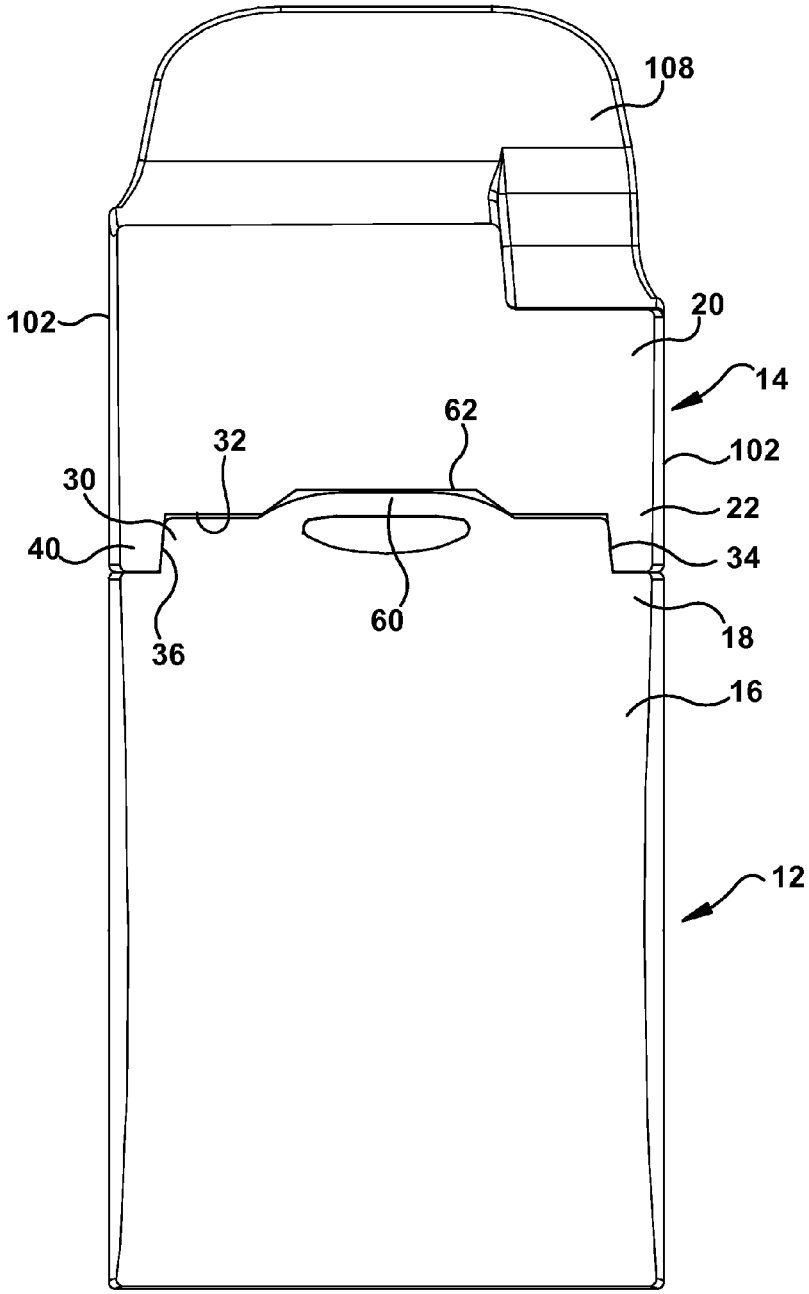
FIG. 4B is a sectional view taken along the plane indicated by lines 4B-4B in FIG. 4A.
Figure 4C:
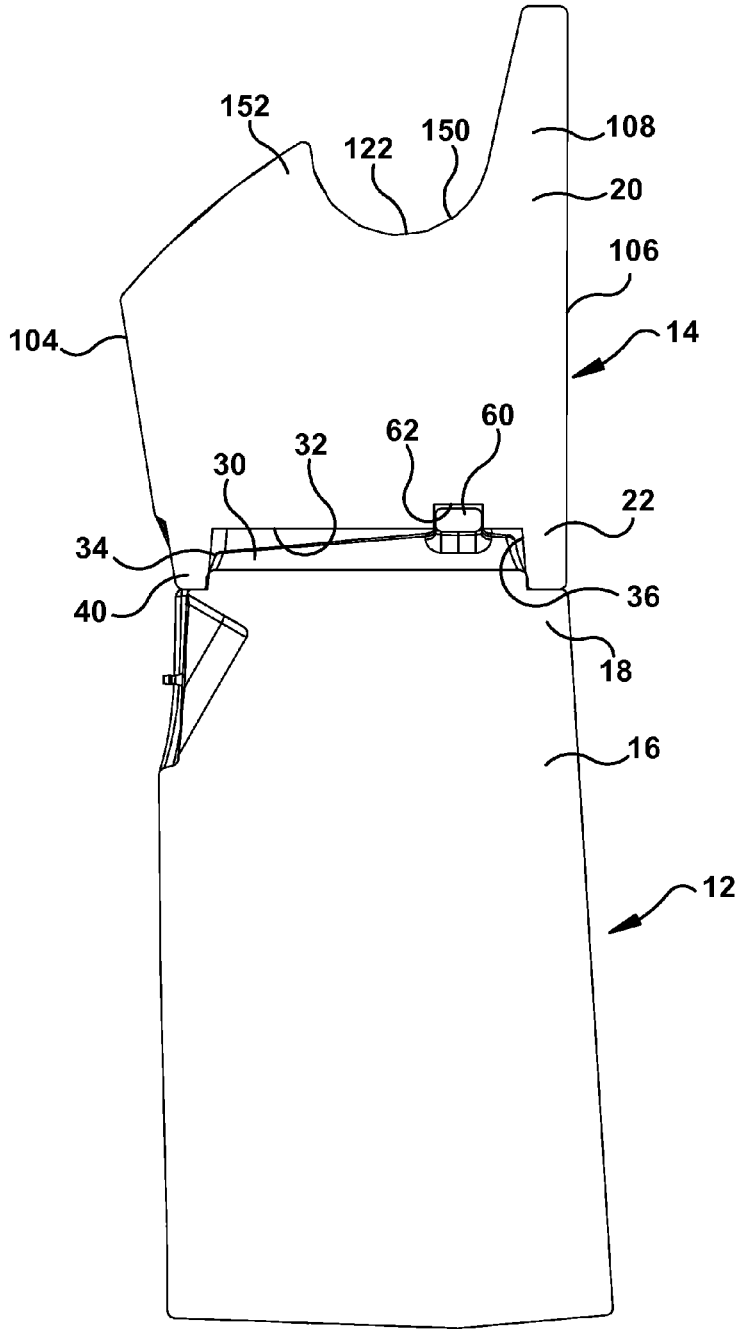
FIG. 4C is a sectional view taken along the plane indicated by lines 4C-4C in FIG. 4A.
Figure 4D:
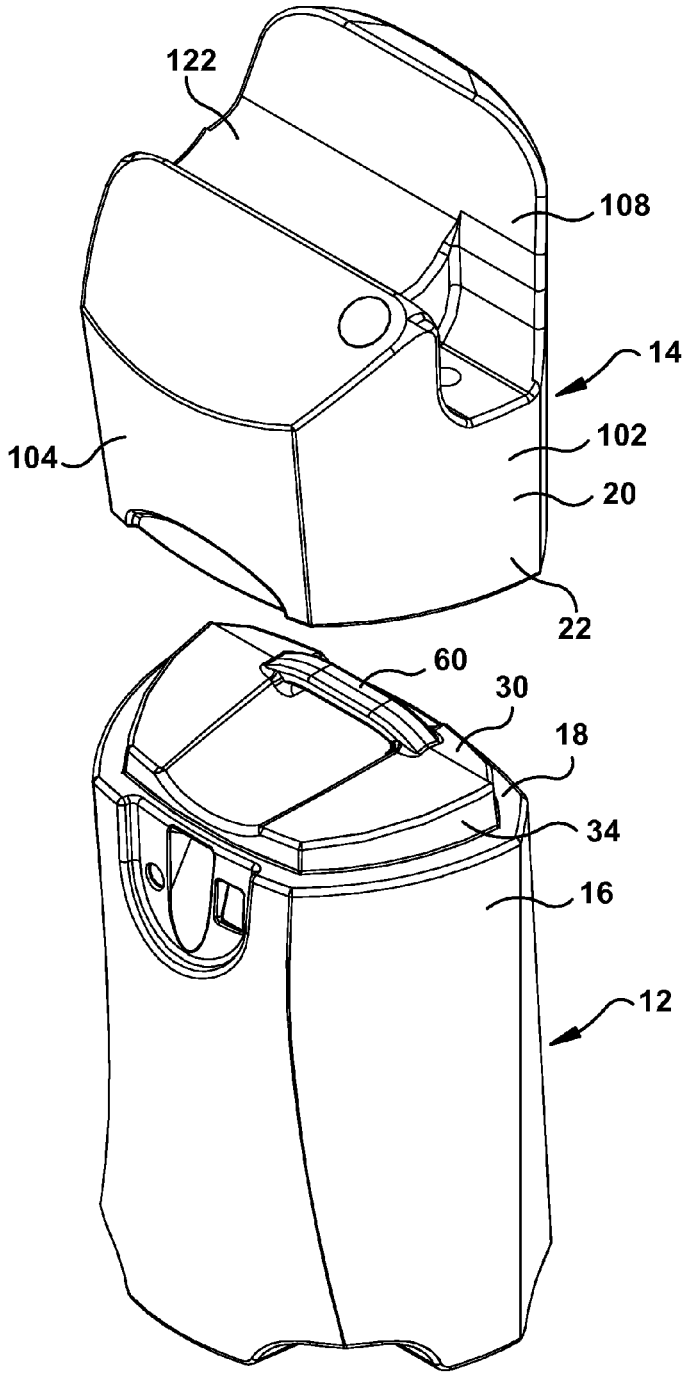
FIG. 4D is an exploded perspective view of an oxygen concentrator housing and a compressor housing of the assembly of FIG. 4A, showing an upper end of the oxygen concentrator housing.
Figure 4E:
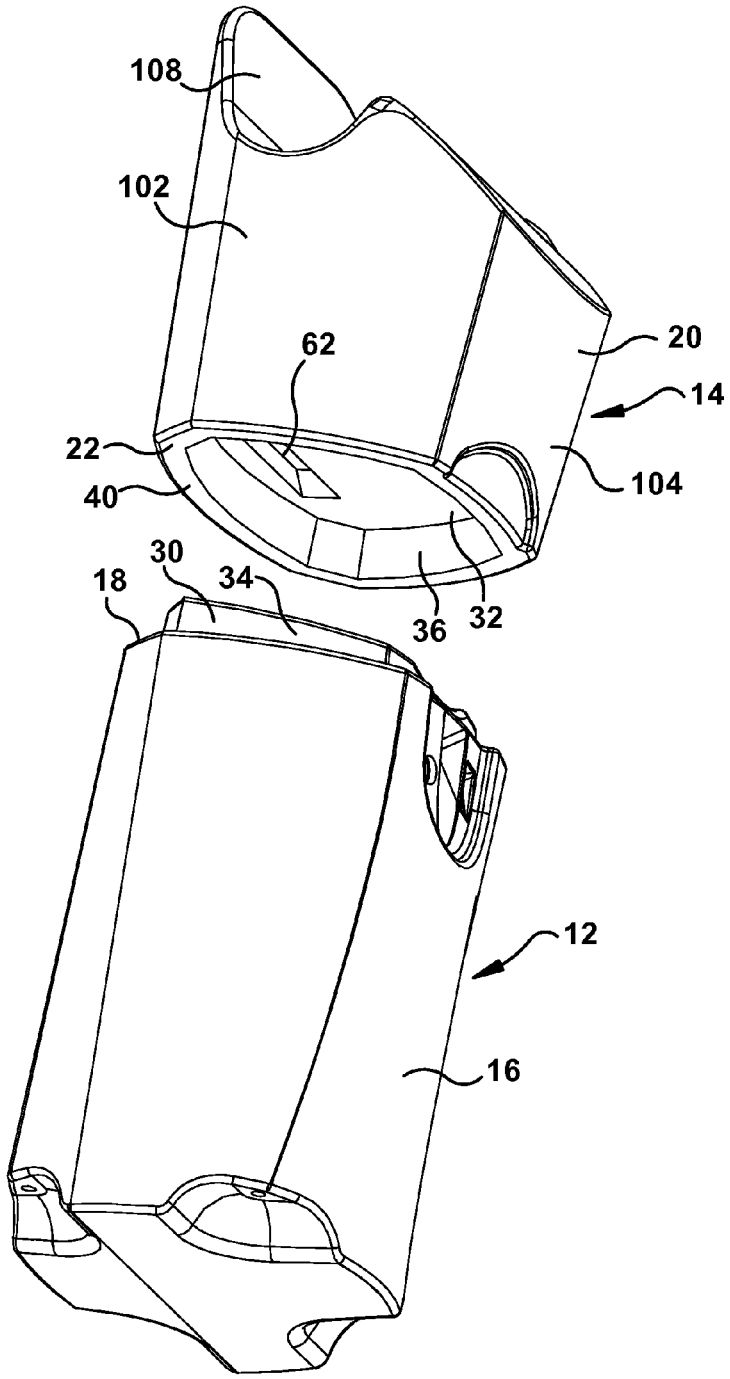
FIG. 4E is an exploded perspective view of an oxygen concentrator housing and a compressor housing of the assembly of FIG. 4A, showing a lower end of the compressor housing.
Figure 5A:
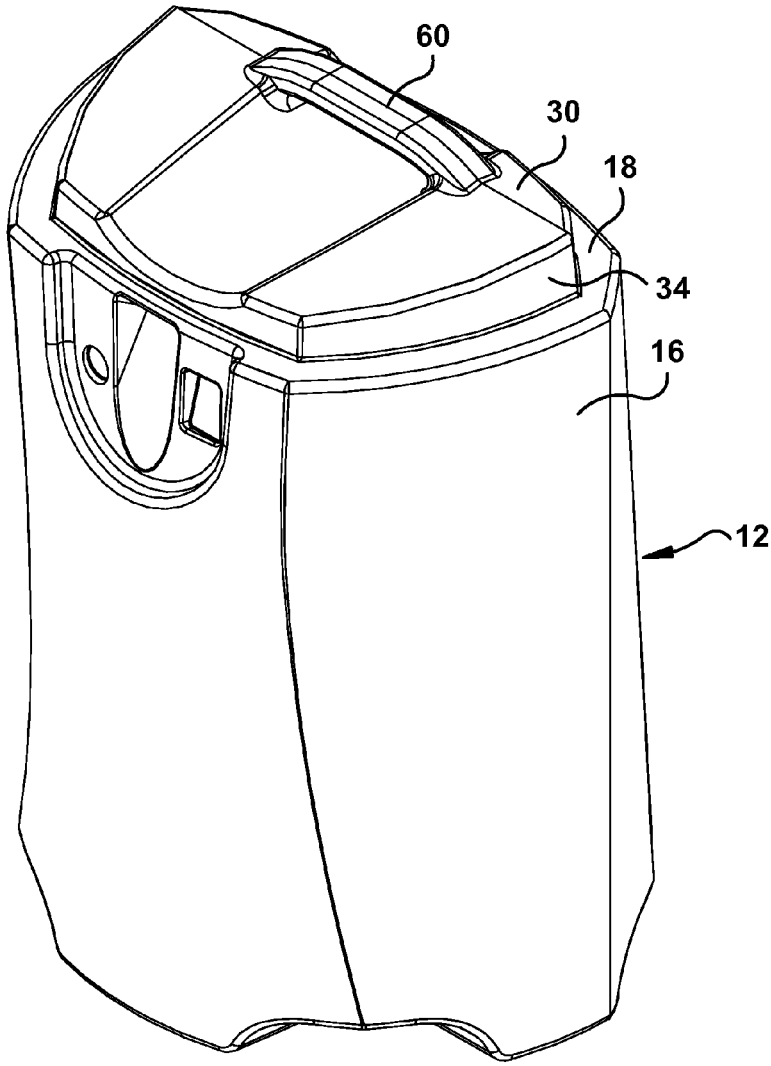
FIG. 5A is a perspective view of an oxygen concentrator housing of the assembly shown in FIG. 4A.
Figure 5B:
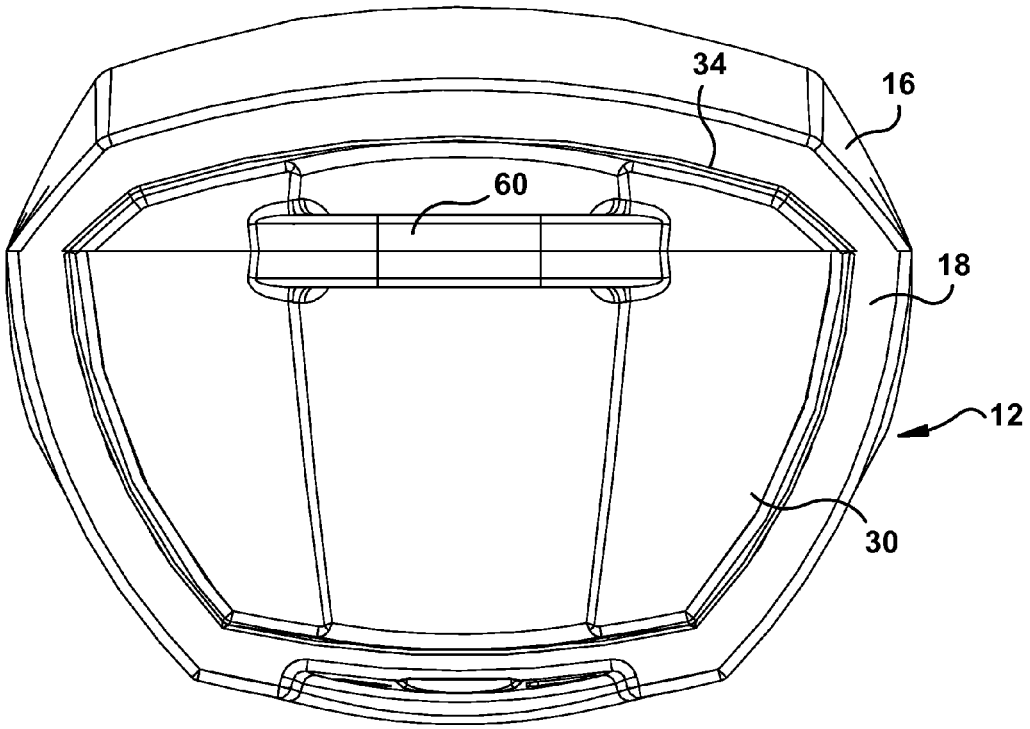
FIG. 5B is a top view of the oxygen concentrator housing shown in FIG. 4A.
Figure 5C:
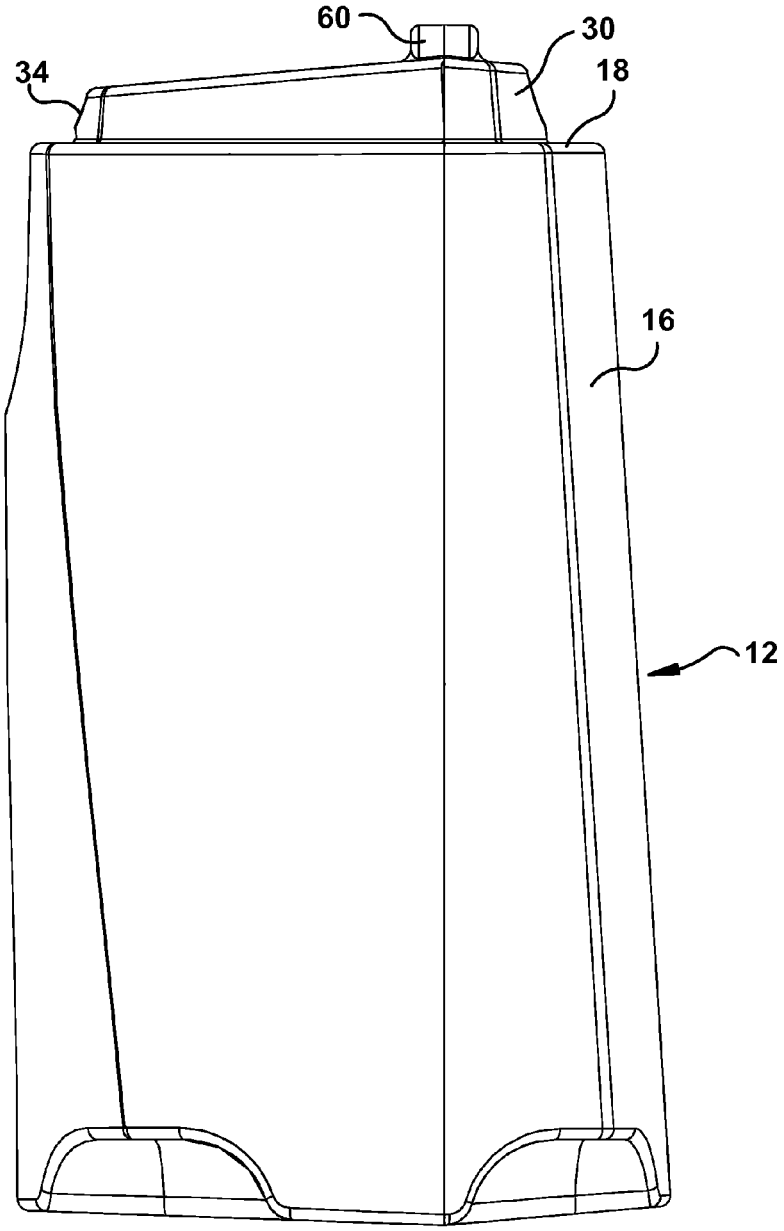
FIG. 5C is a side view of the oxygen concentrator housing shown in FIG. 4A.
Figure 5D:
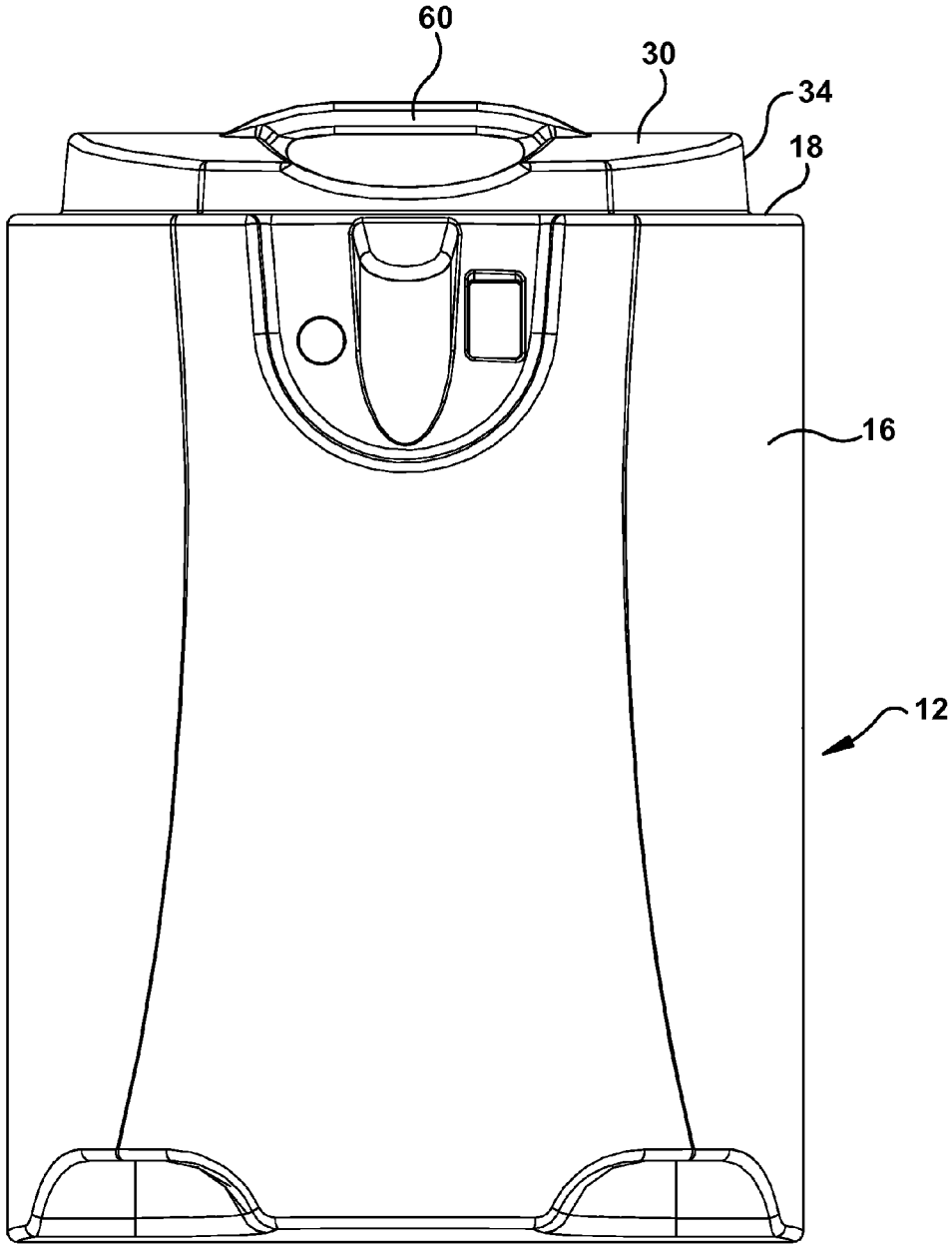
FIG. 5D is a front view of the oxygen concentrator housing shown in FIG. 4A.
Figure 5E:
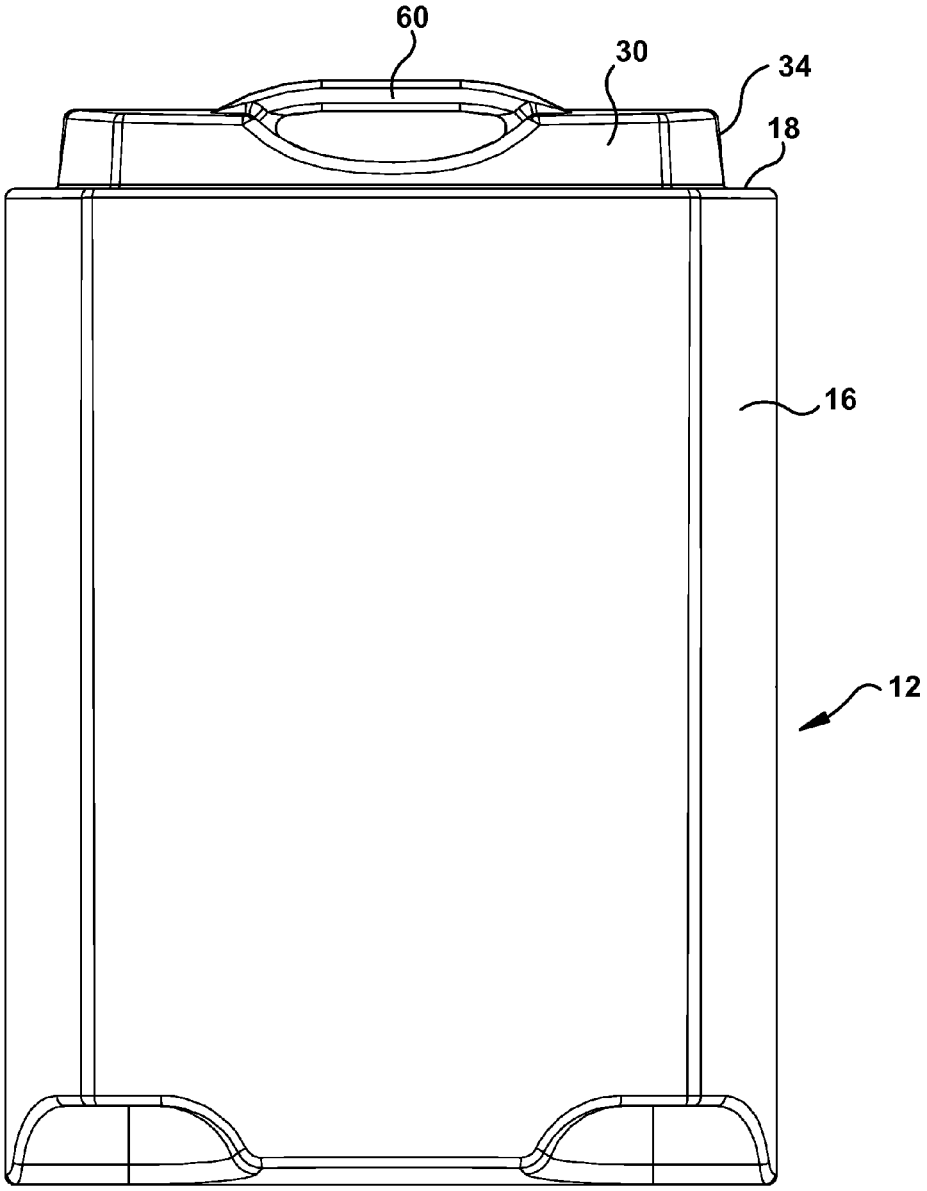
FIG. 5E is a back view of the oxygen concentrator housing shown in FIG. 4A.
Figure 6A:
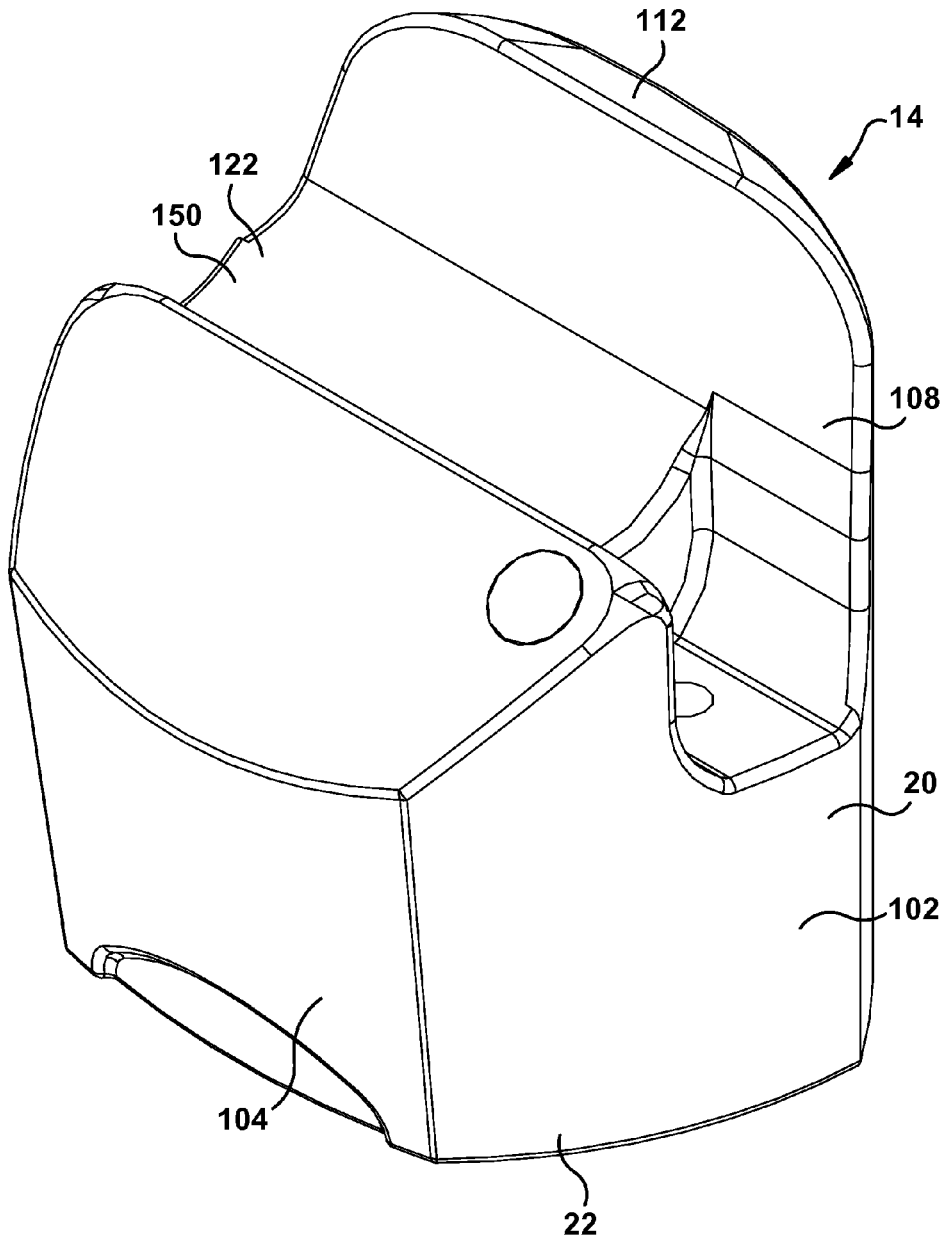
FIG. 6A is a perspective view of a compressor housing of the assembly shown in FIG. 4A.
Figure 6B:
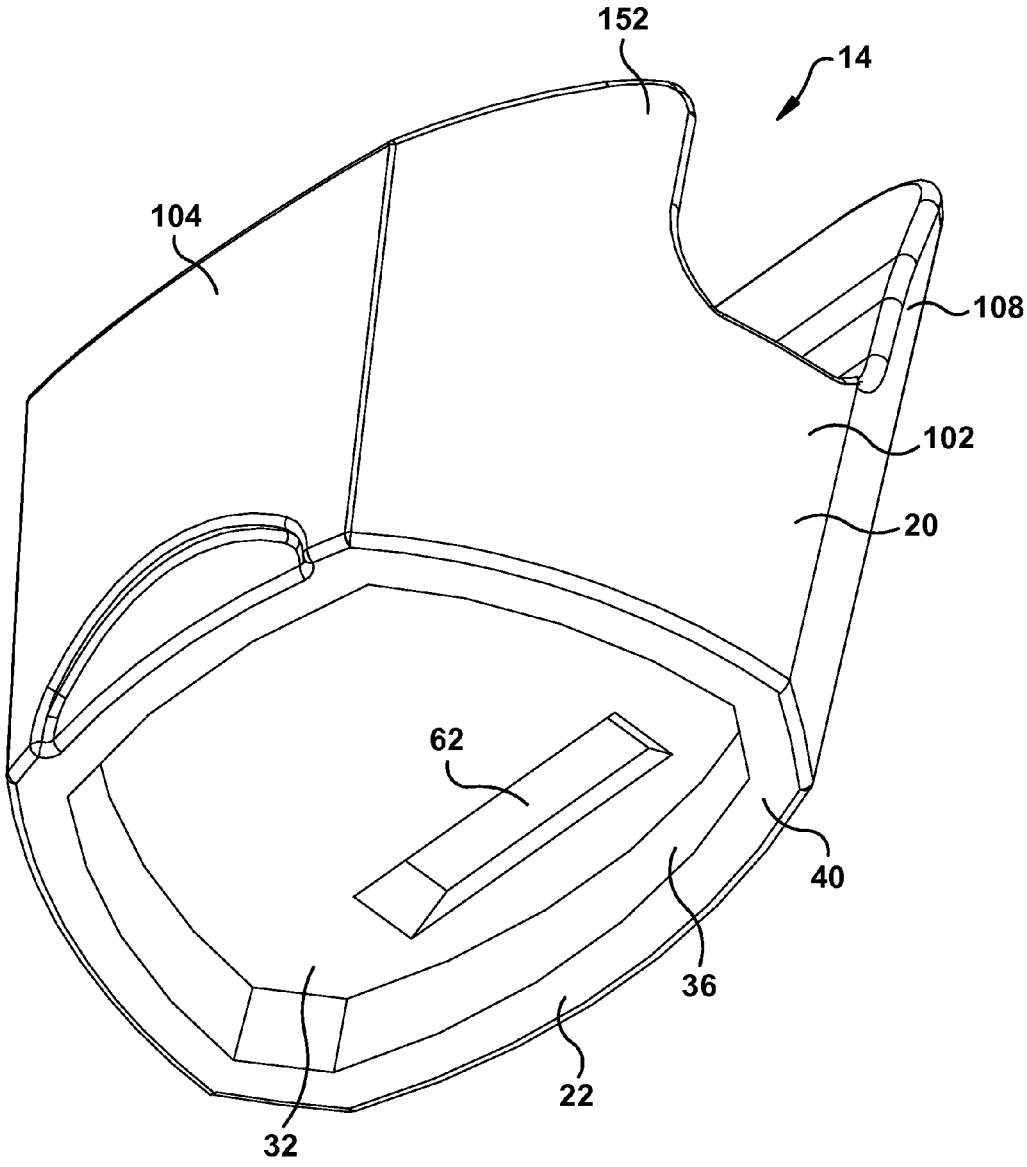
FIG. 6B is a second perspective view of the compressor housing shown in FIG. 6A, showing a lower end of the compressor housing.
Figure 6C:
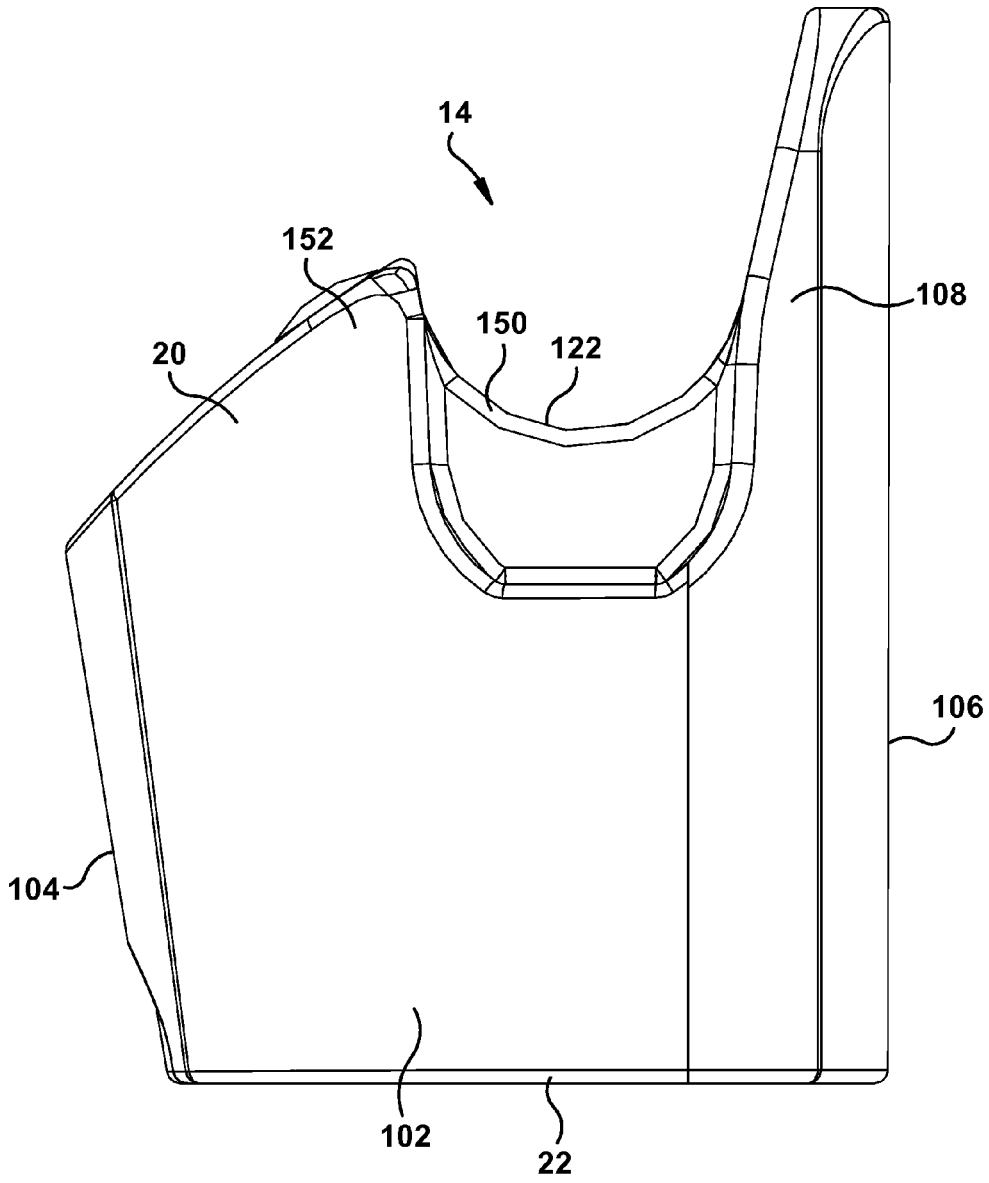
FIG. 6C is a side view of the compressor housing shown in FIG. 6A.
Figure 6D:
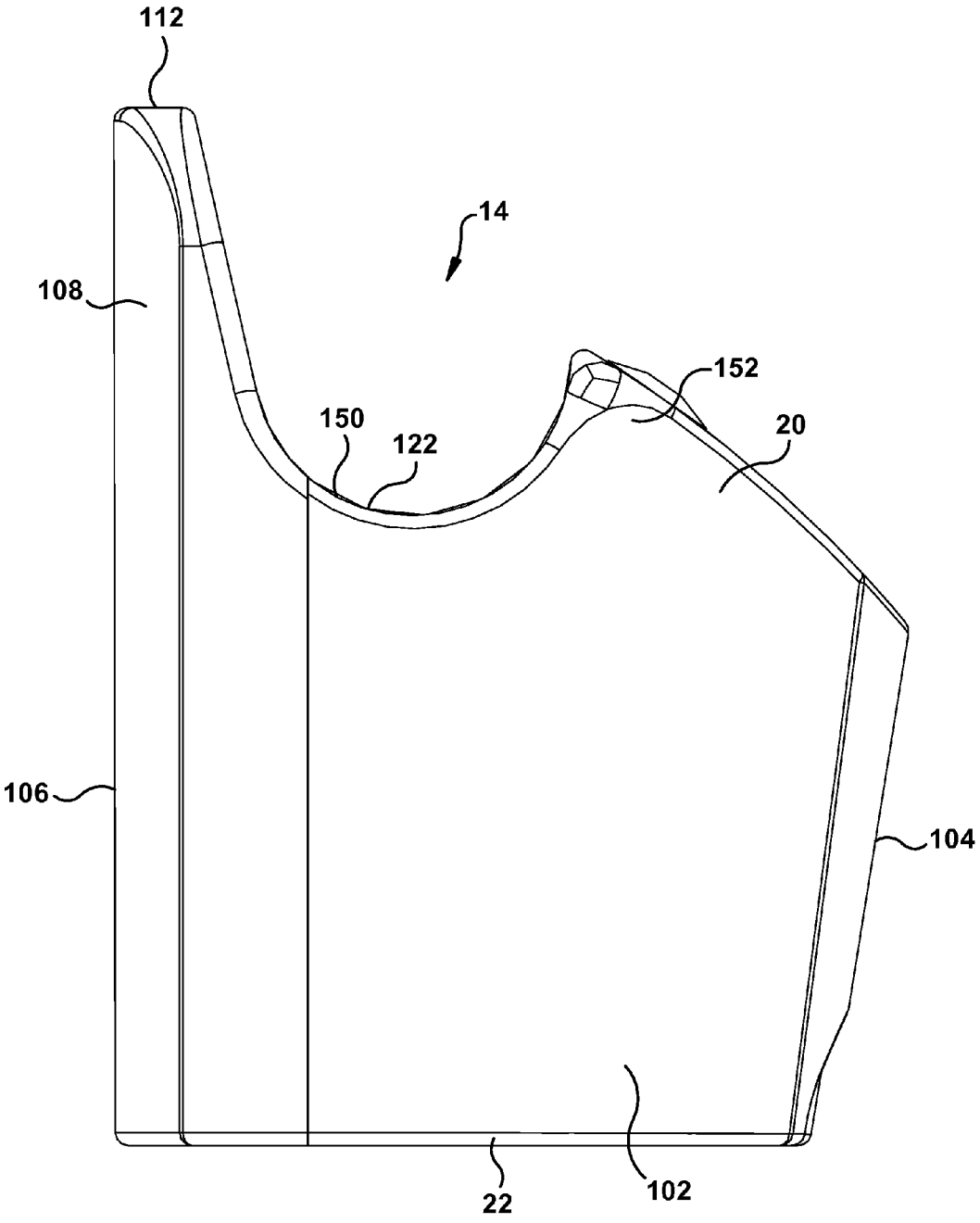
FIG. 6D is a side view of the compressor housing shown in FIG. 6A.
Figure 6E:
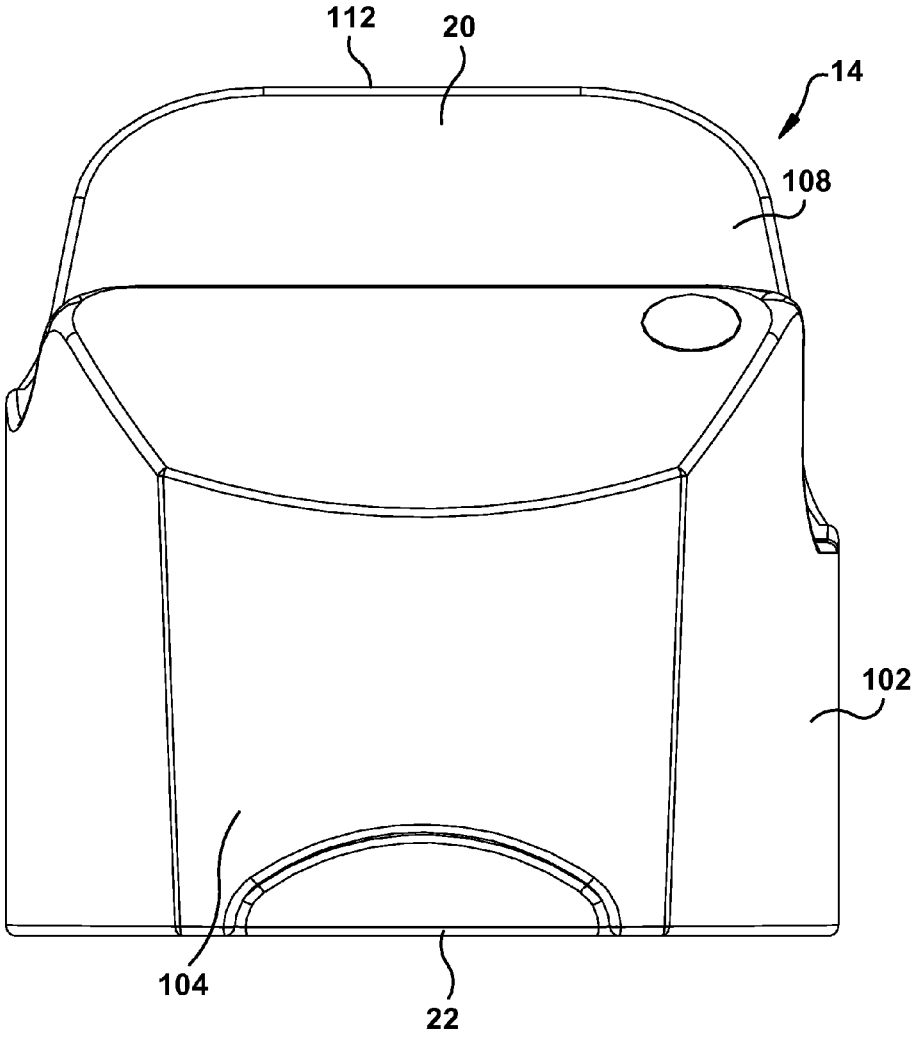
FIG. 6E is a front view of the compressor housing shown in FIG. 6A.
Figure 6F:
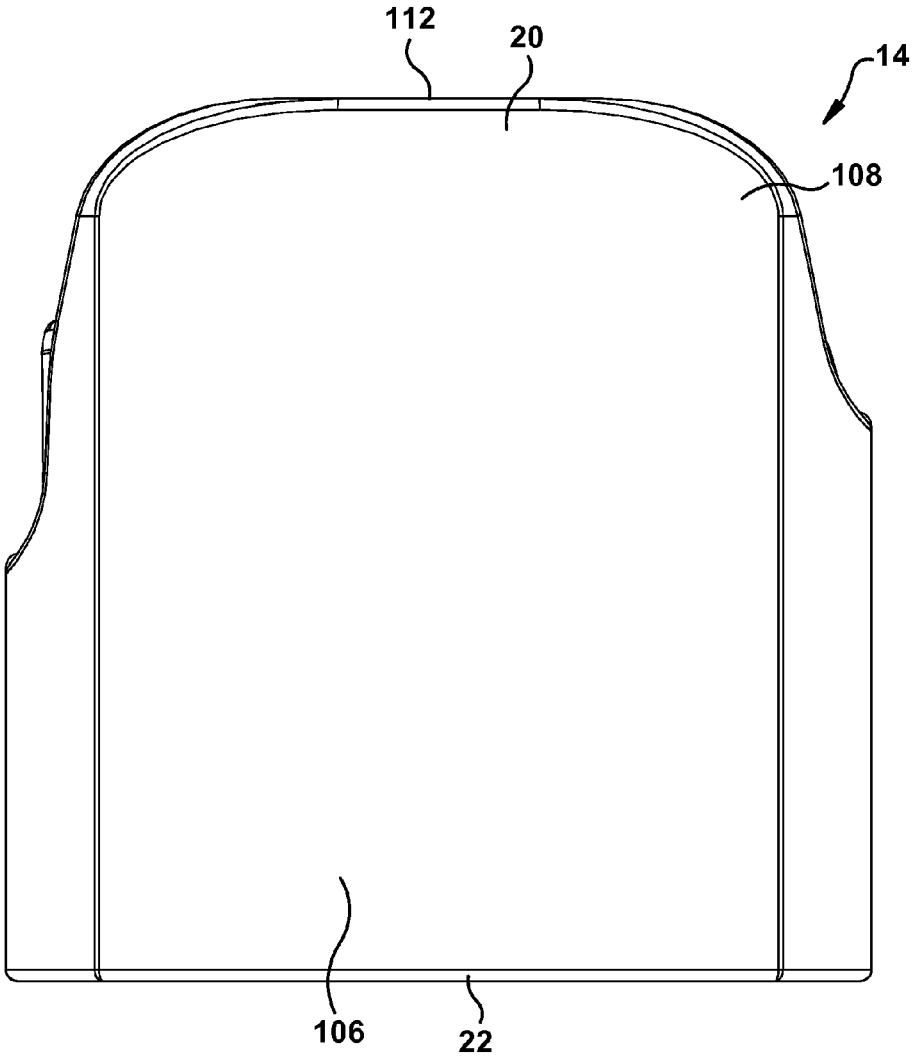
FIG. 6F is a back view of the compressor housing shown in FIG. 6A.
Figure 6G:
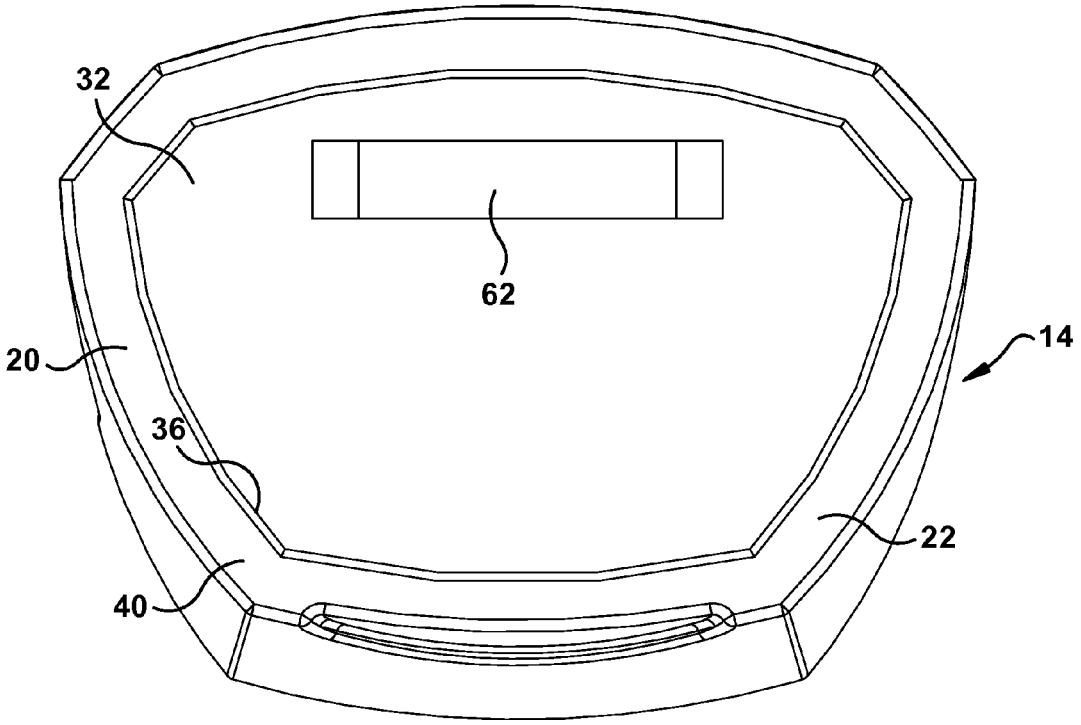
FIG. 6G is a bottom view of the compressor housing shown in FIG. 6A.
Figure 9A:
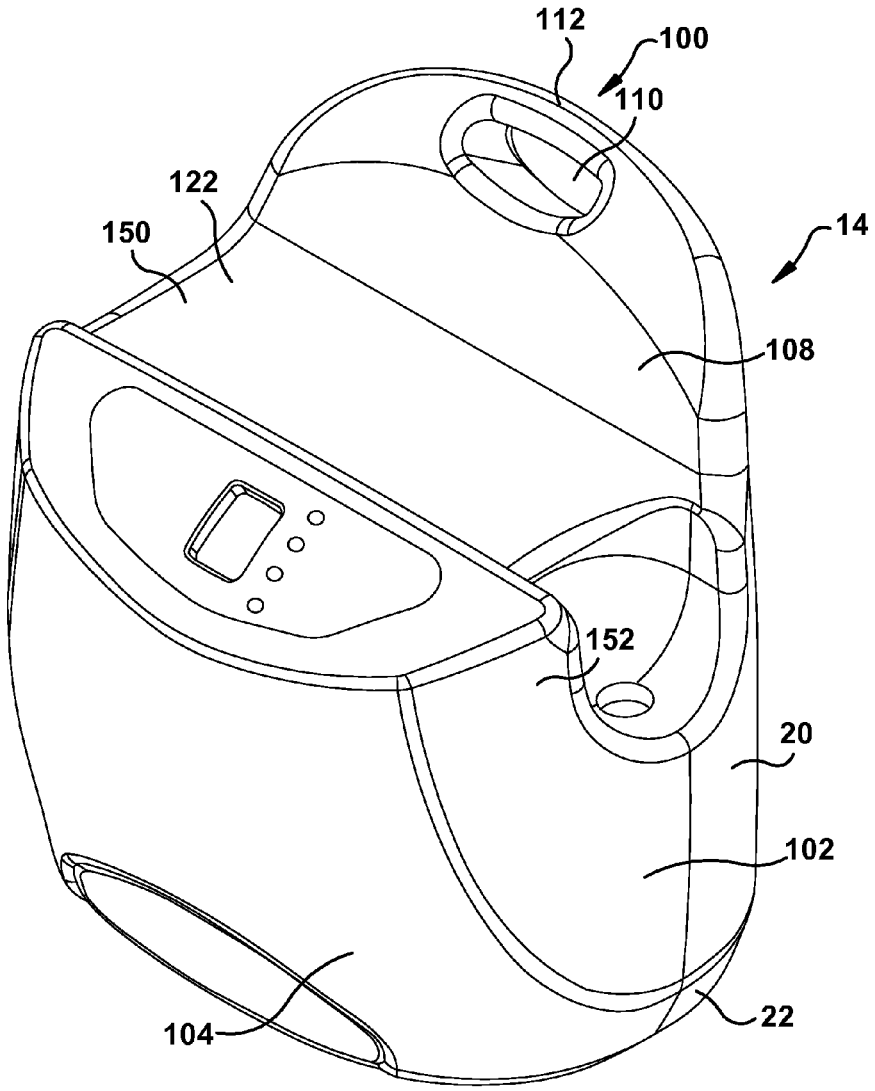
FIG. 9A is a perspective view of a compressor housing of the assembly shown in FIG. 7A.
Figure 9B:
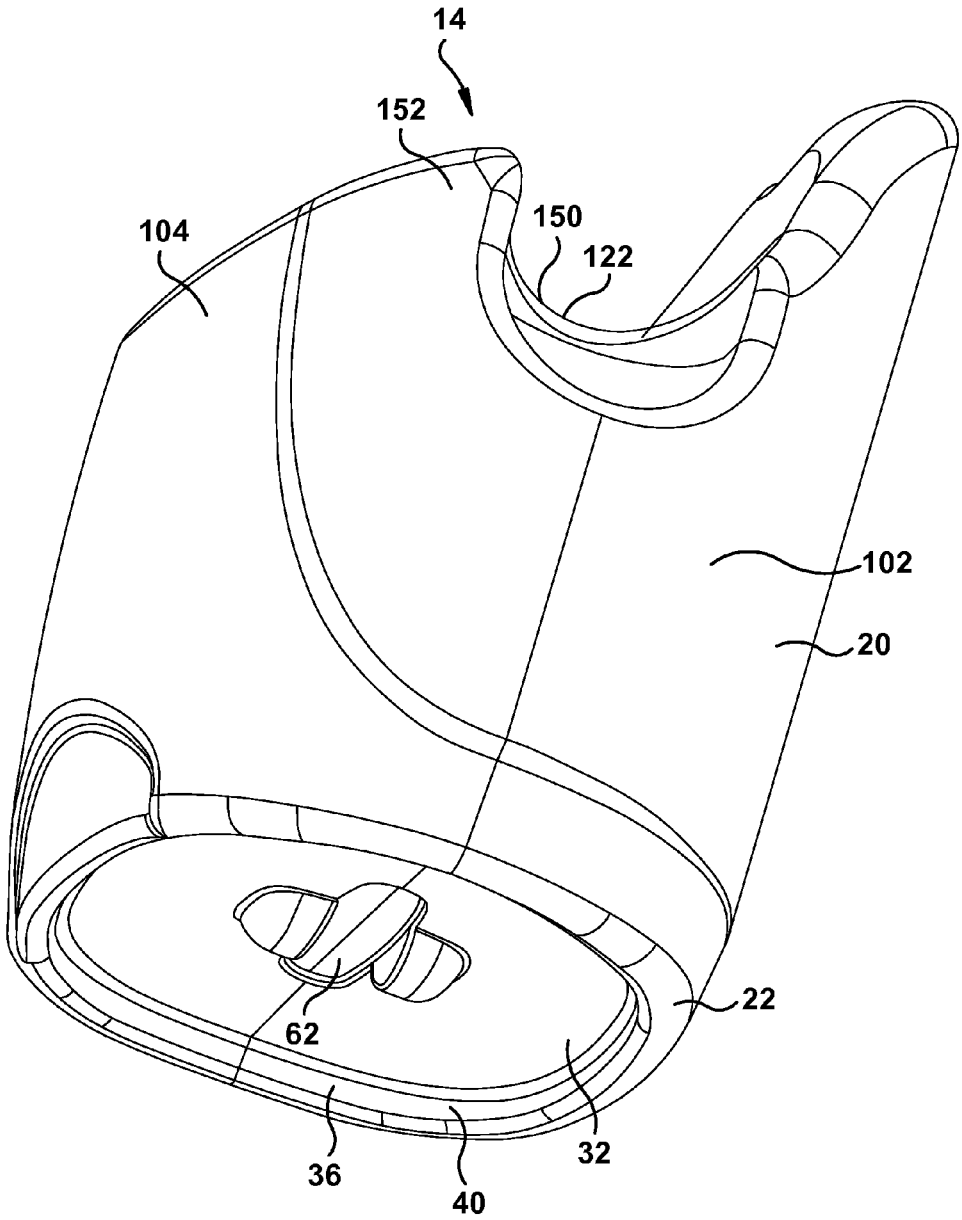
FIG. 9B is a second perspective view of the compressor housing shown in FIG. 9A, showing a lower end of the compressor housing.
Figure 9C:
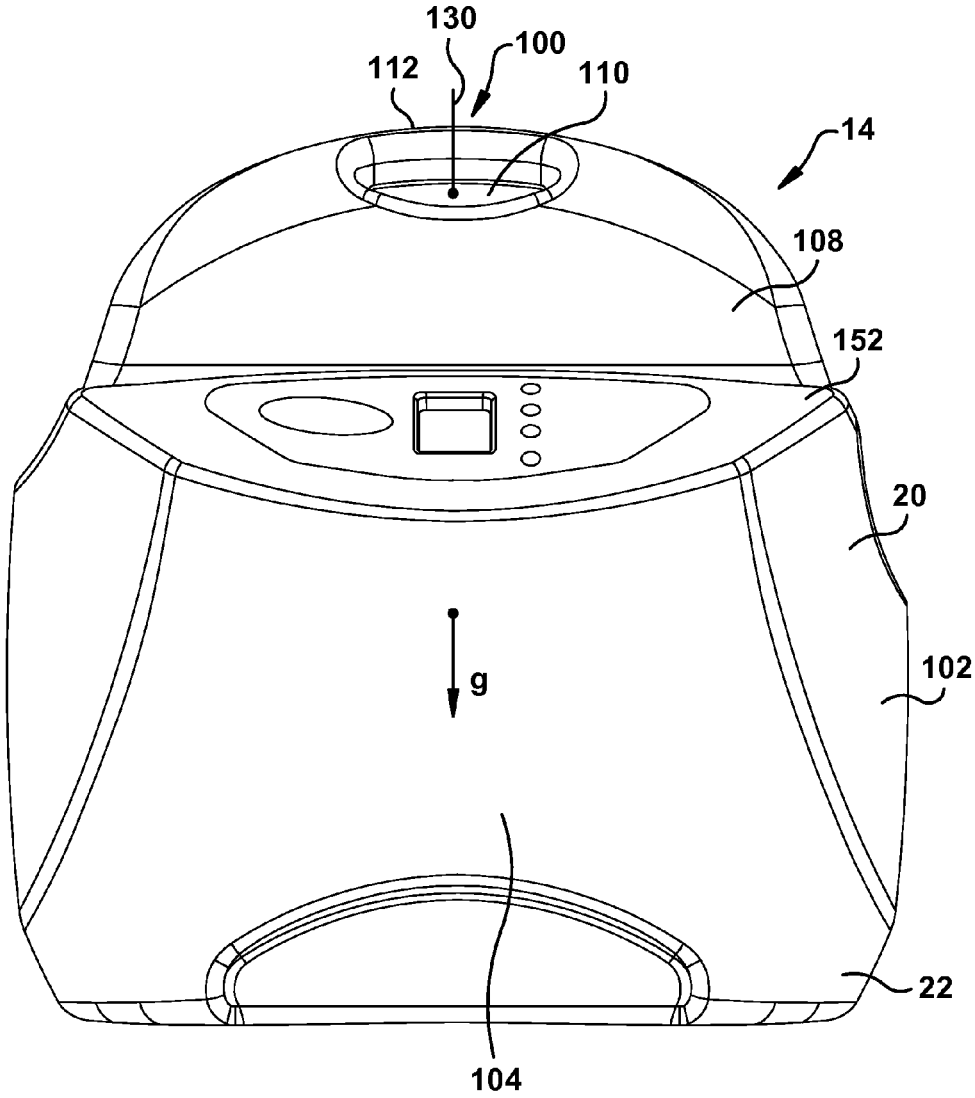
FIG. 9C is a front view of the compressor housing shown in FIG. 9A.
Figure 9D:
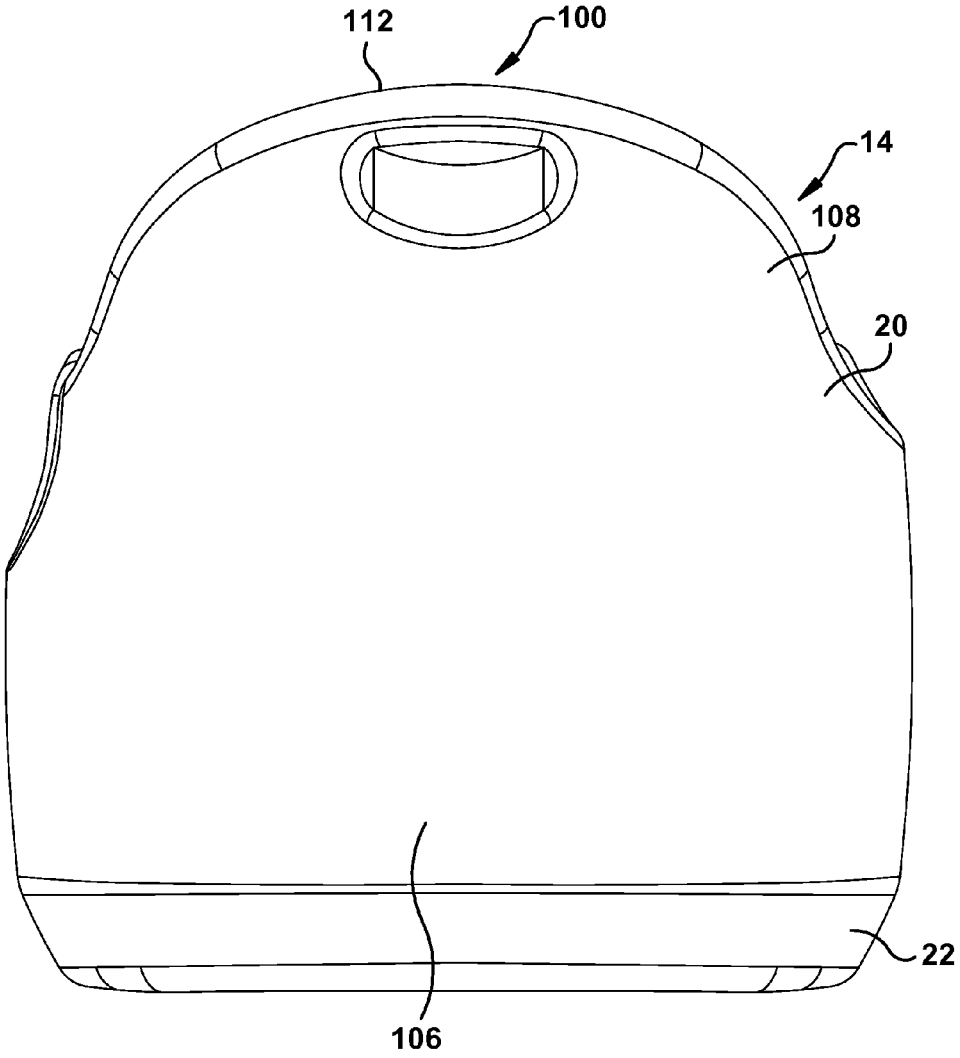
FIG. 9D is a back view of the compressor housing shown in FIG. 9A.
Figure 9E:
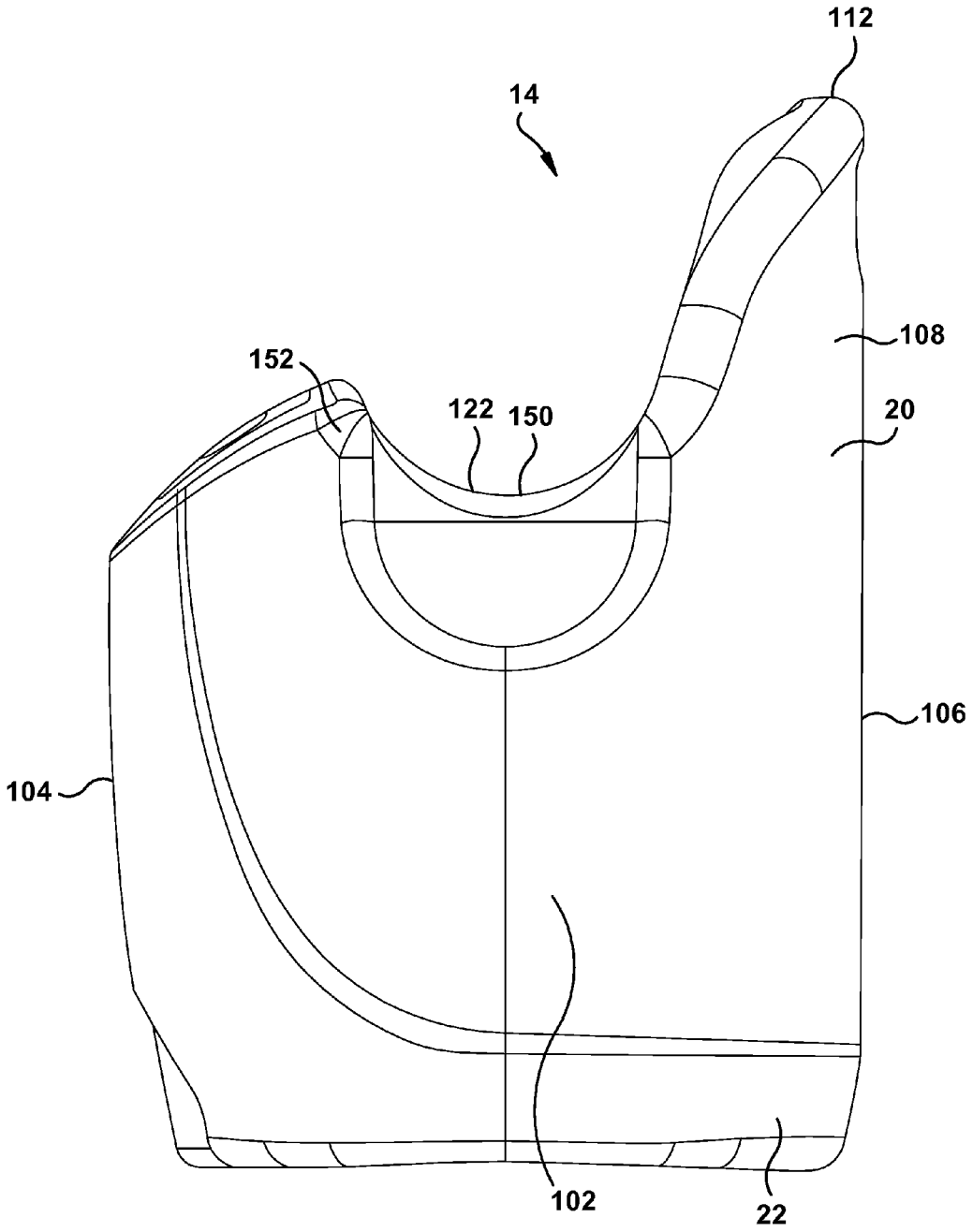
FIG. 9E is a side view of the compressor housing shown in FIG. 9A.
Figure 9F:
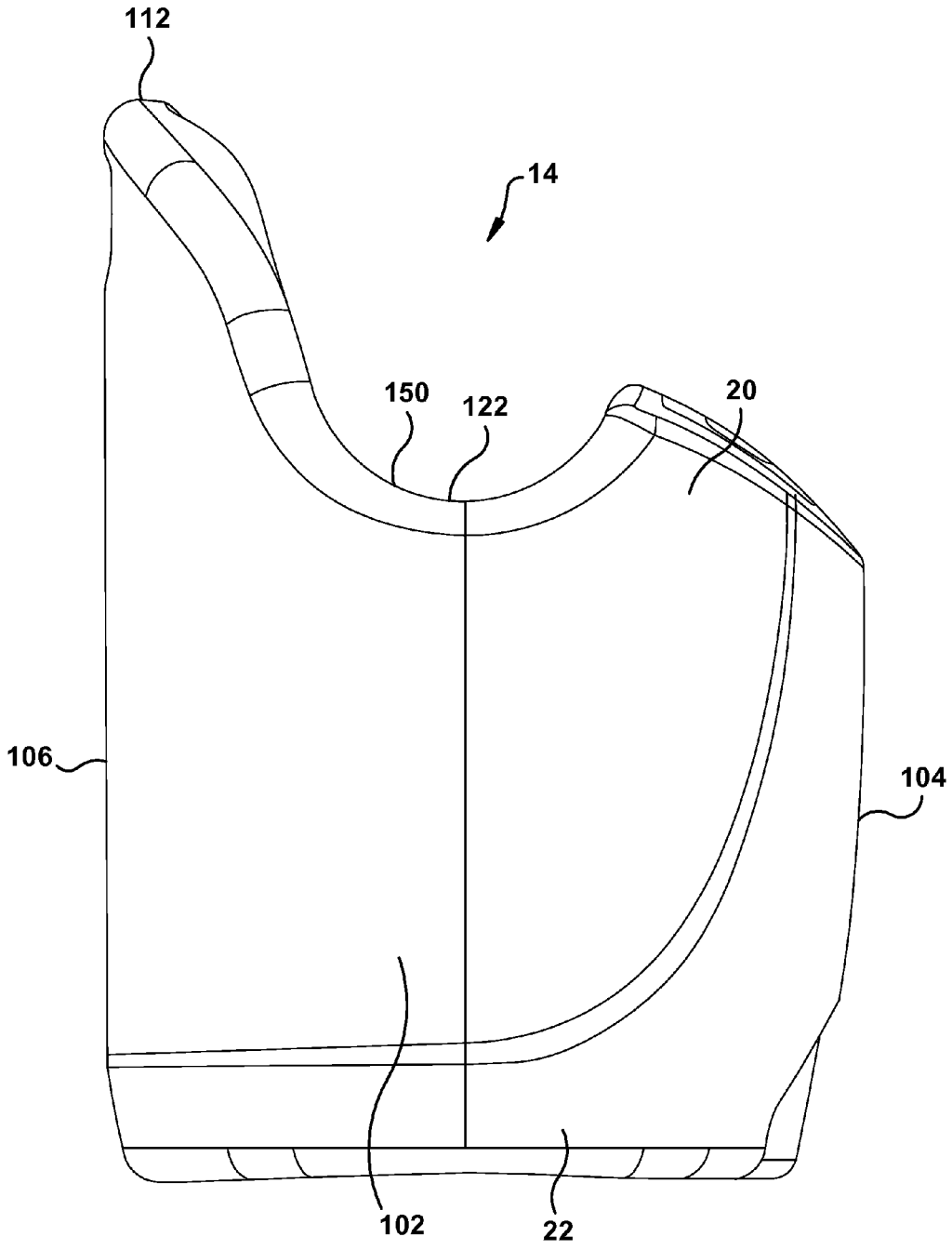
FIG. 9F is a side view of the compressor housing shown in FIG. 9A.
Figure 9G:
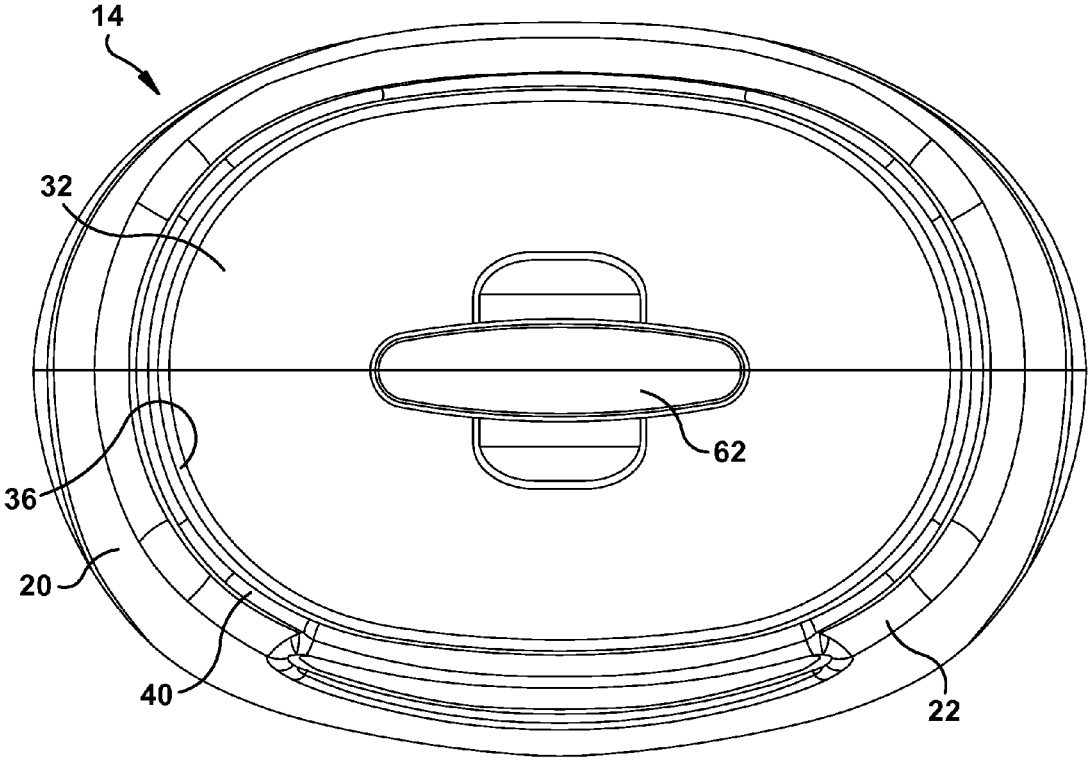
FIG. 9G is a bottom view of the compressor housing shown in FIG. 9A.

In one exemplary embodiment, the weight of the compressor 14 may be laterally distributed, such that a center of gravity g of the compressor is in substantial horizontal alignment with a midpoint 130 of the handle 100 (see FIGS. 3E and 9C). The lateral distance between the center of gravity g may be within 6 inches, within 3 inches, within 2 inches, within 1 inch, or within ½ inch of the midpoint 130 of the handle. Configuring the compressor 14 to have a center of gravity g that is close to the midpoint 130 of the handle 100 can make the compressor 14 easier to lift off of the oxygen concentrator 12, easier to place the compressor 14 on the concentrator, and/or easier to carry, as the compressor 14 will have less of a tendency to cant or tilt toward one side.

With the handle 100 located on the back wall 108, the center of gravity g is forward of the handle. This offset provides little or no increased effort to lift the compressor 14 off of the oxygen concentrator 12, place the compressor 14 on the concentrator, and/or carry the compressor. The illustrated handle 100 has a rounded shape and may simply turn or rotate somewhat in the hand of a person who lifts the compressor 14 off of the oxygen concentrator 12, places the compressor 14 on the concentrator, and/or carries the compressor.

The cradle 122 can take a wide variety of different forms. For example, the cradle 122 can be configured to position the compressed oxygen cylinder 120 to extend from the front 104 toward the back 106 of the compressor housing 20 or the cradle can be configured to position the compressed oxygen cylinder 120 to extend between the sides 102 of the compressor housing 20 as shown in the illustrated embodiments. The illustrated cradle 122 can be offset or shifted from the position shown. For example, the cradles 122 can be shifted forward or rearward, from side to side, and/or up/down from the illustrated positions.

The illustrated cradles 122 include the back wall 108, a support surface 150, and a front wall 152. The illustrated support surface 150 is curved or otherwise shaped to generally conform to the shape of the compressed oxygen cylinder 120. In the embodiments illustrated by FIGS. 1-3 and 7-9, the back wall 108 is configured to extend above the compressed oxygen cylinder 120 to provide access to the handle 100 when the compressed oxygen cylinder is in the cradle. The illustrated front wall 152 is substantially shorter than the back wall 108. For example, the front wall 152 have a height that leaves much of the compressed oxygen cylinder 120 exposed, as illustrated by FIG. 7A. This lower height of the front wall allows the compressed oxygen cylinder to be easily positioned in the cradle 122 and removed from the cradle 122. In the embodiment illustrated by FIGS. 11-13, both the front wall 152 and the back wall 108 have heights that leave much of the compressed oxygen cylinder 120 exposed to allow the oxygen cylinder to be easily accessed from the front or the back of the concentrator 14. In the embodiments illustrated by FIGS. 1-4 and 7-9, a display 160 and/or control 162 for the compressor is disposed on a front face of the front wall 152.

A wide variety of different types of oxygen concentrators 12 and compressors 14 may be used in the assembly 10. For example, U.S. Pat. Nos. 5,988,165 and 6,923,180 and U.S. Patent Application Pub. No. 2007/0065301 disclose examples of suitable oxygen concentrators and compressors and are incorporated herein by reference in their entirety. Another compressor that may be used is disclosed in U.S. Provisional Patent Application No. 61/234,330, a copy of which was attached in Appendix A of U.S. Provisional Application Ser. No. 61/302,906 and is fully incorporated herein by reference. Other types of compressor designs are also applicable and the system and method herein are not limited to any particular type of compressor design or structure unless otherwise noted.

Figure 15:
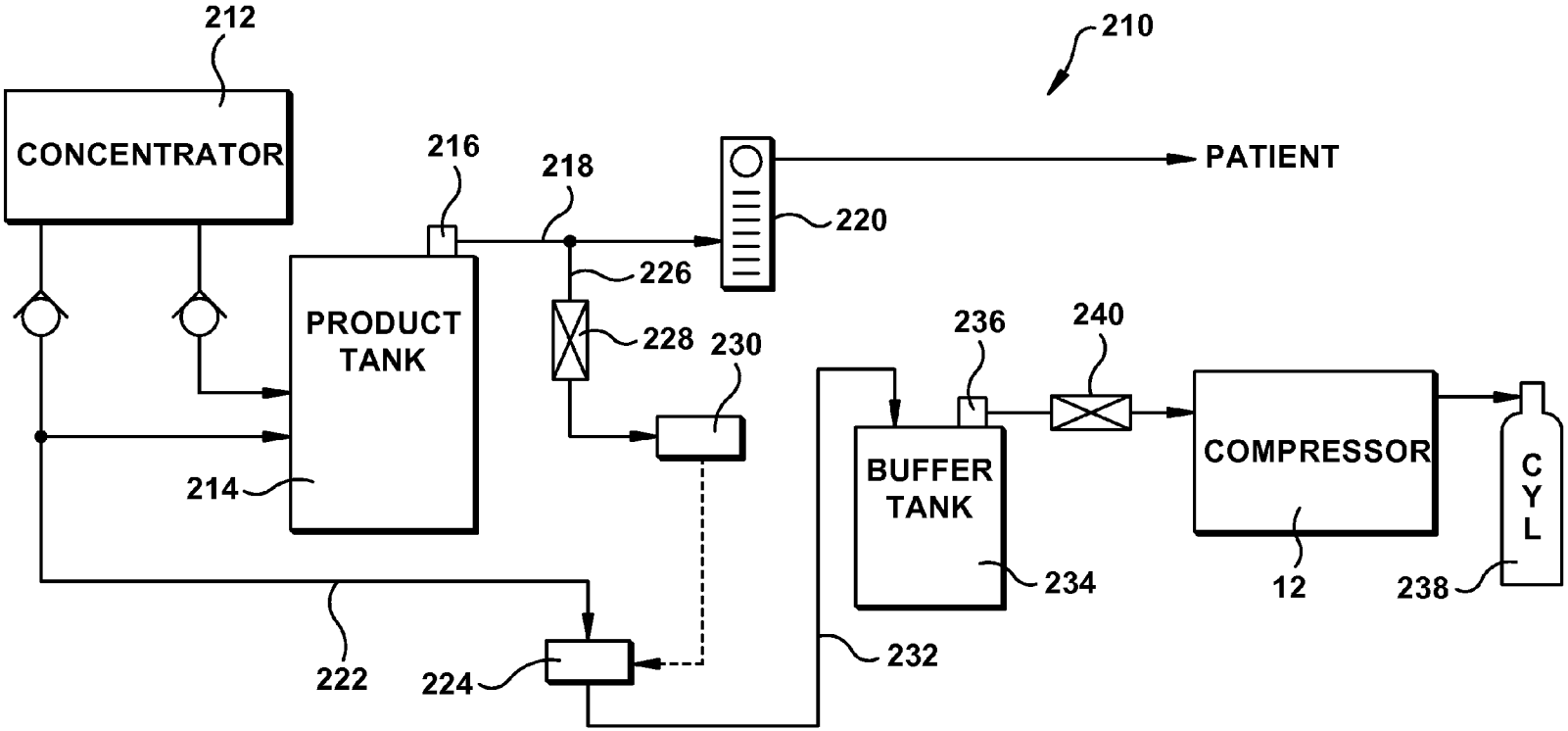
FIG. 15 is a schematic illustration of an exemplary system that can be included in the disclosed housings, including a compressor, for providing oxygen-enriched gas for use by a patient.

FIG. 15 illustrates one embodiment of a system 210 that may be provided by the oxygen concentrator 12 and the compressor 14. The system 210 includes a concentrator 212 that is operable to provide oxygen-enriched gas, for example, from an ambient air input. The oxygen-enriched gas is fed to a product tank 214. A 5-psi regulator 216 emits oxygen-enriched gas from the product tank 214 into a flow line 218 and feeds the same to a flow meter 220 which subsequently emits the oxygen-enriched gas to the patient at a predetermined flow rate of from 0.1 to 6 liters per minute. Optionally, the flow meter 220 can be closed so that all the oxygen-enriched gas is directed to the compressor 12. The compressor may take a wide variety of forms.

Gas not directed to the patient is carried via line 222 to two-way valve 224. A very small portion of the gas in the flow line 220 is directed through line 226 and restrictor 228 into an oxygen sensor 230 which detects whether or not the concentration of the oxygen is of a predetermined value, for example, at least 84 percent as directed to the patient and at least 93±3% as directed to the compressor. Other concentrations may also be provided including 85-95% or more.

When the oxygen sensor 230 detects a concentration at or above the predetermined level, the two-way valve 224 is kept open to permit the oxygen-enriched gas to flow through the valve 224 and line 232 into a buffer tank 234 wherein the pressure is essentially the same as the pressure in the product tank 214. However, should the oxygen sensor 230 not detect a suitable oxygen concentration, two-way valve 224 is closed so that the oxygen concentrator 212 can build up a sufficient oxygen concentration. This arrangement prioritizes the flow of oxygen-enriched gas so that the patient is assured of receiving a gas having a sufficient oxygen concentration therein.

Buffer tank 234 can have a regulator 236 thereon generally set at 12 psi to admit the oxygen-enriched gas to the compressor 12 when needed. The output of the compressor 12 is used to fill a cylinder or portable tank 238 for ambulatory use by the patient. Alternatively, the pressure regulator 236 can be set at anywhere from about 13 to about 21 psi. A restrictor 240 controls the flow rate of gas from the buffer tank 234 to the compressor 12. Should the operation of the compressor 12 cause the pressure in the buffer tank 234 to drop below a predetermined value, a pressure sensor (not shown) automatically cuts off the flow of gas at a pressure above the pressure of the gas being fed to the patient. This prioritization assures that the patient receives priority with regard to oxygen-enriched gas. In other embodiments, prioritization may be optional or even excluded.

Figure 16:
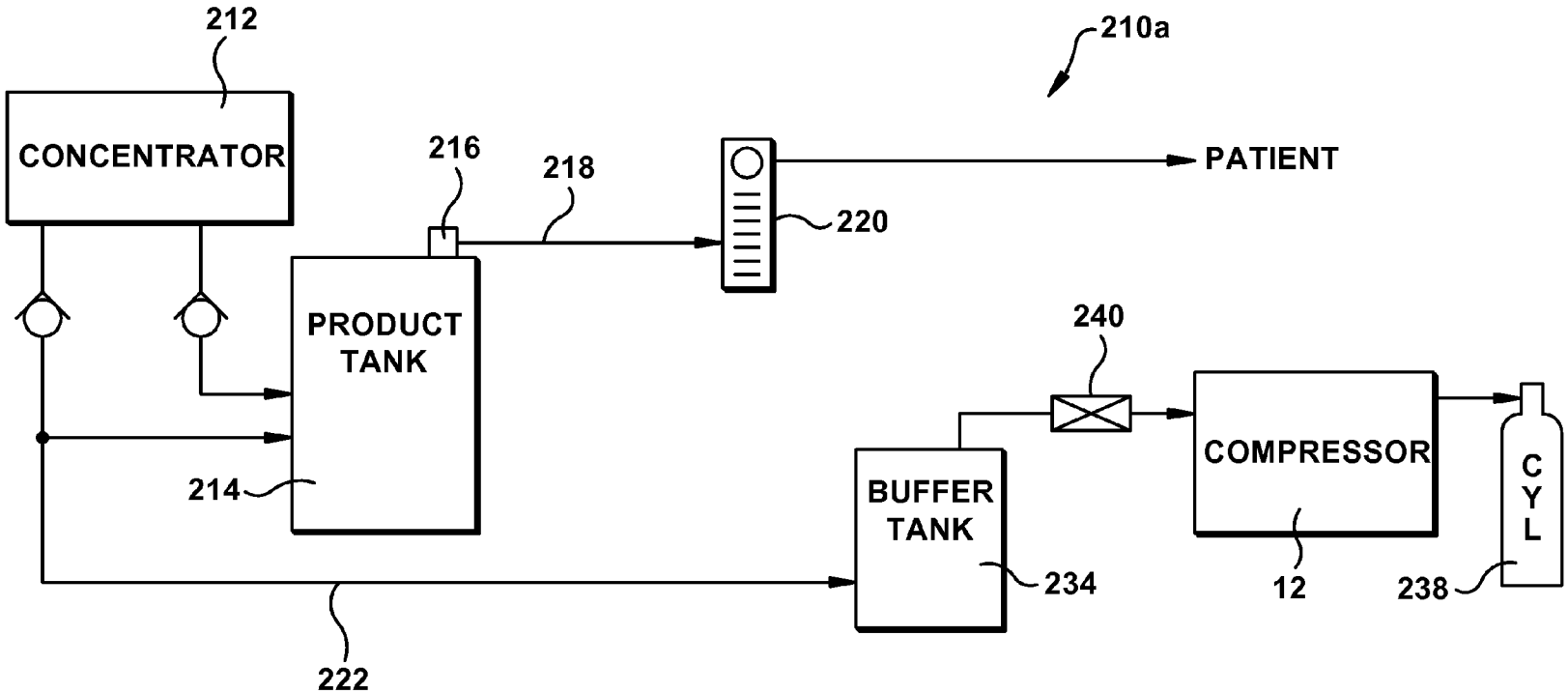
FIG. 16 is a schematic illustration of a second exemplary system that can be included in the disclosed housings, including a compressor, for providing oxygen-enriched gas for use by a patient.

FIG. 16 shows a system 210*a* that is somewhat different from the system 210 of FIG. 15. In the system 210*a*, the compressor 12 includes its own oxygen sensor and control circuitry, so that the elements 224-232 are not present as they are in the system shown in FIG. 15. In addition, the regulator 236 is not present on the buffer tank. A flow restrictor may be provided between the concentrator and the buffer tank. (It should be noted that the buffer tank 234 is optional in all systems, and that the compressor could be fed directly from the product tank.)

In yet another embodiment, the oxygen concentrator patient feed can be used to feed the oxygen gas to the compressor 12. A suitable connector may also be employed to divide the patient feed so as to form two streams: one to the patient and another to the buffer tank 234 or compressor 12. Hence, the system and method for providing the breathing gas may include more or less components than are illustrated herein.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, hardware, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

While the present invention has been illustrated by the description of embodiments thereof, and while the embodiments have been described in considerable detail, it is not the intention of the applicant to restrict or in any way limit the scope of the invention to such detail. Additional advantages and modifications will readily appear to those skilled in the art. For example, the specific locations of the component connections and interplacements can be modified. Therefore, the invention, in its broader aspects, is not limited to the specific details, the representative apparatus, and illustrative examples shown and described. Accordingly, departures can be made from such details without departing from the spirit or scope of the applicant's general inventive concept.

Having described the invention, we claim:

1. An oxygen concentrator and compressor assembly comprising:

an oxygen concentrator disposed in a housing having an upper end;

a compressor disposed in a housing having a lower end;

wherein said upper end of said oxygen concentrator housing and said lower end of the compressor housing are configured such that placement of the lower end of the compressor housing on the upper end of the oxygen concentrator housing sets the position of the compressor housing with respect to the oxygen concentrator housing;

wherein the upper end of the oxygen concentrator housing includes at least one surface that is generally congruent to at least one surface of the lower end of the compressor housing;

wherein the at least one surface of the oxygen concentrator housing comprises a handle of the oxygen concentrator; and wherein the at least one surface of the compressor housing comprises a recess that accepts said handle of the oxygen concentrator.

2. The assembly of claim 1 wherein the at least one surface of the upper end of the oxygen concentrator housing engages the at least one surface of the lower end of the compressor housing to set the position of the oxygen concentrator housing with respect to the compressor housing.

3. The assembly of claim 1 wherein the at least one surface of the upper end of the oxygen concentrator housing engages the at least one surface of the lower end of the compressor housing to set the position of the oxygen concentrator housing with respect to the compressor housing such that the position of the compressor housing is not moveable with respect to the oxygen concentrator housing without disengaging the compressor housing from the oxygen concentrator housing.

4. The assembly of claim 2 wherein the at least one surface of the upper end of the oxygen concentrator housing and the at least one surface of the lower end of the compressor housing are shaped to allow placement of the compressor housing on the oxygen concentrator housing at only a single orientation.

5. The assembly of claim 1 wherein the at least one surface of the lower end of the compressor housing extends substantially around an entirety of a perimeter of the lower end of the compressor housing.

6. The assembly of claim 1 wherein the at least one surface of the oxygen concentrator housing comprises at least one projection extending from said upper end of the oxygen concentrator housing.

7. The assembly of claim 6 wherein the at least one surface of the compressor housing comprises a recess that accepts said projection of the oxygen concentrator housing.

8. The assembly of claim 7 wherein the recess is defined by a skirt that extends around a perimeter of the compressor housing.

9. The assembly of claim 8 wherein the skirt of the compressor engages the projection of the oxygen concentrator housing.

10. The assembly of claim 1 further comprising a conduit that connects an outlet of the oxygen concentrator to an inlet of the compressor.

11. The assembly of claim 1 wherein an outlet of concentrated oxygen is coupled to an inlet of the compressor by placing the lower end of the compressor housing on the upper end of the concentrator housing.

12. The assembly of claim 1 further comprising a latch for securing the compressor housing to the oxygen concentrator housing.

13. The assembly of claim 1 further comprising a detent arrangement between the compressor housing and the oxygen concentrator housing.

14. The assembly of claim 13 wherein the detent arrangement snap-connects the compressor housing to the oxygen concentrator housing when the compressor housing is placed on the oxygen concentrator housing.

15. An oxygen concentrator and compressor assembly comprising:

an oxygen concentrator disposed in a housing having an upper end;

a compressor disposed in a housing having a lower end;

wherein said upper end of said oxygen concentrator housing and said lower end of the compressor housing are configured such that placement of the lower end of the compressor housing on the upper end of the oxygen concentrator housing sets the position of the compressor housing with respect to the oxygen concentrator housing;

wherein the upper end of the oxygen concentrator housing includes at least one surface that is generally congruent to at least one surface of the lower end of the compressor housing;

wherein the at least one surface of the oxygen concentrator housing comprises at least one projection extending from said upper end of the oxygen concentrator housing;

wherein the at least one surface of the compressor housing comprises a recess that accepts said projection of the oxygen concentrator housing;

wherein the recess is defined by a skirt that extends around a perimeter of the compressor housing; and wherein the skirt of the compressor engages the projection of the oxygen concentrator housing.

16. The assembly of claim 15 wherein the at least one surface of the upper end of the oxygen concentrator housing engages the at least one surface of the lower end of the compressor housing to set the position of the oxygen concentrator housing with respect to the compressor housing.

17. The assembly of claim 15 wherein the at least one surface of the upper end of the oxygen concentrator housing engages the at least one surface of the lower end of the compressor housing to set the position of the oxygen concentrator housing with respect to the compressor housing such that the position of the compressor housing is not moveable with respect to the oxygen concentrator housing without disengaging the compressor housing from the oxygen concentrator housing.

18. The assembly of claim 16 wherein the at least one surface of the upper end of the oxygen concentrator housing and the at least one surface of the lower end of the compressor housing are shaped to allow placement of the compressor housing on the oxygen concentrator housing at only a single orientation.

19. The assembly of claim 15 wherein the at least one surface of the lower end of the compressor housing extends substantially around an entirety of a perimeter of the lower end of the compressor housing.

20. The assembly of claim 15 wherein the at least one surface of the oxygen concentrator housing comprises a handle of the oxygen concentrator.

21. The assembly of claim 20 wherein the at least one surface of the compressor housing comprises a recess that accepts said handle of the oxygen concentrator.

22. The assembly of claim 15 further comprising a conduit that connects an outlet of the oxygen concentrator to an inlet of the compressor.

23. The assembly of claim 15 wherein an outlet of concentrated oxygen is coupled to an inlet of the compressor by placing the lower end of the compressor housing on the upper end of the concentrator housing.

24. The assembly of claim 15 further comprising a latch for securing the compressor housing to the oxygen concentrator housing.

25. The assembly of claim 15 further comprising a detent arrangement between the compressor housing and the oxygen concentrator housing.

26. The assembly of claim 25 wherein the detent arrangement snap-connects the compressor housing to the oxygen concentrator housing when the compressor housing is placed on the oxygen concentrator housing.

27. An oxygen concentrator and compressor assembly comprising:

an oxygen concentrator disposed in a housing having an upper end;

a compressor disposed in a housing having a lower end;

wherein said upper end of said oxygen concentrator housing and said lower end of the compressor housing are configured such that placement of the lower end of the compressor housing on the upper end of the oxygen concentrator housing sets the position of the compressor housing with respect to the oxygen concentrator housing; and wherein an outlet of concentrated oxygen is coupled to an inlet of the compressor by placing the lower end of the compressor housing on the upper end of the concentrator housing.

28. The assembly of claim 27 wherein the upper end of the oxygen concentrator housing includes at least one surface that is generally congruent to at least one surface of the lower end of the compressor housing.

29. The assembly of claim 28 wherein the at least one surface of the upper end of the oxygen concentrator housing engages the at least one surface of the lower end of the compressor housing to set the position of the oxygen concentrator housing with respect to the compressor housing.

30. The assembly of claim 28 wherein the at least one surface of the upper end of the oxygen concentrator housing engages the at least one surface of the lower end of the compressor housing to set the position of the oxygen concentrator housing with respect to the compressor housing such that the position of the compressor housing is not moveable with respect to the oxygen concentrator housing without disengaging the compressor housing from the oxygen concentrator housing.

31. The assembly of claim 29 wherein the at least one surface of the upper end of the oxygen concentrator housing and the at least one surface of the lower end of the compressor housing are shaped to allow placement of the compressor housing on the oxygen concentrator housing at only a single orientation.

32. The assembly of claim 28 wherein the at least one surface of the lower end of the compressor housing extends substantially around an entirety of a perimeter of the lower end of the compressor housing.

33. The assembly of claim 28 wherein the at least one surface of the oxygen concentrator housing comprises a handle of the oxygen concentrator.

34. The assembly of claim 33 wherein the at least one surface of the compressor housing comprises a recess that accepts said handle of the oxygen concentrator.

35. The assembly of claim 28 wherein the at least one surface of the oxygen concentrator housing comprises at least one projection extending from said upper end of the oxygen concentrator housing.

36. The assembly of claim 35 wherein the at least one surface of the compressor housing comprises a recess that accepts said projection of the oxygen concentrator housing.

37. The assembly of claim 36 wherein the recess is defined by a skirt that extends around a perimeter of the compressor housing.

38. The assembly of claim 37 wherein the skirt of the compressor engages the projection of the oxygen concentrator housing.

39. The assembly of claim 27 further comprising a conduit that connects an outlet of the oxygen concentrator to an inlet of the compressor.

40. The assembly of claim 27 further comprising a latch for securing the compressor housing to the oxygen concentrator housing.

41. The assembly of claim 27 further comprising a detent arrangement between the compressor housing and the oxygen concentrator housing.

42. The assembly of claim 41 wherein the detent arrangement snap-connects the compressor housing to the oxygen concentrator housing when the compressor housing is placed on the oxygen concentrator housing.

* * * * *